US007952525B2

(12) United States Patent
Hirabayashi

(10) Patent No.: US 7,952,525 B2
(45) Date of Patent: May 31, 2011

(54) ANTENNA DEVICE ASSOCIATED WIRELESS COMMUNICATION APPARATUS AND ASSOCIATED CONTROL METHODOLOGY FOR MULTI-INPUT AND MULTI-OUTPUT COMMUNICATION SYSTEMS

(75) Inventor: Takayuki Hirabayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 177 days.

(21) Appl. No.: 11/443,146

(22) Filed: May 31, 2006

(65) Prior Publication Data

US 2007/0035463 A1 Feb. 15, 2007

(30) Foreign Application Priority Data

Jun. 3, 2005 (JP) ..... 2005-164828
Jun. 3, 2005 (JP) ..... 2005-164829

(51) Int. Cl.
*H01Q 1/38* (2006.01)

(52) U.S. Cl. ..... 343/700 MS

(58) Field of Classification Search ..... 343/700 MS, 343/876, 702, 756
See application file for complete search history.

(56) References Cited

U.S. PATENT DOCUMENTS

| | | | | |
|---|---|---|---|---|
| 6,441,395 | B1 | 8/2002 | Yu et al. | |
| 6,501,427 | B1 * | 12/2002 | Lilly et al. | 343/700 MS |
| 6,762,950 | B2 | 7/2004 | Gudesen et al. | |
| 7,075,485 | B2 * | 7/2006 | Song et al. | 343/700 MS |
| 2003/0052834 | A1 * | 3/2003 | Sievenpiper et al. | 343/909 |
| 2006/0105730 | A1 * | 5/2006 | Modonesi et al. | 455/273 |
| 2006/0223450 | A1 * | 10/2006 | Dacosta | 455/73 |

FOREIGN PATENT DOCUMENTS

| | | | |
|---|---|---|---|
| JP | 53-141006 | | 8/1983 |
| JP | 1-179613 | | 12/1989 |
| JP | 2000-4119 | | 1/2000 |
| JP | 20004119 | A1 * | 1/2000 |
| JP | 2002-502128 | | 1/2002 |
| JP | 2002-280826 | | 9/2002 |
| JP | 2002-290148 | | 10/2002 |
| JP | 2003-32164 | | 1/2003 |
| JP | 2003-204295 | | 7/2003 |
| JP | 2004-64059 | | 2/2004 |
| JP | 2004-517549 | | 6/2004 |
| JP | 2004-274223 | | 9/2004 |
| JP | 2004-304760 | | 10/2004 |
| JP | 2004-312381 | | 11/2004 |
| JP | 2004-364262 | | 12/2004 |
| JP | 2005-510866 | | 4/2005 |
| WO | WO99/66592 | * | 12/1999 |
| WO | WO0120718 | A1 * | 3/2001 |
| WO | WO2004/084344 | * | 9/2004 |

* cited by examiner

*Primary Examiner* — Jacob Y Choi
*Assistant Examiner* — Robert Karacsony
(74) *Attorney, Agent, or Firm* — Oblon, Spivak, McClelland, Maier & Neustadt, L.L.P.

(57) ABSTRACT

An antenna device has a substrate of insulation and a conductive flat antenna main body having a predetermined shape. The flat antenna main body is positioned on the substrate. The antenna device also has conductive polarization control elements that are positioned along a transverse line across the flat antenna main body over an insulation region of the substrate. The antenna device further has switching elements each being connected with the flat antenna main body and each of the polarization control elements. The switching elements switch the polarization control elements to select polarization that a flat antenna radiates.

11 Claims, 28 Drawing Sheets

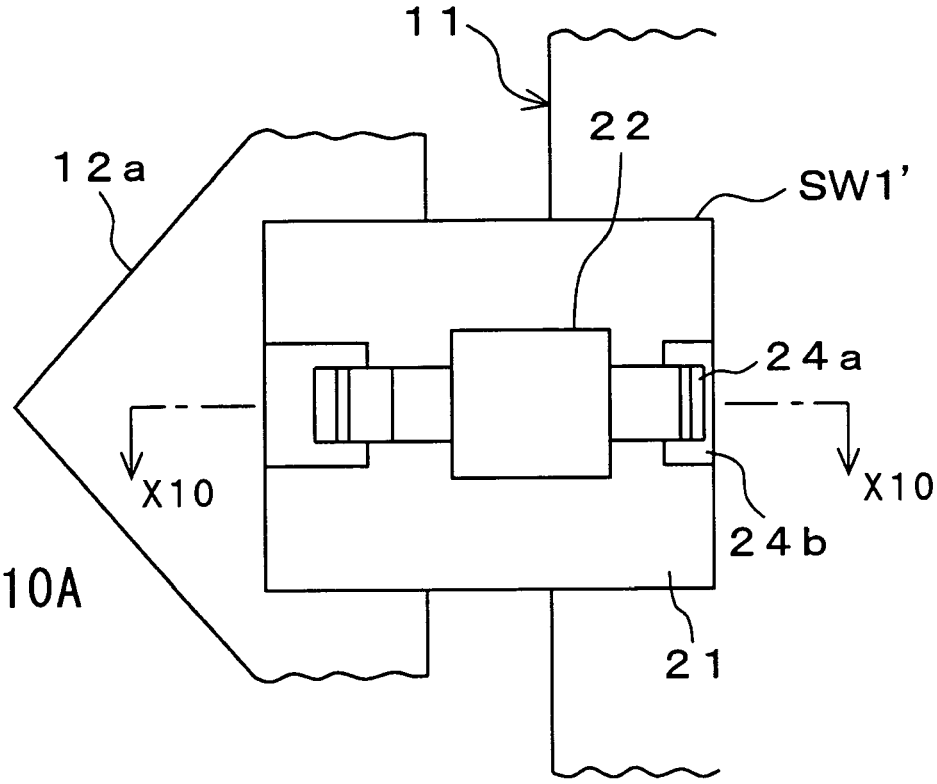
FIG. 10A
FIG. 10B
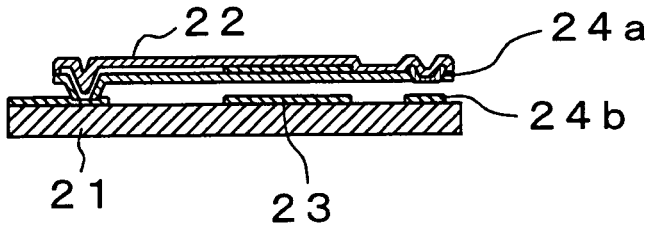
FIG. 10C
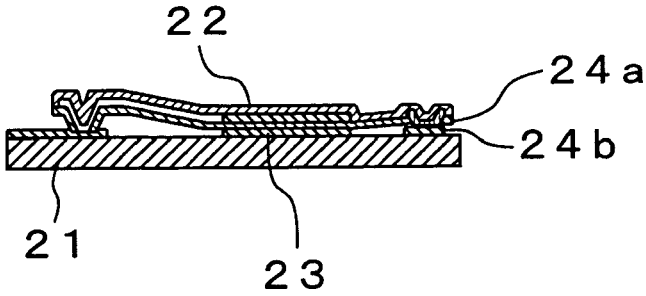

ANTENNA DEVICE ASSOCIATED WIRELESS COMMUNICATION APPARATUS AND ASSOCIATED CONTROL METHODOLOGY FOR MULTI-INPUT AND MULTI-OUTPUT COMMUNICATION SYSTEMS

CROSSREFERENCE TO RELATED APPLICATION

The present invention contains subject matters related to Japanese Patent Applications Nos. JP 2005-164828 and JP2005-164829 each filed in the Japanese Patent Office on Jun. 3, 2005, the entire contents of which being incorporated herein by reference.

BACKGROUND OF THE INVENTION

1. Field of the Invention

The present invention relates to an antenna device, a wireless communication apparatus, a control method of controlling the wireless communication apparatus, a computer program product therefor, and a computer-readable storage medium therefor. More particularly, it relates to an antenna device and the like that transmit and receive at the same time an signal according to a multi-input and multi-output (MIMO) communication system using any plural flat antennas.

2. Description of Related Art

Recently, a wireless communication function has been often implemented in an information processing apparatus such as a personal computer, a mobile phone, a communication terminal such as a personal digital assistance, and any various kinds of consumer appliances such as an audio instrument, video equipment, a camera, a printer, and an entertainment robot. Further, such the wireless communication function has been often implemented in not only the electronics but also an access point for a wireless local area network (LAN) and a so-called accessory card of small size such as a card specified by personal computer memory card international association (PCMCIA), a compact flash card (trademark), and a mini peripheral component interconnection (PCI) card. Any wireless card module having such the wireless communication function and a storage function has been adapted.

A residential wireless LAN has particularly used institute of electrical and electronics engineers (IEEE) 802.11a that utilizes a carrier frequency with a band of 5.2 Ghz, and IEEE802.11b/g that utilizes a carrier frequency with a band of 2.4 Ghz. Such these IEEE802.11a and IEEE802.11b/g have data transmission rate of 54 Mbps but any research and development for wireless schemes have been recently performed to implement any faster data transmission rate, accompanying an increase in an amount of data (information) to be dealt with.

The MIMO communication system has been proposed as remarkable one of such the wireless schemes that can perform any faster data transmission rate. In the MIMO communication system, any wireless communication can be performed utilizing any spatial multipath propagation channels by using plural antennas. IEEE 802.11a and IEEE802.11g that have been used in the wireless LAN at the present use as a modulation system an orthogonal frequency division multiplexing (OFDM). Acceptance of OFDM causes any transmission by each sub carrier to be almost considered as flat fading. This allows the MIMO propagation channels to be represented as a simple model to some extent in a relative broadband communication system such as IEEE802.11a and IEEE802.11g, thereby being enabling the MIMO communication system to be implemented in any actual wireless applications.

Japanese Patent Application Publication No. 2002-280826 discloses a wireless communication apparatus having an antenna of such the MIMO communication system. The wireless communication apparatus has a cluster of antenna that is composed of n antennas. The antenna can transmit and receive signals each having a relative low correlation therebetween and has many antenna ports each being coupled to a signal-processing device. The cluster of antennas operates within a frequency band having maximum frequency and at least a pair of the antenna ports is placed in a volume of space whose longest linear dimension is $\lambda/3$ or less. Such the antenna arrangement enables the cluster of antennas that can transmit and receive the non-correlated signals at the same time in the MIMO communication system, which is applicable to a mobile wireless terminal device, to be provided.

Japanese Patent Application Publication No. 2002-290148 discloses an antenna array. The antenna array has groups of antennas where each group includes two pairs of antennas. Each of the pairs of antennas in a group contains orthogonally polarized antennas. An antenna circuitry is coupled to the antenna groups to enable the antenna array to operate in a beam forming/steering mode, a diversity mode or a MIMO mode or any combination thereof. Such the antenna array arrangement enables to be provided the antenna array that can operate under the beam forming/steering mode, the diversity mode or the MIMO mode concerning any transmitting and receiving signals without any additional antennas.

Japanese Patent Application Publication No. 2003-204295 discloses a diversity system, a base apparatus, and a diversity control method. The diversity system has plural antenna elements, so that multiple coming electronic waves can be separated into multiple paths for each angle based on the receiving signals received by these antenna elements. By measuring a mutual relationship between the separated paths, plural transmission directions for a transmission diversity can be determined based on the measured mutual relationship. Any transmission weights of the antenna elements for transmitting the signals towards the determined transmission directions can be then calculated. Such the system configuration prevents any fading to enable any attenuation in receiving signals to be improved and prevents the signals from being interfered with each other.

FIG. 1 illustrates a configuration of an MIMO communication system relative to a related art when propagating a signal. The MIMO communication system illustrated in FIG. 1 has a transmission unit 2*a* in a transmitting terminal 2. The transmission unit 2*a* has m transmitting antennas TX (m is an integer). A receiving terminal 4 has a reception unit 4*a*. The reception unit 4*a* has n receiving antennas RX (n is an integer). The transmitting terminal 2 communicates to the receiving terminal 4 using plural radio wave propagation channels 3.

For example, the transmission unit 2*a* receives a transmitting signal, performs any spatial multiple encoding thereon to modulate it, and emits (or radiates) any radio waves on the modulated transmitting signal into the radio wave propagation channels 3 by means of m transmitting antennas TX. The receiving terminal 4 receives any coming radio waves through the radio wave propagation channels 3 by means of n receiving antennas RX. The reception unit 4*a* receives the received radio waves and performs any time-space decoding on it to demodulate and output the receiving signal.

It is to be noted that as demodulation scheme in the MIMO, any various kinds of demodulation schemes have been proposed as following: a demodulation scheme wherein a transmission side knows no channel information and only the reception side performs any linear calculation to demodulate it, for example, zero forcing, vertical bell labs layered space-time (V-BLAST); a demodulation scheme wherein a non-linear calculation is performed and demodulated, for example, so-called maximum likelihood detection (MLD); a demodulation scheme wherein two series of the transmitting signals have any orthogonality to each other by space time block coding (STBC); a demodulation scheme wherein the transmission side has already known any channel information and suitable power distribution corresponding thereto and a phase vector synthesis are performed to transmit and receive the signals, for example, an Eigen-mode MIMO; and the like.

In this MIMO communication system, as a principle, a data transmission rate is linearly increased in proportion to the increased numbers of antennas. Such the MIMO communication system uses any radio wave propagation environment, namely, any multipath environment in which reflection, scatter, diffraction, screening of the signals to be received and transmitted are intermingled in the radio wave propagation channels 3. Accompanying the above, a spatial correlation property thereof has any serious influence on its information transmission faculty, so that in the MIMO communication system, a method of reducing interference between the signals as broadly as possible has been proposed until now.

FIG. 2 illustrates an example of attachment of antenna for linear polarization that is used in the MIMO communication system. According to the antenna attachment for linear polarization shown in FIG. 2, a vertical polarization antenna 5*a* and a horizontal polarization antenna 5*b* are attached to a set box 5 or the like. For example, the vertical polarization antenna 5*a* and the horizontal polarization antenna 5*b* are orthogonally arranged.

FIG. 3 illustrates an example of attachment of antenna for circular polarization that is used in the MIMO communication system. According to the antenna attachment for circular polarization shown in FIG. 3, a right-handed circular polarization antenna 6*a* and a left-handed circular polarization antenna 6*b* are attached to a set box 5 or the like. For example, the right-handed circular polarization antenna 6*a* and the left-handed circular polarization antenna 6*b* are orthogonally arranged. Thus, orthogonal arrangement of these polarizations in the linear polarization antenna and the circular polarization antenna allows any quality in the MIMO transmission to be improved.

SUMMARY OF THE INVENTION

It, however, is difficult to orthogonalize the polarizations continually in the above MIMO communication systems. This is because a case where radio wave can be transmitted and/or received under a line of sight (LOS) is rare even in an indoor wireless LAN and an outdoor mobile communication and a case where radio wave can be transmitted and/or received under a non line of sight (NLOS), which is a multipath-rich environment including any reflected waves, is almost. If such the multipath-rich environment is used in the MIMO communication system, it is possible for the polarizations to be orthogonalized to be interfered by any influence of the reflection objects.

FIG. 4 illustrates an example of receiving a signal in the receiving terminal 4 when two antennas 7, 8 of the transmitting terminal 2 are set as transmitting the signals with both of them being as right-handed circular polarizations and the receiving terminal 4 receives the signals when radio wave radiated from one of the antennas is reflected by an object 403 once. If the radio wave is reflected by an object 403 once, its polarization rotates to become a reverse circular polarization, thereby causing the receiving terminal 4 to receive a left-handed circular polarization. Thus, even if both of the antennas of the transmitting terminal 2 transmit the signals with them being as same-handed circular polarizations, when radio wave radiated from one of the antennas is reflected by the object, its polarization rotates to become a reverse circular polarization. This may prevent any interference from occurring in the receiving terminal 4.

FIG. 5 illustrates an example of receiving a signal in the receiving terminal 4 when two antennas 7, 8 of the transmitting terminal 2 are set as transmitting the signals with one of them being as right-handed circular polarization and the other being as left-handed circular polarization and the receiving terminal 4 receives the signals when radio wave radiated from one of the antennas is reflected by an object 403 once. If the radio wave is reflected by an object 403 once, its polarization rotates to become a reverse circular polarization, thereby causing the receiving terminal 4 to receive a right-handed circular polarization. Thus, even if both of the antennas of the transmitting terminal 2 transmit the signals with them being as right and left-handed circular polarizations, separately, when radio wave radiated from one of the antennas is reflected by the object, its polarization rotates to become a reverse circular polarization. This may cause any interference to occur in the receiving terminal 4.

Thus, under the multipath-rich environment, the polarization alters variously. Even if the signals having orthogonality with each other are radiated, any excellent communication quality may not be absolutely given according to any radio wave environments.

In order to cope well with this, if the transmitting terminal 2 equips itself with antennas for linear polarization and the right and left-handed circular polarizations and uses them by means of any control over a switch in these antennas, he numbers of antennas are increased in the MIMO communication system, nevertheless many antennas are necessary for the MIMO communication system. This may result in any increase in its costs, and spaces for attaching the antennas may occupy most of the set box 5.

It is desirable to provide an antenna device, a wireless communication apparatus, a control method of controlling the wireless communication apparatus, a computer program product therefor, and a computer-readable storage medium therefor that are possible to select any combination of antenna elements to configure three kinds of antennas for linear polarization, and right and left-handed circular polarizations as one structure and implement any MIMO communication suitable for its radio wave environment by utilizing any optimum set antennas.

According to an embodiment of the invention, there is provided an antenna device. The antenna device has a substrate of insulation, a conductive flat antenna main body having a predetermined shape, which is positioned on the substrate, conductive polarization control elements that are positioned along-a transverse line across the flat antenna main body over an insulation region of the substrate, and switching elements, each of which is connected with the flat antenna main body and each of the polarization control elements. The switching elements switch the polarization control elements to select polarization that a flat antenna radiates.

In this embodiment of the antenna device according to the invention, the conductive flat antenna main body having a predetermined shape is positioned on the substrate of insulate and conductive polarization control elements are positioned along a transverse line across the flat antenna main body over an insulation region of the substrate. Each of the switching elements is connected with the flat antenna main body and each of the polarization control elements. Controlling the switching elements to switch the polarization control elements allows polarization that a flat antenna radiates to be selected.

For example, the switching elements are respectively arranged on four corners along two diagonals in the flat antenna main body. Two of the switching elements arranged along the one diagonal switch the polarization control elements on while two of the switching elements arranged along the other diagonal switch the polarization control elements off. Thus, controlling the switching elements to switch the polarization control elements allows the flat antenna main body and the polarization control elements arranged along the one diagonal to be electrically connected to each other and allows the flat antenna main body and the polarization control elements arranged along the other diagonal to be isolated. This enables to be configured an antenna device that radiates any circular polarization indicating a right or left-handed circular polarization property. Alternatively, all the switching elements arranged on four corners of the flat antenna main body along the two diagonals thereof switch the polarization control elements on, thereby enabling to be configured an antenna device that radiates any linear polarization in which a vertical polarization is orthogonal with a horizontal polarization.

Thus, controlling the switching elements to switch the polarization control elements allows the flat antenna main body and the polarization control elements to be combined, thereby enabling three kinds of antennas for linear polarization and right and left-handed circular polarizations to be configured as one structure.

Thus, by this embodiment of the antenna device according to the invention, controlling each of the switching elements connected with the flat antenna main body and each of the polarization control elements to switch the polarization control elements allows polarization that a flat antenna radiates to be selected.

Such a combination of the flat antenna main body and each of the polarization control elements allows three kinds of antennas for linear polarization and right and left-handed circular polarizations to be configured as one structure. Therefore, the antenna device having such the switching function on polarization that a flat antenna radiates can be fully applied to the MIMO communication system suitable for its radio wave environment.

According to another embodiment of the invention, there is provided a wireless communication apparatus. This wireless communication apparatus has at least two antenna devices, at least two reception-and-transmission circuits that transmit and receive signals according to a multi-input-multi-output communication system, each of which is connected to each of the antenna devices, and a communication control unit that controls the antenna devices and the reception-and-transmission circuits. Further, each of the antenna devices includes a substrate of insulation, a conductive flat antenna main body having a predetermined shape, which is positioned on the substrate, conductive polarization control elements that are positioned along a transverse line across the flat antenna main body over an insulation region of the substrate, and switching elements, each of which is connected with the flat antenna main body and each of the polarization control elements. The communication control unit controls the switching elements to switch the polarization control elements, thereby selecting polarization that a flat antenna radiates.

To the embodiment of the wireless communication apparatus according to the invention, the embodiment of the above antenna device according to the invention is applied. Thus, controlling the switching elements connected with the flat antenna main body and each of the polarization control elements to switch the polarization control elements allows polarization that a flat antenna radiates to be selected.

For example, the switching elements are respectively arranged on four corners along two diagonals in the flat antenna main body. Two of the switching elements arranged along the one diagonal switch the polarization control elements on while two of the switching elements arranged along the other diagonal switch the polarization control elements off. Thus, controlling the switching elements to switch the polarization control elements allows the flat antenna main body and the polarization control elements arranged along the one diagonal to be electrically connected to each other and allows the flat antenna main body and the polarization control elements arranged along the other diagonal to be isolated. This enables to be configured an antenna device that radiates any circular polarization indicating a right or left-handed circular polarization property. Alternatively, all the switching elements arranged on four corners of the flat antenna main body along the two diagonals thereof switch the polarization control elements on, thereby enabling to be configured an antenna device that radiates any linear polarization in which a vertical polarization is orthogonal with a horizontal polarization.

Thus, in the embodiment of the wireless communication apparatus according to the invention, controlling the switching elements to select one among three types of the antenna devices that are formed by the combinations of the flat antenna main body and the polarization control elements allows the wireless communication apparatus to receive and transmit the signals for linear polarization and right and left-handed circular polarizations. This enables MIMO communication that is suitable for any radio wave environments to be implemented in the wireless communication apparatus.

According to further embodiment of the invention, there is provided a control method of controlling a wireless communication apparatus that transmits and receives signals according to a multi-input-multi-output (MIMO) communication system. The wireless communication apparatus includes an antenna device having a substrate of insulation, a conductive flat antenna main body having a predetermined shape, which is positioned on the substrate, conductive polarization control elements that are positioned along a transverse line across the flat antenna main body over an insulation region of the substrate, and switching elements each being connected with the flat antenna main body and each of the polarization control elements. The switching elements switch the polarization control elements to select polarization that a flat antenna radiates. The control method of controlling a wireless communication apparatus has the steps of setting switching operations of the switching elements in the antenna device, detecting quality of communication by the flat antenna formed based on the set switching operations of the switching elements, maintaining the setting on switching operations of the switching elements based on the detected quality of communication by the flat antenna, and performing the communication by the maintained setting on switching operations of the switching elements.

To this embodiment of control method of controlling a wireless communication apparatus according to the invention, the embodiment of the above antenna device according to the invention is applied. Thus, controlling the switching elements connected with the flat antenna main body and each of the polarization control elements to switch the polarization control elements allows polarization that a flat antenna radiates to be selected.

For example, when maintaining the setting on switching operations of the switching elements, the steps of setting switching operations of the switching elements in the antenna device, detecting quality of communication by the flat antenna formed based on the set switching operations of the switching elements, determining whether the detected quality of communication by the flat antenna is optimal, and updating the setting of switching operations of the switching elements to the setting when it is determined that the detected quality of communication by the flat antenna is optimal and maintaining the updated setting.

Thus, using the flat antenna having an optimal condition set, which is selected among three types of antennas that are formed by the combinations of the flat antenna main body and the polarization control elements enables the wireless communication apparatus to receive and transmit three kinds of signals for linear polarization and right and left-handed circular polarizations. This allows MIMO communication that is suitable for any radio wave environments to be implemented in the wireless communication apparatus.

Thus, to the embodiments of the wireless communication apparatus and the control method of controlling a wireless communication apparatus, an embodiment of the antenna device according to the invention is applied. Controlling each of the switching elements connected with the flat antenna main body and each of the polarization control elements to switch the polarization control elements allows polarization that a flat antenna radiates to be selected.

It is possible to receive and transmit signals for linear polarization and right and left-handed circular polarizations by using a flat antenna selected from three kinds of antennas constituted of any combination of the flat antenna main body and each of the polarization control elements and set as any optimum one. This enables the MIMO communication system suitable for its radio wave environment to be implemented.

According to additional embodiments of the invention, there are provided a program product allowing a computer to carry out the above control method of controlling the wireless communication apparatus and a computer-readable storage medium that stores the above control method of controlling the wireless communication apparatus.

In these embodiments of the program product and the computer-readable storage medium, a computer including a microcomputer, CPU, and a signal-processing LSI can perform any processes in the program product. Thus, using the flat antenna having an optimal condition set, which is selected among three types of antennas that are formed by the combinations of the flat antenna main body and the polarization control elements enables the wireless communication apparatus to receive and transmit three kinds of signals for linear polarization and right and left-handed circular polarizations.

Thus, according to these embodiments of the program product and the computer-readable storage medium, it is possible to receive and transmit signals for linear polarization and right and left-handed circular polarizations by using a flat antenna selected from three kinds of antennas constituted of any combination of the flat antenna main body and each of the polarization control elements and set as any optimum one.

According to still another embodiment of the invention, there is provided an antenna device. The antenna device has a dielectric substrate, a conductive flat antenna main body having a predetermined shape, which is positioned on the substrate, semi-conductive polarization control elements that are positioned along a transverse line across the flat antenna main body, and control electrodes that are positioned on the polarization control elements. Direct current biased voltage applied across each of the control electrodes is controlled to switch polarization that a flat antenna radiates.

In this embodiment of the antenna device, the conductive flat antenna main body having a predetermined shape is positioned on the substrate and the semi-conductive polarization control elements are positioned along a transverse line across the flat antenna main body. The control electrodes are positioned on the elements. Direct current biased voltage applied across each of the control electrodes is controlled to switch polarization that a flat antenna radiates.

For example, the polarization control elements each having the control electrode are respectively arranged on four corners along two diagonals in the flat antenna main body. Application of forward biased voltage across the two control electrodes on the polarization control elements arranged along the one diagonal while application of reverse biased voltage across the two control electrodes on the polarization control elements arranged along the other diagonal allows the flat antenna main body and the polarization control elements arranged along the one diagonal to be electrically connected to each other and allows the flat antenna main body and the polarization control elements arranged along the other diagonal to be isolated. This enables to be configured as one structure an antenna device that radiates any circular polarization indicating a right or left-handed circular polarization property.

Alternatively, application of forward biased voltage across each of the four control electrodes on four corners of the flat antenna main body along the two diagonals thereof enables to be configured an antenna device that radiates any linear polarization.

Thus, controlling the application of direct-current biased voltage across each of the control electrodes allows a switch from conductivity to insulation and vice versa in each of the polarization control elements to be controlled, thereby enabling any combinations of the flat antenna main body and the polarization control elements to be selected. This allows the polarization that the flat antenna can radiate to be switched, thereby enabling three types of antennas for linear polarization and-right and left-handed circular polarizations to be configured as one structure.

Thus, by this embodiment of the antenna device according to the invention, controlling the application of direct-current biased voltage across each of the semi-conductive polarization control elements that are positioned along a transverse line across the flat antenna main body allows polarization that a flat antenna radiates to be selected.

Such a combination of the flat antenna main body and each of the semi-conductive polarization control elements allows three kinds of antennas for linear polarization and right and left-handed circular polarizations to be configured as one structure. Therefore, this embodiment of the antenna device having such the polarization-switching function can be fully applied to MIMO communication system that is suitable for any radio wave environments.

According to still further embodiment of the invention, there is provided a wireless communication apparatus. The wireless communication apparatus has at least two antenna devices, at least two reception-and-transmission circuits that transmit and receive signals according to a multi-input-multi-output communication system, each of which is connected to each of the antenna devices, and a communication control unit that controls the antenna devices and the reception-and-transmission circuits. Each of the antenna devices includes a dielectric substrate, a conductive flat antenna main body having a predetermined shape, which is positioned on the substrate, semi-conductive polarization control elements that are positioned along a transverse line across the flat antenna main body, and control electrodes that are positioned on the elements. Direct-current biased voltage applied across each of the control electrodes is controlled to switch polarization that a flat antenna radiates.

To this embodiment of the wireless communication apparatus according to the invention, the embodiment of the above antenna device according to the invention is applied. Thus, controlling the application of direct-current biased voltage across each of the control electrodes on the semi-conductive polarization control elements that are positioned along a transverse line across the flat antenna main body allows polarization that the flat antenna radiates to be switched.

For example, the polarization control elements each having the control electrode are respectively arranged on four corners along two diagonals in the flat antenna main body. Application of forward biased voltage across each of the control electrodes on the two polarization control elements arranged along the one diagonal while application of reverse biased voltage across each of the control electrodes on the two polarization control elements arranged along the other diagonal allows the polarization control elements arranged along the one diagonal to be made conductive so that the flat antenna main body and the polarization control elements thus conductivity-changed can be electrically connected to each other and allows the polarization control elements arranged along the other diagonal to be kept isolated. This enables to be configured an antenna device that radiates any circular polarization indicating a right or left-handed circular polarization property. Alternatively, application of forward biased voltage across each of the four control electrodes on four corners of the flat antenna main body along the two diagonals thereof enables to be configured an antenna device that radiates any linear polarization.

Thus, in the embodiment of the wireless communication apparatus according to the invention, controlling the application of direct-current biased voltage across each of the control electrodes to select one among three types of the antenna devices that are formed by the combinations of the flat antenna main body and the polarization control elements allows the wireless communication apparatus to receive and transmit the signals for linear polarization and right and left-handed circular polarizations. This enables MIMO communication that is suitable for any radio wave environments to be implemented in the wireless communication apparatus.

According to still additional embodiment of the invention, there is provided a control method of controlling a wireless communication apparatus that transmits and receives signals according to a multi-input-multi-output (MIMO) communication system. The wireless communication apparatus includes an antenna device having a dielectric substrate, a conductive flat antenna main body having a predetermined shape, which is positioned on the substrate, semi-conductive polarization control elements that are positioned along a transverse line across the flat antenna main body, and control electrodes that are positioned on the elements. Direct current biased voltage applied across each of the control electrodes is controlled to switch polarization that a flat antenna radiates. The control method includes the steps of setting direct-current biased voltage applied across each of the control electrodes in each of the antenna devices, detecting quality of communication by the flat antenna formed based on the application of set direct-current biased voltage applied across each of the control electrodes, maintaining the setting on the application of set direct-current biased voltage across each of the control electrodes based on the detected quality of communication by the flat antenna, and performing the communication by the maintained setting on the application of set direct-current biased voltage across each of the control electrodes.

To this embodiment of the control method of controlling the wireless communication apparatus according to the invention, the embodiment of the above antenna device according to the invention is applied. Thus, controlling the application of direct-current biased voltage across each of the control electrodes on the semi-conductive polarization control elements that are positioned along a transverse line across the flat antenna main body allows polarization that a flat antenna radiates to be switched.

For example, when maintaining the setting on the application of direct-current biased voltage across each of the control electrodes, setting direct-current biased voltage applied across each of the control electrodes; detecting quality of communication by the flat antenna formed based on the application of set direct-current biased voltage across each of the control electrodes; determining whether the detected quality of communication by the flat antenna is optimal; and updating the setting on the application of the direct-current biased voltage across each of the control electrodes to the setting when it is determined that the detected quality of communication by the flat antenna is optimal and maintaining the updated setting, are sequentially repeated.

Thus, using the flat antenna having an optimal condition set, which is selected among three types of antennas that are formed by the combinations of the flat antenna main body and the polarization control elements, enables the wireless communication apparatus to receive and transmit three kinds of signals for linear polarization and right and left-handed circular polarizations. This allows MIMO communication that is suitable for any radio wave environments to be implemented in the wireless communication apparatus.

Thus, to the embodiments of the wireless communication apparatus and the control method of controlling a wireless communication apparatus, an embodiment of the antenna device according to the invention is applied. Controlling the application of direct-current biased voltage across each of the control electrodes in the semi-conductive polarization control elements that are positioned along a transverse line across the flat antenna main body allows polarization that a flat antenna radiates to be selected.

It is possible to receive and transmit signals for linear polarization and right and left-handed circular polarizations by using a flat antenna selected from three kinds of antennas constituted of any combination of the flat antenna main body and each of the polarization control elements and set as any optimum one. This enables the MIMO communication system suitable for its radio wave environment to be implemented.

According to still further embodiments of the invention, there are provided a program product allowing a computer to carry out the above control method of controlling the wireless communication apparatus and the computer-readable storage medium that stores the above control method of controlling the wireless communication apparatus.

In these embodiments of the program product and the computer-readable storage medium, a computer including a microcomputer, CPU, and a signal-processing LSI can perform any processes in the program product. Thus, using the flat antenna having an optimal condition set, which is selected among three types of antennas that are formed by the combinations of the flat antenna main body and the polarization control elements enables the wireless communication apparatus to receive and transmit three kinds of signals for linear polarization and right and left-handed circular polarizations.

Thus, according to these embodiments of the program product and the computer-readable storage medium, it is possible to receive and transmit signals for linear polarization and right and left-handed circular polarizations by using a flat antenna selected from three kinds of antennas constituted of any combination of the flat antenna main body and each of the polarization control elements and set as any optimum one.

The concluding portion of this specification particularly points out and directly claims the subject matter of the present invention. However that skill in the art will best understand both the organization and method of operation of the invention, together with further advantages and objects thereof, by reading the remaining portions of the specification in view of the accompanying drawing(s) wherein like reference characters refer to like elements.

BRIEF DESCRIPTION OF THE DRAWINGS

FIG. 10A is a schematic diagram for showing a configuration of a micro electromechanical system (MEMS) switch and the like, FIG. 10B is a sectional view of the MEMS switch taken along the lines X10-X10 of FIG. 10A when the MEMS switch is switched off, and FIG. 10C is a sectional view of the MEMS switch taken along the lines X10-X10 of FIG. 10A when the MEMS switch is switched on;

DETAILED DESCRIPTION OF PREFERRED EMBODIMENTS

Figure 1:
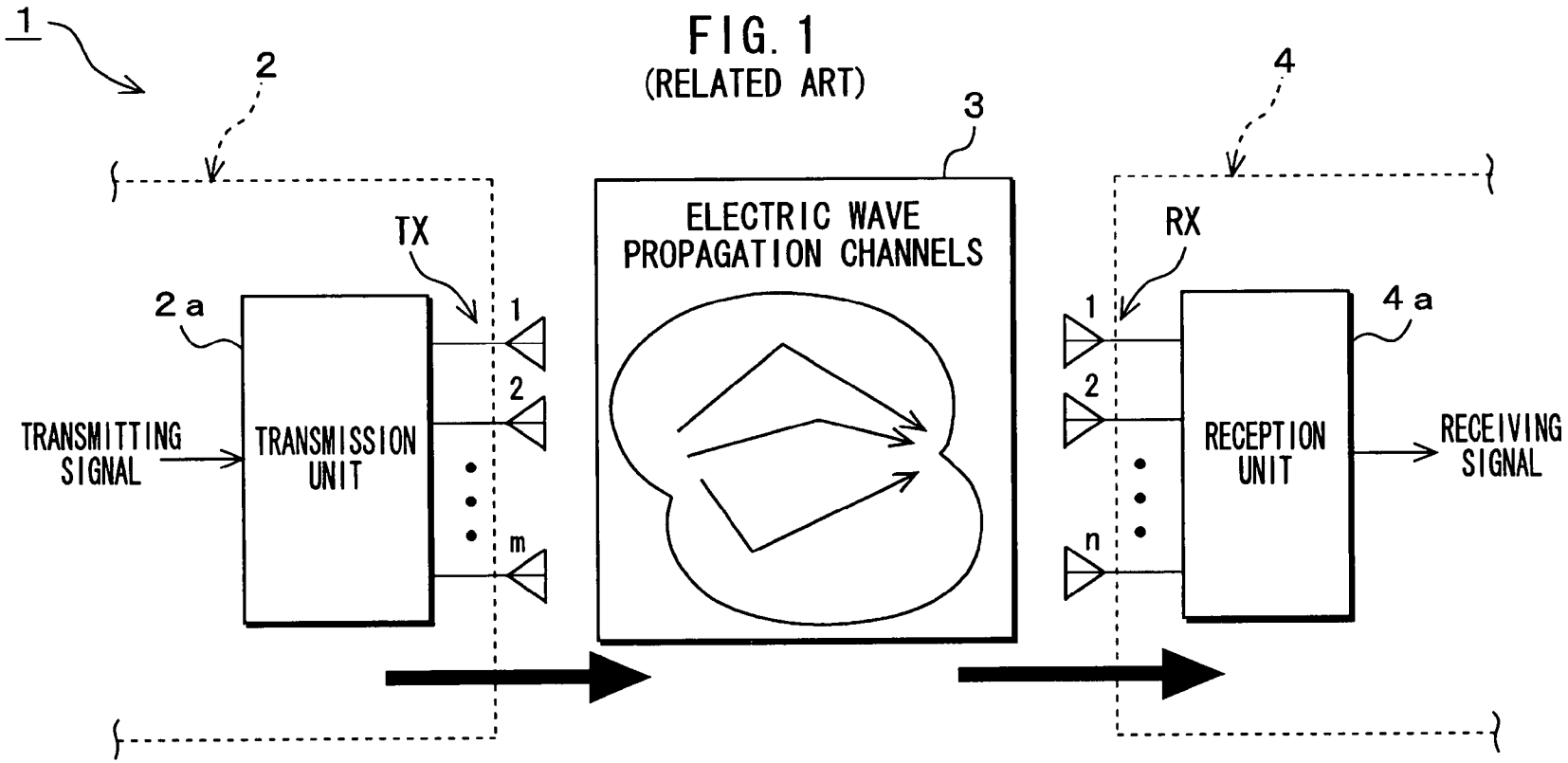
FIG. 1 (RELATED ART)
FIG. 1 is a block diagram for illustrating a configuration of an MIMO communication system relative to a related art when propagating a signal.
Figure 2:
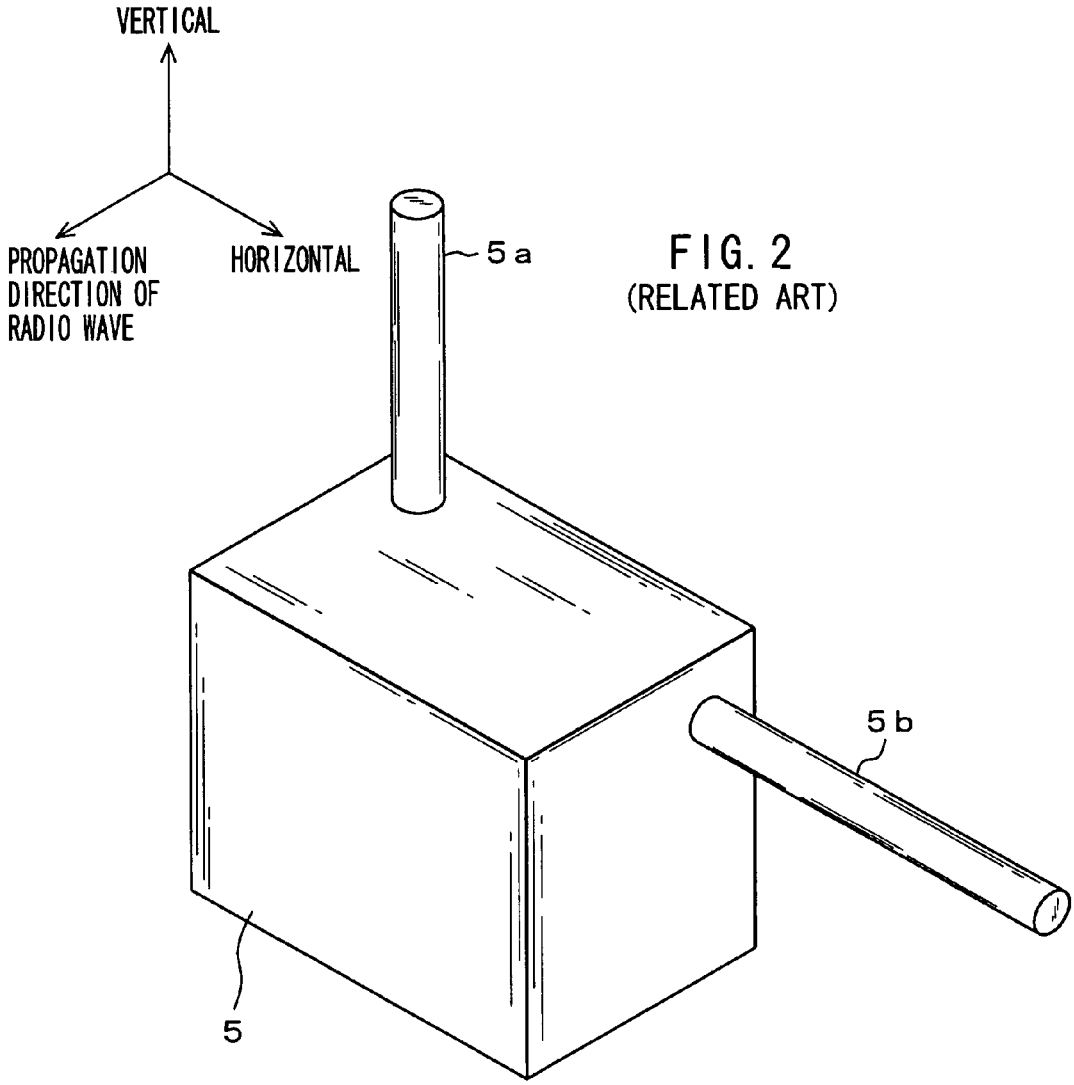
FIG. 2 (RELATED ART)
FIG. 2 is a diagram for showing an example of attachment of an antenna for linear polarization that is used in the MIMO communication system.
Figure 3:
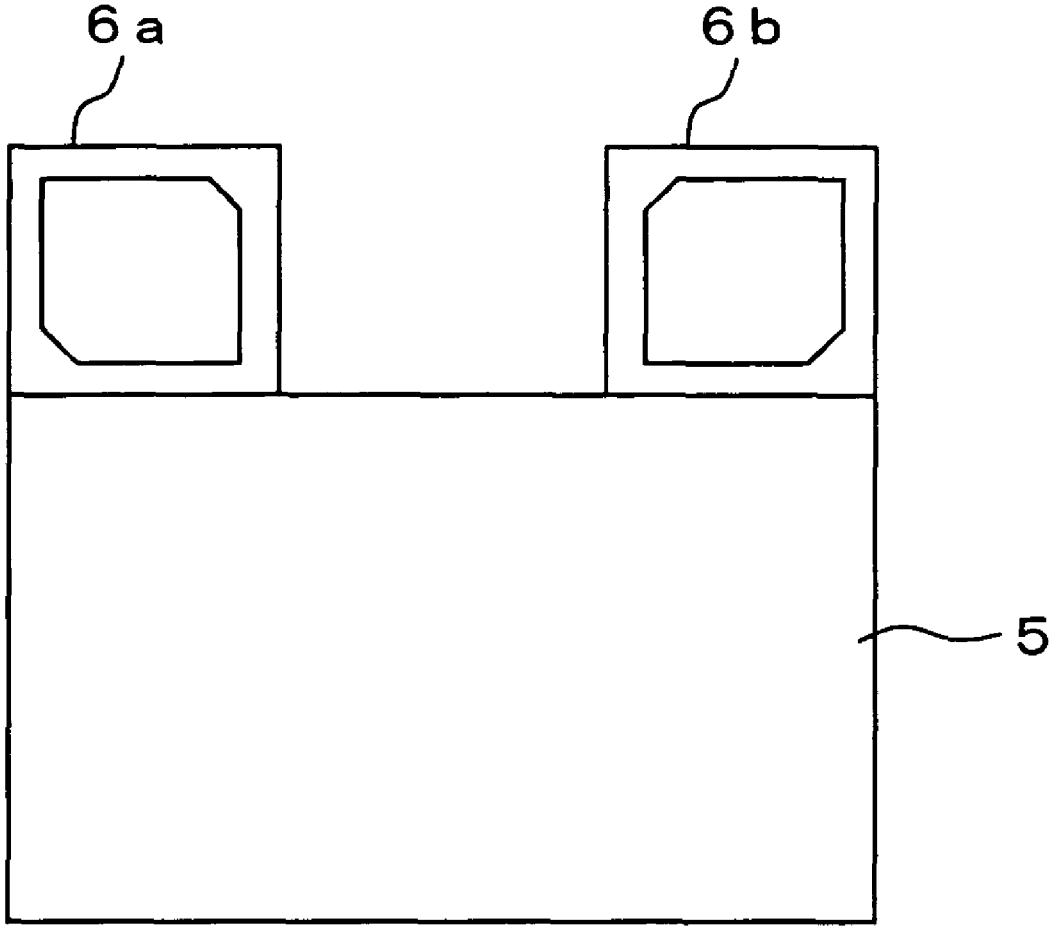
FIG. 3 (RELATED ART)
FIG. 3 is a diagram for showing an example of attachment of an antenna for circular polarization that is used in the MIMO communication system.
Figure 4:
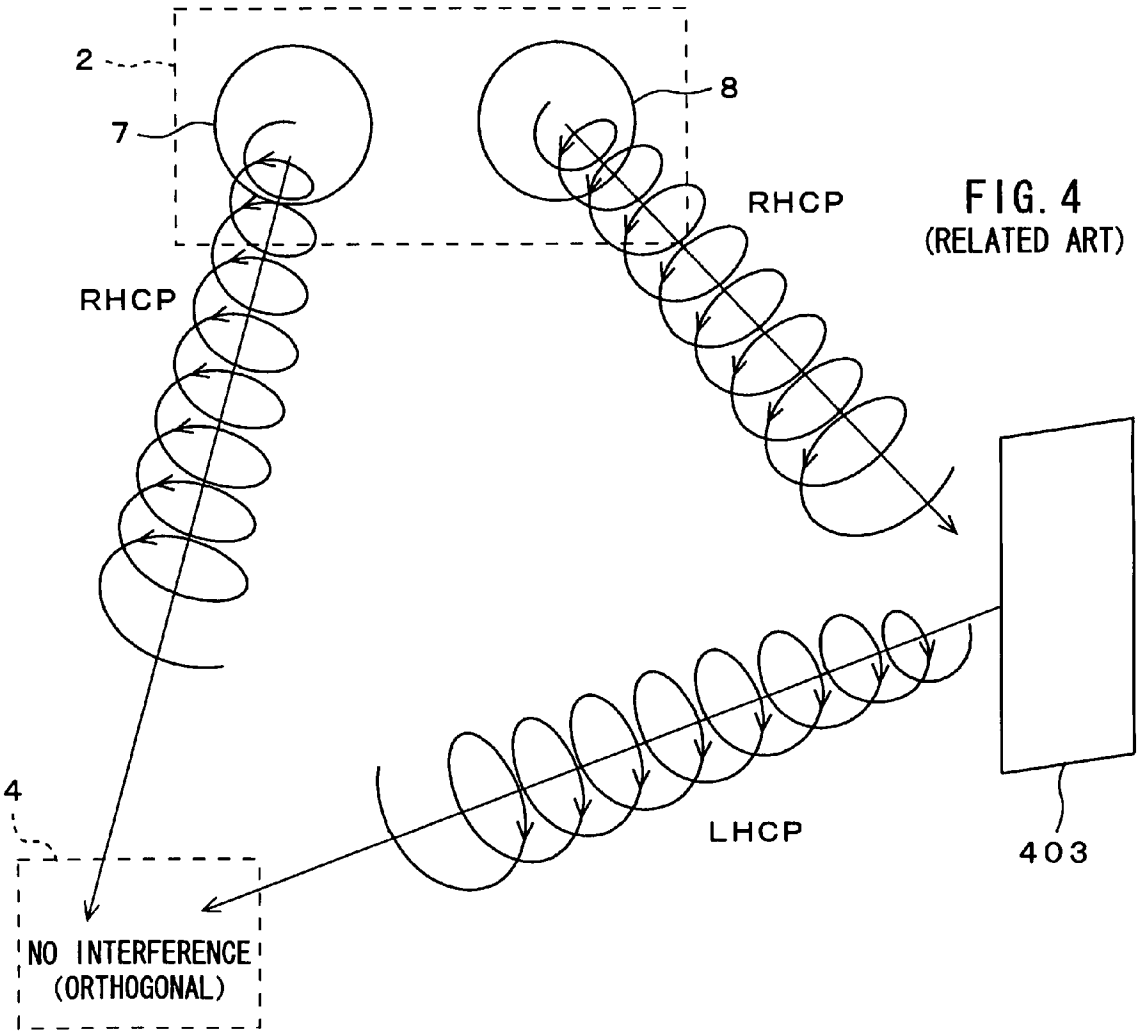
FIG. 4 (RELATED ART)
FIG. 4 is a diagram for showing an example of receiving a signal in the receiving terminal when two antennas of the transmitting terminal are set as transmitting the signals with both of them being as right-handed circular polarizations and the receiving terminal receives the signals when radio wave radiated from one of the antennas is reflected by an object once.
Figure 5:
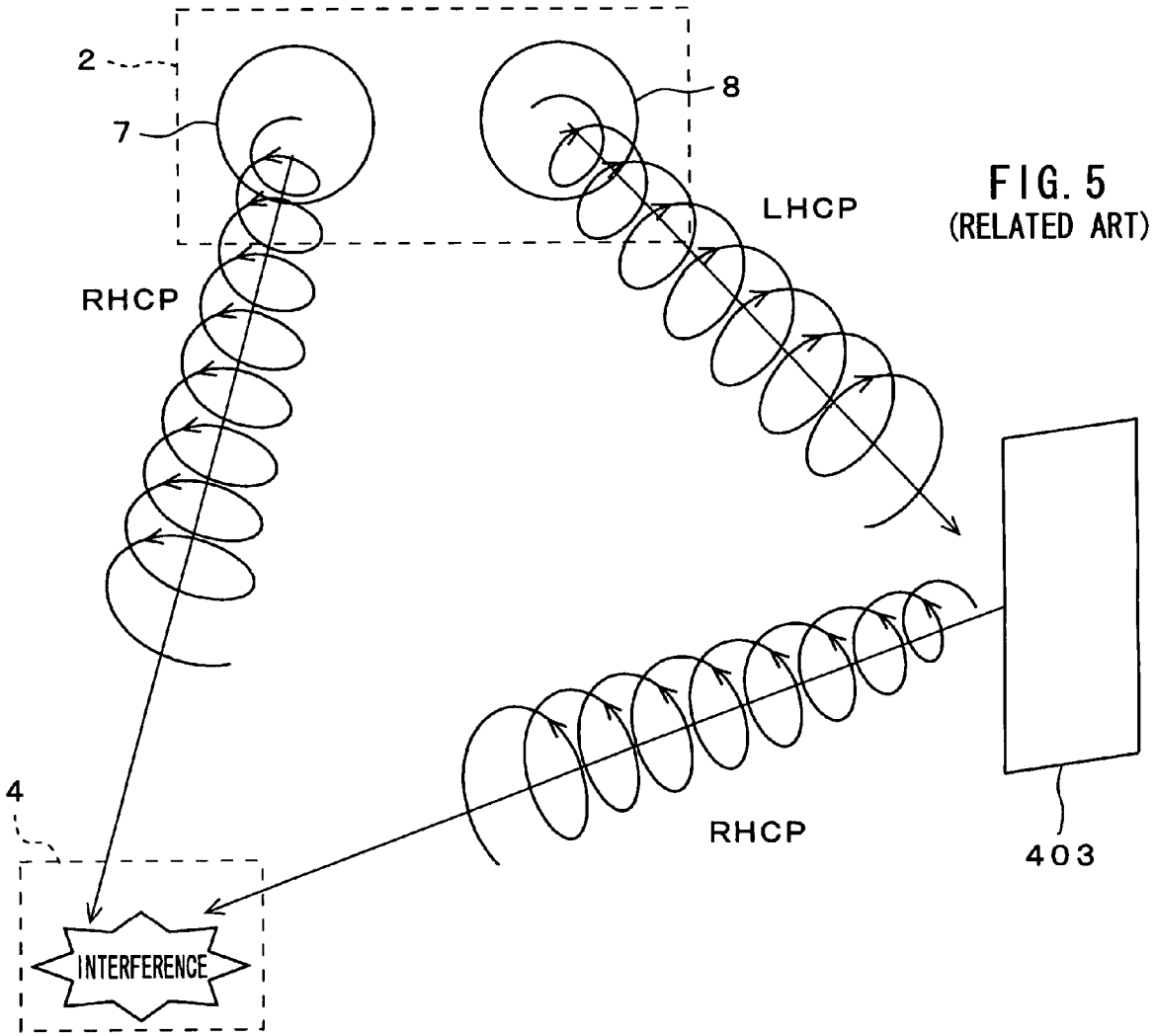
FIG. 5 (RELATED ART)
FIG. 5 is a diagram for showing an example of receiving a signal in the receiving terminal when two antennas of the transmitting terminal are set as transmitting the signals with one of them being as right-handed circular polarization and the other being left-handed circular polarization and the receiving terminal receives the signals when radio wave radiated from the other antenna is reflected by an object once.

Referring now to the drawings, an antenna device, a wireless communication apparatus, a control method of controlling the wireless communication apparatus, a computer program product therefor, and a computer-readable storage medium therefor according to preferred embodiments of the invention will be described specifically below.

Figure 6:
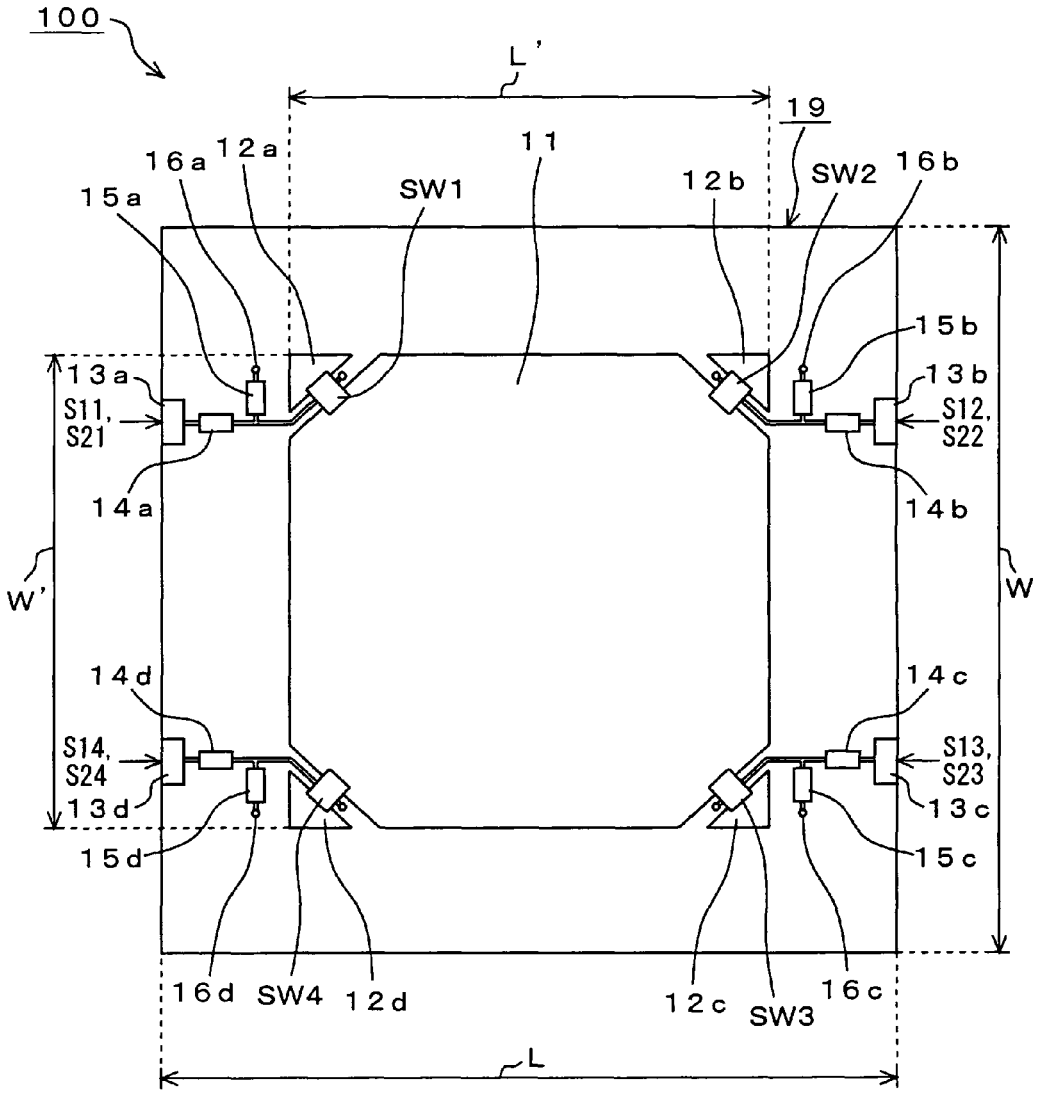
FIG. 6 is a diagram for showing a configuration of an antenna device according to a first embodiment of the invention.

FIG. 6 shows a configuration of an antenna device 100 as a first embodiment of the invention.

The antenna device 100 shown in FIG. 6 is preferably applicable to an antenna device, which receives and transmits signals according to the MIMO communication system at the same time using plural flat antennas, and a wireless communication apparatus using the antenna device. The antenna device 100 has a substrate 19 of insulation and a conductive main excitation device 11, as an example of a flat antenna main body, which is positioned on the substrate 19. The main excitation device 11 has a shape, for example, a polygonal patch pattern such as an octagon that is given by cutting four corners from a square. The substrate 19 has a length of L and a width of W. The main excitation device 11 has a length of L' (L'<L) and a width of W (W'<W). The main excitation device 11 has a thickness of "t" and is made of metallic materials such as copper, cupronickel, phosphorus bronze, brass, stainless steel (SUS), and gold. The main excitation device 11 is formed by means of any etching method of a copper foil onto the substrate, any metallic plating to resin, any affixation technology of metallic foil and the like.

Triangular auxiliary excitation devices 12 (degeneracy separation elements or perturbation elements: cut-away portions from the main excitation device 11) for polarization control as examples of conductive polarization control elements are positioned along diagonals in the main excitation device 11 across insulation regions of the substrate 19. The auxiliary excitation devices 12*a* through 12*d* are made of the same metallic materials as those of the main excitation device 11. The auxiliary excitation devices 12*a* through 12*d* are formed so that four corners of the square main excitation device can be separated from the main excitation device 11 by cutting away parts thereof to expose the underlaid substrate 19 of insulation. Such the cutaway can be performed by using any method such as any etching and any grooving by grinding.

In this embodiment, switches SW1 through SW4 are installed on (connected with) the main excitation device 11 and each of the auxiliary excitation devices 12*a* through 12*d* that are positioned at four corners of the main excitation device 11. The switches SW1 through SW4 switch the auxiliary excitation devices 12*a* through 12*d* on or off to select polarization that a flat antenna (hereinafter referred to as "square patch antenna") radiates. The switches SW1 through SW4 are made of semiconductor active components. As the active components, a field-effect transistor of p-type or n-type and a bipolar transistor of npn-type or pnp-type are used. As the switches SW1 through SW4, in addition to the semiconductor active components, a switch having any mechanical driving mechanism, for example, micro electromechanical system (MEMS) switch can be used.

When the switches SW1 through SW4 are made of the field-effect transistors, their sources are connected to the main excitation device 11 and their drains are connected to each of the auxiliary excitation devices 12, as an example. Their sources can be connected to each of the auxiliary excitation devices 12 and their drains can be connected to the main excitation device 11. The switches switch the auxiliary excitation devices on or off by means of controlling their gate voltages.

When the switches SW1 through SW4 are made of the bipolar transistors, their collectors are connected to the main excitation device 11 and their emitters are connected to each of the auxiliary excitation devices 12, as an example. Their collectors can be connected to each of the auxiliary excitation devices 12 and their emitters can be connected to the main excitation device 11. The switches switch the auxiliary excitation devices on or off by means of controlling their base currents.

The substrate 19 has four control terminals 13*a* through 13*d*. The control terminal 13*a* is connected to a control electrode of the switch SW1 (its gate or base) through a choke coil 14*a*. A bypass capacitor 15*a* is connected with the control electrode and a ground (GND) pattern 17, which will be described later. The choke coil 14*a*, the bypass capacitor 15*a* and the like form a filter for preventing high-frequency current from being diffracted, which can be connected to a line for a direct-current power supply at need. Such the filter can be laid out (positioned) on a suitable position.

The GND pattern 17 is provided on a rear surface of the substrate 19. The bypass capacitor 15*a* is connected to the GND pattern 17 via a through-hole 16*a*. Similarly, other control terminals 13*b* through 13*d* are respectively connected to control electrodes of the switches SW2 through SW4 through choke coils 14*b* through 14*d* or the like. Further, similarly, bypass capacitors 15*b* through 15*d* are respectively connected to the GND pattern 17 via through-holes 16*b* through 16*d*. The switches SW1 through SW4, the main excitation device 11 and the auxiliary excitation devices 12*a* through 12*d* of the square patch antenna, the control terminals 13*a* through 13*d*, the lines for a direct-current power supply, and GND pattern 17 are connected to each other by using face-up installation such as wire-bonding, face-down installation such as bumping or the like.

Direct-current voltage (hereinafter referred to as "switch-operating voltage" or "switch control signal" S11 to S14, S21 to S24) operating the switches SW1 through SW4 is supplied to each of the control terminals 13*a* through 13*d* so as to be applied across each of the control electrodes and the GND pattern 17. The control terminal 13*a* through 13*d* and the GND pattern is connected to a control unit (a switch controller), which is not shown. In the switches SW1 through SW4, the switch operating voltage is applied across each of the pairs of switches SW1 and SW3 as well as SW2 and SW4 that are arranged along each of the diagonals. Such the square patch antenna radiates polarization such as circular polarization like right-handed circular polarization or left-handed circular polarization, linear polarization and the like (see "New Antenna Engineering" written by Hiroyuki ARAI and published by Sougou Electronic Publisher in 1996.

Figure 7A:
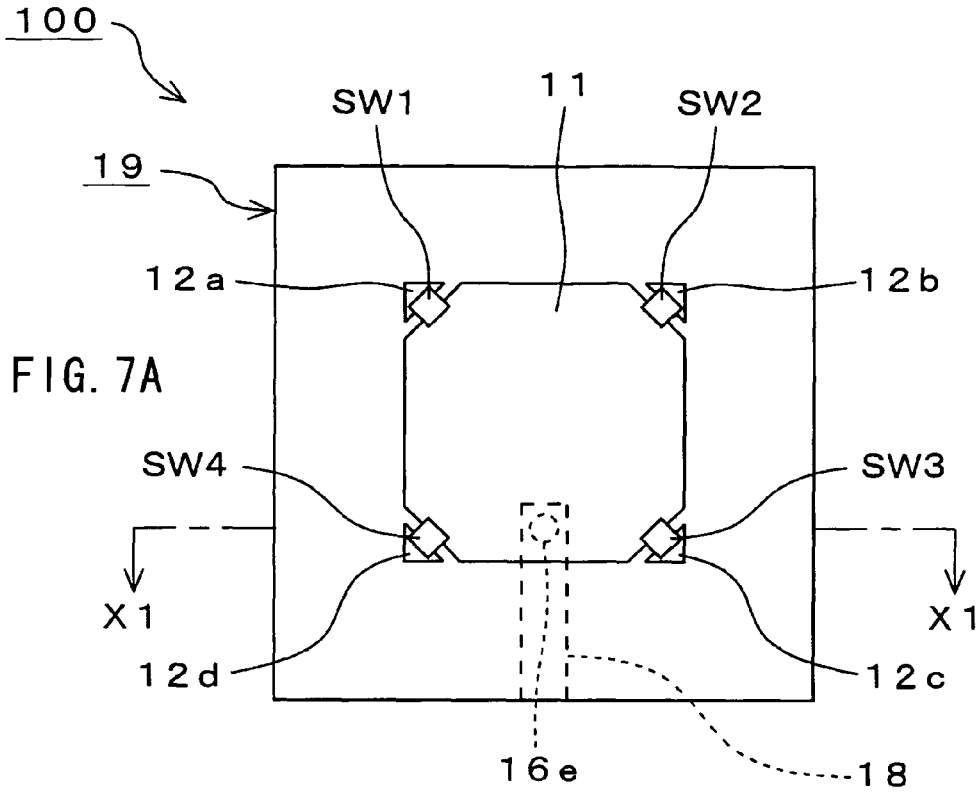
FIG. 7A is a plane view of the antenna device illustrating a configuration thereof and FIG. 7B is a sectional view of the antenna device taken along the lines X1-X1 of FIG. 7A.
Figure 7B:
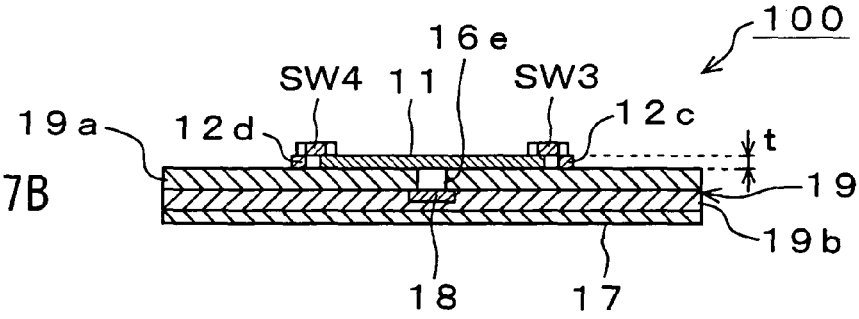
Figure 8:
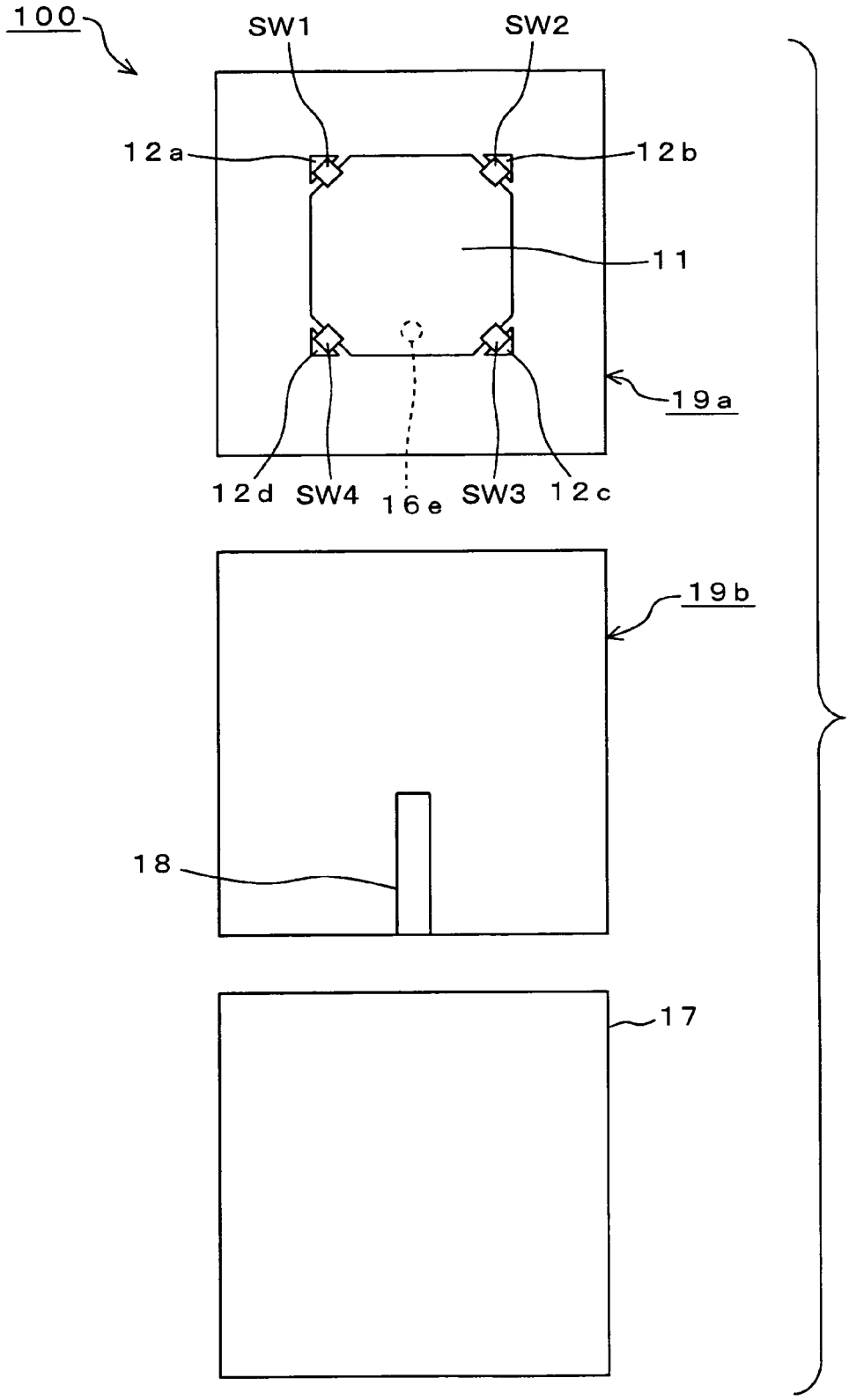
FIG. 8 is an exploded view of the antenna device for showing its laminated configuration.

FIG. 7A shows a plane view of the antenna device 100 illustrating a configuration thereof and FIG. 7B shows a sectional view of the antenna device 100 taken along the lines X1-X1 of FIG. 7A. FIG. 8 is an exploded view of the antenna device 100 for showing its laminated configuration.

As shown in FIG. 7A, the antenna deice 100 has the switches SW1 through SW4, the square substrate 19 of insulation, the octagonal main excitation device 11 and the triangular auxiliary excitation devices 12*a* through 12*d*. As shown in FIG. 7B, each of the switches SW1 through SW4 extends on the main excitation device 11 and each of the auxiliary excitation devices 12*a* through 12*d* across an insulation region of the substrate 19.

The antenna device 100, as shown in FIG. 8, has a three-layer structure. A first layer has the substrate 19*a* of insulation, the conductive main excitation device 11, the triangular auxiliary excitation devices 12*a* through 12*d*, and the switches SW1 through SW4. The conductive main excitation device 11 and the auxiliary excitation devices 12*a* through 12*d* are arranged on the substrate 19*a* of insulation in the first layer. The switches SW1 through SW4 are connected with the main excitation device 11 and each of the auxiliary excitation devices 12*a* through 12*d*. The substrate 19*a* has a through-hole 16*e* under the main excitation device 11 and the through-hole 16*e* is used for an RF feeding point.

A second layer shown in FIG. 8 has the substrate 19*b* of insulation and a micro strip line 18 formed in the substrate 19*b*. The micro strip line 18 is connected to the main excitation device 11 via the through-hole 16*e* formed in the substrate 19*a* of insulation of the first layer. The micro strip line 18 has characteristic impedance of 50Ω and is arranged with it being sandwiched between the substrates 19*a* and 19*b* of the first and second layers. The micro strip line 18 has a feeding terminal (a feeding circuit) that is connected to a high-frequency circuit of a wireless communication apparatus or the like. A transmission signal is fed to the feeding terminal and a reception signal is received from the feeding terminal.

A third layer shown in FIG. 8 has GND pattern (GND layer) 17 that is arranged over an entire rear surface of the substrate 19*b* of insulation of the second layer. Thus, the antenna device 100 having the three-layer structure is formed.

There will describe how to manufacture such the antenna device 100 having the three-layer structure.

A square substrate of insulation, a surface of which has a copper foil, is prepared. A resist layer is applied on the copper foil and is patterned so that an octagonal can be formed for the main excitation device 11 and triangles can be formed for the auxiliary excitation devices 12*a* through 12*d*. It is to be noted that no resist layer is applied to a portion between the main excitation device 11 and each of the auxiliary excitation devices 12*a* through 12*d* in order to maintain insulation regions therebetween. By using the resist layers as masks, suitable etching liquid can remove an excessive copper foil therefrom. This enables the octagonal main excitation device 11 and the triangle auxiliary excitation devices 12*a* through 12*d* to be separated to each other on the square substrate 19*a* of insulation.

Further, the through-hole 16*e* having a predetermined diameter is formed in the square substrate 19*a* of insulation to reach a rear face of the main excitation device 11. The through-hole 16*e* is formed by using any drill or the like. The diameter of the through-hole may have an extent such that any conductive component can be contained therein. Thus, the first substrate 19*a* having the main excitation device 11 and the auxiliary excitation devices 12*a* through 12*d* on a surface thereof and having the through-hole 16*e* with the predetermined diameter to reach the rear face of the main excitation device 11 can be formed.

Next, another square substrate of insulation, both surfaces of which have copper foils, is prepared. A resist layer having a predetermined shape for the micro strip line 18 is applied on the copper foil on one surface of the substrate and is patterned. The resist layer is applied so that it can be aligned to the through-hole 16*e*. A resist layer is applied over the copper foil on the other surface of the substrate. By using the resist layers as masks, suitable etching liquid can remove an excessive copper foil therefrom. This enables to be formed the second substrate 19*b* on a surface of which the micro strip line is formed and on the other surface of which GND pattern 17 is formed. Of course, this invention is not limited thereto. A copper foil corresponding to the micro strip line 18 can be affixed to a non-copper-foil-formed surface of the substrate, the other surface of which has a copper foil.

Then, the first substrate 19*a* having the main excitation device 11, the auxiliary excitation devices 12*a* through 12*d*, and the through-hole 16*e* and the second substrate 19*b* having the micro strip line 18 and the GND pattern 17 are firmly affixed to each other using any predetermined adhesive agent. The surface of the first substrate 19*a* on which the main excitation device 11 and the auxiliary excitation devices 12*a* through 12*d* are not mounted and the surface of the second substrate 19*b* in which the micro strip line 18 is positioned are affixed to each other. In this moment, the through-hole 16*e* contains any conductive materials to connect the main excitation device 11 and the micro strip line 18. Alternatively, using any plating method allows the through-hole 16*e* to contain conductive material, thereby connecting the main excitation device 11 and the micro strip line 18.

The switches SW1 through SW4 are connected with the main excitation device 11 and each of the auxiliary excitation devices 12*a* through 12*d*. As the switches SW1 through SW4, semiconductor active components such as a field-effect transistor of p-type or n-type and a bipolar transistor of npn-type or pnp-type are used. As usage of the switches SW1 through SW4, this invention is not limited to such the semiconductor active components. Any switch having a mechanical driving mechanism can be used, which will be referred to as second embodiment of the invention. These components are connected to each other by using the face-up installation such as wire-bonding or the face-down installation such as bumping. Thus, the antenna device 100 having the three-layer structure is manufactured.

On the antenna device 100 having the three-layer structure according to the first embodiment of the invention, the switches SW1 through SW4 are respectively arranged on four corners along two diagonals in the main excitation device 11 and two switches SW1 And SW3 arranged along the one diagonal switch the auxiliary excitation devices 12*a* and 12*c* on while two switches SW2 and SW4 arranged along the other diagonal switch the auxiliary excitation devices 12*b* and 12*d* off. Such the of-off control of each of the switches SW1 through SW4 enables the main excitation device 11 and each of the auxiliary excitation devices 12*a* and 12*c* arranged along the one diagonal to be electrically connected to each other while the main excitation device 11 and each of the auxiliary excitation devices 12*b* and 12*d* arranged along the other diagonal to be insulated. This allows an antenna structure for circular polarization indicating any property of a right or left-handed circular polarization to be formed.

When all the switches SW1 through SW4 arranged on four corners along two diagonals in the main excitation device 11 are switched on, they switch the auxiliary excitation devices 12*a* through 12*d* on, thereby allowing to be formed an antenna structure for linear polarization in which its horizontal polarization is orthogonal to its vertical polarization.

Thus, the of-off control of each of the switches SW1 through SW4 enables the main excitation device 11 and any of the auxiliary excitation devices 12*a* and 12*d* to be combined. This allows an antenna device of three-types for linear polarization and right and left-handed circular polarizations to be formed as one antenna structure. Thus, it is fully possible to apply the antenna device 100 having any radiated polarization switching mechanism to an MIMO communication system that is preferably suitable for any radio wave environments.

Figure 9:
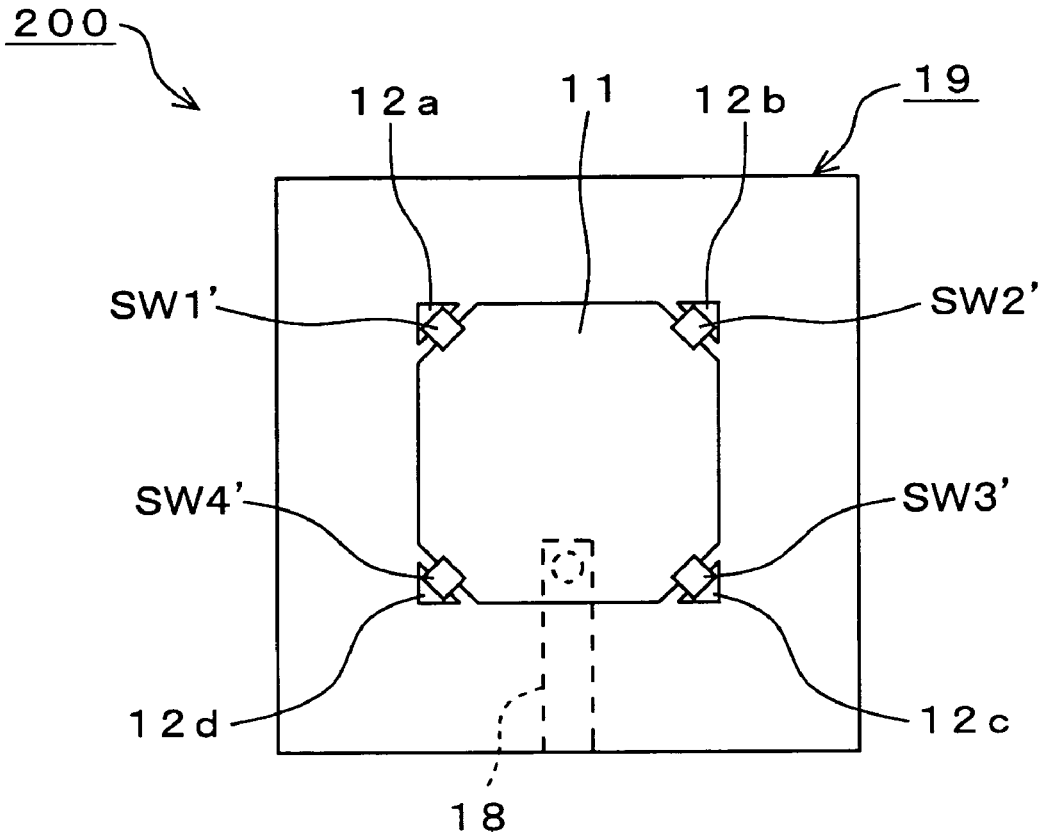
FIG. 9 is a diagram for showing a configuration of an antenna device according to a second embodiment of the invention.

FIG. 9 shows a configuration of an antenna device 200 according to a second embodiment of the invention. The antenna device 200 shown in FIG. 9 has the MEMS switches SW1' through SW4', as switching elements, which are installed on (connected with) the main excitation device 11 and each of the auxiliary excitation devices 12*a* through 12*d*. The on-off control of the MEMS switches SW1' through SW4' allows polarization that the square patch antenna radiates to be switched. In this embodiment, like names and reference characters refer to like elements in the first embodiment, detailed explanation of which will be omitted.

FIG. 10A shows a configuration of the MEMS switch SW1' and the like. The MEMS switch SW1' shown in FIG. 10A is arranged between the main excitation device 11 and each of the auxiliary excitation devices 12*a* through 12*d* across an insulation region of the substrate 19. For example, the MEMS switch SW1' has a silicon (Si) substrate 21, a movable member 22, a voltage-applied electrode 23, and contacts 24*a*, 24*b*. An end of the movable member 22 is attached on the Si substrate 21. The movable member 22 has such a diaphragm structure that the other end thereof can be moved upwardly or downwardly with the end being used as a fulcrum. The movable member 22 has the contact 24*a* on the other end thereof. The contact 24*a* can be electrically connected to the auxiliary excitation devices 12*a* or the like. The Si substrate 21 also has the contact 24*b* that can be electrically connected to the main excitation device 11. The contact 24*b* of the Si substrate 21 is positioned so that it can face the contact 24*a* of the movable member 22 (see FIG. 10B).

The voltage-applied (control) electrode 23 is fixed on the Si substrate 21. Switch-operating voltage is applied to the voltage-applied electrode 23. When any set switch-operating voltage is applied to the voltage-applied electrode 23, the movable member 22 is attracted toward the voltage-applied electrode 23 by means of its Coulomb attraction. The contact 24*a* of the movable member 22 is then contacted with the contact 24*b* of the Si substrate 21 so that the main excitation device 11 can be electrically connected to each of the auxiliary excitation devices 12*a* through 12*d*.

Thus, in the antenna device 200 according to the second embodiment of the invention, the MEMS switches SW1 through SW4 are switched on or off to select the connection of the main excitation device 11 and each of the auxiliary excitation devices 12*a* through 12*d* that are arranged on four corners along two diagonals in the main excitation device 11. This allows an antenna device of three-types for linear polarization and right and left-handed circular polarizations to be formed as one antenna structure like the antenna device of the first embodiment.

Figure 11:
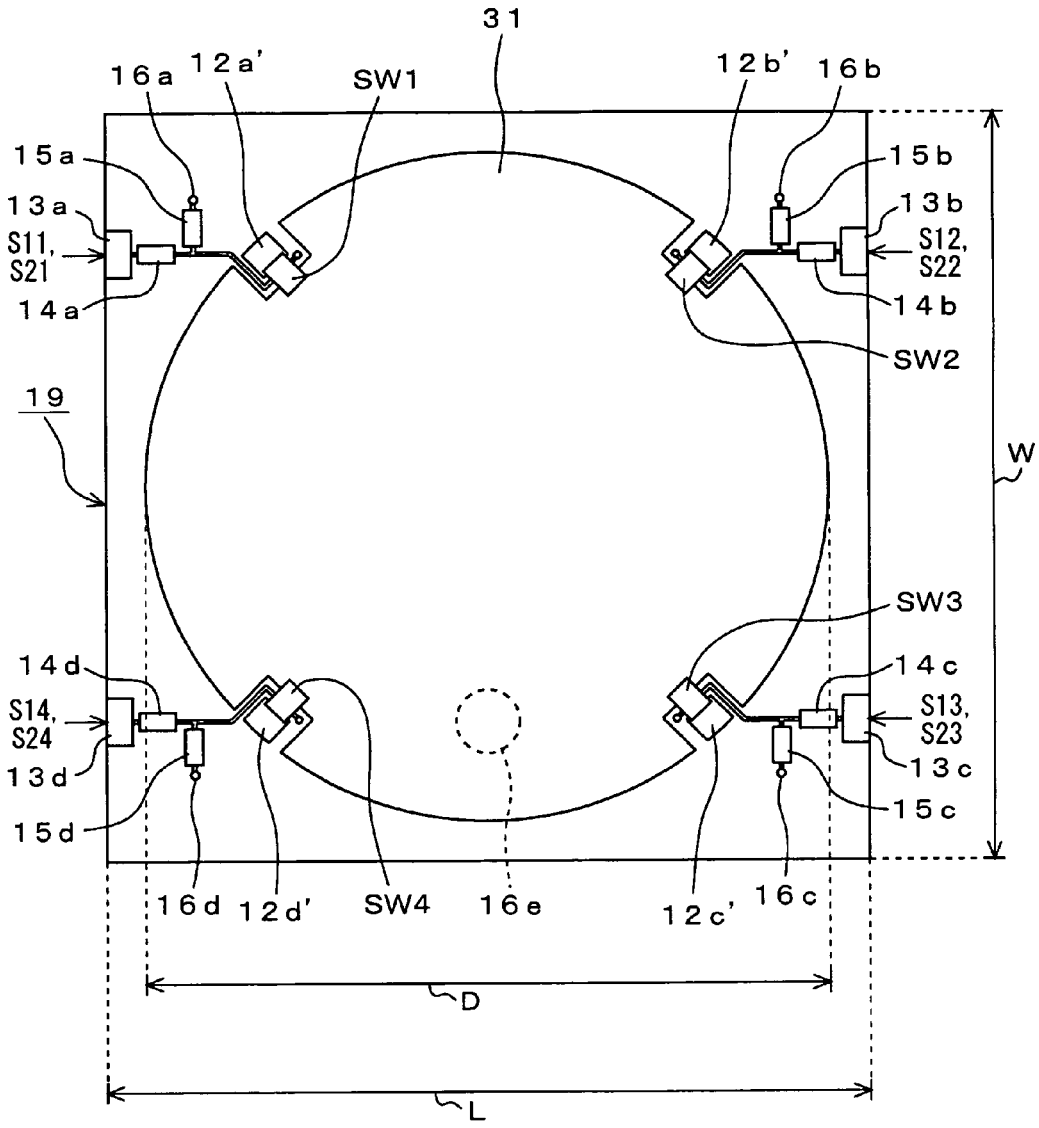
FIG. 11 is a diagram for showing a configuration of an antenna device according to a third embodiment of the invention.

FIG. 11 shows a configuration of an antenna device 300 according to a third embodiment of the invention.

The antenna device 300 shown in FIG. 11 is preferably applicable to antenna device, which receives and transmits signals according to the MIMO communication system at the same time using plural flat antennas, and a wireless communication apparatus using the antenna device. The antenna device 300 has a substrate 19 of insulation and a conductive main excitation device 31, which is positioned on the substrate 19. The main excitation device 31 has a circle shape. The substrate 19 has a length of L and a width of W. The main excitation device 31 has a diameter of D (D<L, W). The main excitation device 31 is made of the same materials as those of the first embodiment and by means of the same manufacturing method as that of the first embodiment.

The square-like auxiliary excitation devices 12*a*' through 12*d*' (perturbation elements: cut-away portions from the main excitation device 31) for polarization control as examples of conductive polarization control elements are positioned on predetermined positions along a circumference of the main excitation device 31 across insulation regions of the substrate 19 with a pair of the auxiliary excitation devices 12*a*' through 12*d*' being faced to each other around a center of the circular main excitation device 31. For example, the square-like auxiliary excitation devices 12*a*' through 12*d*' are positioned on positions, which are away from each other by every 90 degrees on the circumference of the main excitation device 31, along two diagonals in the substrate 19 of insulation, as shown in FIG. 11. The auxiliary excitation devices 12*a*' through 12*d*' are made of the same metallic materials as those of the main excitation device 31. The auxiliary excitation devices 12*a* through 12*d* are formed so that they are separated from four positions on the circumference of the circular main excitation device 31 by cutting away portions of the circular main excitation device 31 corresponding to the positions like square from the circular main excitation device 31 to expose the underlaid substrate 19 of insulation. Such the cutaway can be performed by using any method such as any etching and any grooving by grinding.

In this embodiment, switches SW1 through SW4 are installed on (connected with) the main excitation device 31 and each of the auxiliary excitation devices 12*a*' through 12*d*' that are positioned on the positions on the circumference of the main excitation device 31. The switches SW1 through SW4 switch the auxiliary excitation devices 12*a*' through 12*d*' to select polarization that a flat antenna (hereinafter referred to as "circular patch antenna") radiates. The switches SW1 through SW4 are made of semiconductor active components like the first embodiment. As the active components, a field-effect transistor of p-type or n-type and a bipolar transistor of npn-type or pnp-type are used. Of course, as the switches SW1 through SW4, in addition to the semiconductor active components, switches having any mechanical driving mechanism or the MEMS switches SW1' through SW4' like the second embodiment can be used.

Similar to the first embodiment, the substrate 19 of insulation has four control terminals 13*a* through 13*d*. The control terminal 13*a* is connected to a control electrode of the switch SW1 (its gate or base) through a choke coil 14*a*. A bypass capacitor 15*a* is connected with a control electrode and a GND pattern, which is not shown. The choke coil 14*a*, the bypass capacitor 15a and the like form a filter for preventing high-frequency current from being diffracted, which can be connected to any lines for a direct-current power supply at need. Such the filter can be laid out on any suitable positions.

The GND pattern is provided on a rear surface of the substrate 19, which is similar to the first embodiment. The bypass capacitor 15*a* is connected to the GND pattern via a through-hole 16*a*. Similarly, other control terminals 13*b* through 13*d* are respectively connected to control electrodes of the switches SW2 through SW4 through choke coils 14b through 14*d*. Further, similarly, bypass capacitors 15*b* through 15*d* are respectively connected to the GND pattern via through-holes 16*b* through 16*d*. The switches SW1 through SW4, the main excitation device 31 and the auxiliary excitation devices 12*a*' through 12*d*' of the circular patch antenna, the control terminals 13*a* through 13*d*, the lines for a direct-current power supply, and the GND pattern are connected to each other by using face-up installation such as wire-bonding, face-down installation such as bumping or the like.

Direct-current voltage (hereinafter referred to as "switch-operating voltage" or "switch control signal") S11 through S14, S21 through S24 operating the switches SW1 through SW4 is supplied to each of the control terminals 13*a* through 13*d* so as to be applied across each of the control electrodes and the GND pattern. The control terminal 13*a* through 13*d* and the GND pattern is connected to a control unit (a switch controller), which is not shown. In the switches SW1 through SW4, the switch operating voltage is applied across each of the pairs of switches SW1 and SW3 as well as SW2 and SW4. The switches SW1 and SW3 are faced to each other on a transverse line across the circular main excitation device 31. Similarly, the switches SW2 and SW4 are faced to each other on a transverse line across the circular main excitation device 31. Thus, this circular patch antenna also radiates polarization such as circular polarization like right-handed circular polarization or left-handed circular polarization, linear polarization and the like, which is similar to the first embodiment.

Since the main excitation device 31 according to the third embodiment of the invention has such the circular patch pattern, the invention is not limited to the square patch antenna like the first embodiment. Based on any concept of the invention, the antenna device 300 having the circular patch antenna is applicable to any various kinds of wireless communication apparatuses.

Figure 12:
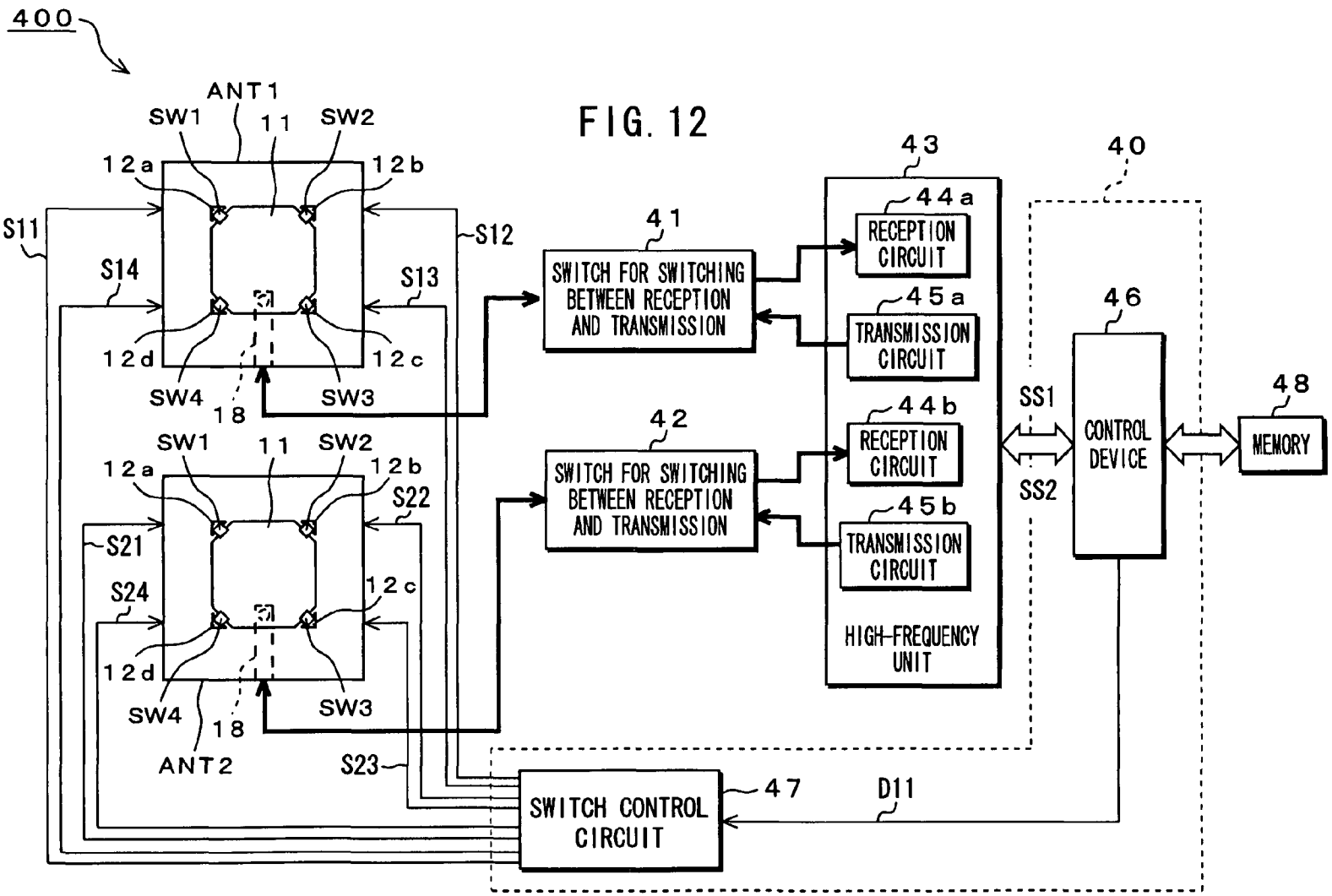
FIG. 12 is a block diagram for showing a configuration of a wireless communication apparatus to which the antenna device is applied according to a fourth embodiment of the invention.

FIG. 12 shows a configuration of a wireless communication apparatus 400 to which the antenna devices 100 are applied, according to a fourth embodiment of the invention.

In the embodiment, the wireless communication apparatus 400 uses N antenna devices (N are at least two) and N reception-and-transmission circuits (N are at least two). The wireless communication apparatus 400 suitably controls the antenna devices to radiate polarization, thereby implementing the MIMO communication (transmission) system that is preferable to any radio wave environment used. In this embodiment, the antenna devices 100 described in the first embodiment are respectively used as antennas ANT1, ANT2.

The wireless communication apparatus 400 shown in FIG. 12 is preferably applicable to wireless LAN for home use according to IEEE 802.11a scheme using carrier frequencies of a 5.2 GHz band, IEEE 802.11b/g scheme using carrier frequencies of a 2.4 GHz band or the like. The wireless communication apparatus 400 has a communication control unit 40, a high-frequency unit 43, a memory 48, two antenna devices ANT1, ANT2, and two switches 41, 42 for switching between reception and transmission. The wireless communication apparatus 400 implements the MIMO communication. The high-frequency unit 43 includes two reception circuits 44*a*, 44*b* and two transmission circuits 45*a*, 45*b*.

The switch 41 is connected to the antenna device ANT1. The switch 41 switches between the reception circuit 44*a* and the transmission circuit 45*a* in the high-frequency unit 43 so that any one of the reception circuit 44*a* and the transmission circuit 45*a* can be connected to a feeding terminal (the through-hole 16*e*) of the antenna device ANT1. The feeding terminal is connected to the main excitation device 11 of the antenna device ANT1 via the micro strip line 18, thereby feeding a transmission signal to the feeding terminal and receiving a reception signal from the feeding terminal. The feeding terminal and the micro strip line 18 form a feeding circuit.

The reception circuit 44*a* and the transmission circuit 45*a* forms a reception-and-transmission circuit that receives and transmits signals according to the MIMO communication system using the antenna device ANT1.

The reception circuit 44*a* is connected to the antenna device ANT1 through the switch 41 and receives the signal from the antenna device ANT1 through the switch 41 to perform any reception processing based on MIMO communication system.

The transmission circuit 45*a* is connected to the antenna device ANT1 through the switch 41 and performs any transmission processing on a signal based on MIMO communication system to feed the signal to the antenna device ANT1, through the switch 41, from which the signal is transmitted.

The switch 42 is connected to the antenna device ANT2. The switch 42 switches between the reception circuit 44*b* and the transmission circuit 45*b* in the high-frequency unit 43 so that any one of the reception circuit 44*b* and the transmission circuit 45*b* can be connected to a feeding terminal (the through-hole 16*e*) of the antenna device ANT2. The feeding terminal is connected to the main excitation device 11 of the antenna device ANT2 via the micro strip line 18, thereby feeding a transmission signal to the feeding terminal and receiving a reception signal from the feeding terminal. The feeding terminal and the micro strip line 18 form a feeding circuit.

The reception circuit 44*b* and the transmission circuit 45*b* forms a reception-and-transmission circuit that receives and transmits signals according to the MIMO communication system using the antenna device ANT2.

The reception circuit 44*b* is connected to the antenna device ANT2 through the switch 42 and receives the signal from the antenna device ANT2 through the switch 42 to perform any reception processing based on MIMO communication system.

The transmission circuit 45*b* is connected to the antenna device ANT2 through the switch 42 and performs any transmission processing on a signal based on MIMO communication system to feed the signal to the antenna device ANT2, through the switch 42, from which the signal is transmitted.

The communication control unit 40 is connected with the antenna devices ANT1, ANT2 and the high-frequency unit 43 and performs any on-off controls on the switches SW1 through SW4 of the antenna device ANT1 based on quality of communication of the signal received by the reception circuit 44*a* and any on-off controls on the switches SW1 through SW4 of the antenna device ANT2 based on quality of communication of the signal received by the reception circuit 44*b*.

The communication control unit 40 has a control device 46 and a switch control circuit 47. The switch control circuit 47 is connected to the antenna devices ANT1, ANT2. The switch control circuit 47 is also connected to the control device 46. The control device 46 includes a central processing unit (CPU), a micro processing unit (MPU), A/D converter, D/A converter, modulation/demodulation (Base Band) circuit, media access control (MAC) circuit, and a user interface, which are not shown.

The control device 46 controls the antenna devices ANT1, ANT2 through the high-frequency unit 43 and the switch control circuit 47. For example, the control device 46 transmits a switch-change-over signal SS1 to the switch 41 to switch between reception and transmission functions of the antenna device ANT1 and transmits a switch-change-over signal SS2 to the switch 42 to switch between reception and transmission functions of the antenna device ANT2.

Further, the control device 46 performs on-off controls of each of the switches SW1 through SW4, which are connected with the main excitation device 11 and each of the auxiliary excitation devices 12*a* through 12*d* of the antenna devices ANT1, ANT2, based on quality of communication of each of the signals received by the reception circuits 44*a*, 44*b*. For example, the reception circuits 44*a*, 44*b* measure reception sensitivity (received signal strength indicator (RSSI)). In a case of IEEE802.11a scheme, the reception sensitivity is given by monitoring an automatic gain control (AGC) signal before a quadrature amplitude demodulation has been carried out. Of course, the reception sensitivity can be given by any other methods, in addition to this, such as detection of the decoded data.

The control device 46 determines whether RSSI stays within a fixed range. If RSSI stays out of the fixed range, for example, RSSI stays under a lower threshold value or stays beyond an upper threshold value, the control device 46 transmits switch control data D11 for commanding and controlling any switch of polarizations to the switch control circuit 47. Thus, the switch control circuit 47 allows the switch of polarizations that the antenna devices ANT1, ANT2 radiate to be controlled (polarization diversity).

The control device 46 also controls the transmission circuits 45*a*, 45*b* based on quality of communication of each of the signals received by the reception circuits 44*a*, 44*b* to make suitable a subcarrier modulation scheme of each of the transmission signals that the transmission circuits 45*a*, 45*b* feed (transmit) to the antenna devices ANT1, ANT2. Such control of the subcarrier modulation scheme enables any MIMO communication (transmission) system that is preferable to any radio wave environment used to be implemented.

The memory 48 as an example of the storage medium is connected to the control device 46. As the memory 48, a read-only memory (ROM), a random-access memory (RAM) that can write or read information at any time, an electrically erasable programmable ROM (EEPROM) that can electrically erase or write information and/or a hard disk drive (HDD) are used. The memory 48 stores a control program for wireless communication apparatus that receives and transmits the signals according to the MIMO communication system.

The control program includes the steps of: setting switching operations of the switches SW1 through SW4 in each of the antenna devices ANT1, ANT2; detecting quality of communication by the square patch antenna formed based on the set switching operations of the switches SW1 through SW4; maintaining the setting on switching operations of the switches SW1 through SW4 based on the detected quality of communication by the square patch antenna; and performing the communication by the maintained setting on switching operations of the switches SW1 through SW4.

Thus, using the control program stored in the memory 48 enables three types of the square patch antennas formed by a combination of the main excitation device 11 and any of the auxiliary excitation devices 12*a* through 12*d* to be selected. Further, the square patch antenna is made optimal and thus, the optimal square patch antenna can receive and transmit the signals for polarization such as linear polarization and left and right-handed circular polarization.

The switch control circuit 47 receives the switch control data D11 from the control device 46 and generates switch selection signals S11 through S14 and S21 through S24 based on the switch control data D11 D11. Regarding the antenna device ANT1, the switch control circuit 47 transmits the switch selection signal S11 to the switch SW1; the switch selection signal S12 to the switch SW2; the switch selection signal S13 to the switch SW3; and the switch selection signal S14 to the switch SW4. Based on these switch selection signals S11 through S14, the switches SW1 through SW4 of the antenna device ANT1 are switched on or off.

The switch control circuit 47 receives the switch control data D11 from the control device 46. Regarding the antenna device ANT2, the switch control circuit 47 transmits the switch selection signal S21 to the switch SW1; the switch selection signal S22 to the switch SW2; the switch selection signal S23 to the switch SW3; and the switch selection signal S24 to the switch SW4. Based on these switch selection signals S21 through S24, the switches SW1 through SW4 of the antenna device ANT2 are switched on or off.

In this embodiment, the switches SW1 through SW4 are arranged clock-wise on four corners along two diagonals in the main excitation device 11. The pair of the switches SW1 and SW3 arranged along one diagonal therein is switched on while a pair of the switches SW2 and SW4 arranged along the other diagonal therein is switched off. Alternatively, the pair of the switches SW1 and SW3 arranged along one diagonal therein can be switched off while the pair of the switches SW2 and SW4 arranged along the other diagonal therein can be switched on. Thus, such the switch operation allows a right or left-handed circular polarization to be selected. If all the switches SW1 through SW4 arranged on four corners along two diagonals in the main excitation device 11 are switched on, the linear polarization can be selected.

TABLE 1

| COMBINATIONS | SWITCHES OF ANT 1 | | SWITCHES OF ANT 2 | | OPERATING STATES |
|---|---|---|---|---|---|
| | 1, 3 | 2, 4 | 1, 3 | 2, 4 | |
| 1 | ON | OFF | OFF | ON | ANT 1 RADIATES RHCP<br>ANT 2 RADIATES LHCP |
| 2 | OFF | ON | ON | OFF | ANT 1 RADIATES LHCP<br>ANT 2 RADIATES RHCP |
| . | . | | . | | |
| . | . | | . | | |
| . | . | | . | | |
| . | ON | ON | ON | ON | ANT 1 RADIATES LINER<br>ANT 2 RADIATES LINER |
| . | | | | | |
| . | | | | | |
| . | . | | . | | |
| . | . | | . | | |
| . | . | | . | | |
| N | | | | | |

TABLE 1 indicates combinations of four switched Sw1 through SW4 and operating states of the antenna devices corresponding thereto. In the TABLE 1, if the switches SW1 and SW3 of the square patch antenna by the antenna device ANT1 are switched on while the switches SW2 and SW4 of the square patch antenna by the antenna device ANT1 are switched off, the antenna device ANT1 radiates right-handed circular polarization (RHCP). If the switches SW1 and SW3 of the square patch antenna by the antenna device ANT2 are switched on while the switches SW2 and SW4 of the square patch antenna by the antenna device ANT2 are switched off, the antenna device ANT2 radiates light-handed circular polarization (LHCP).

If the switches SW1 and SW3 of the square patch antenna by the antenna device ANT1 are switched off while the switches SW2 and SW4 of the square patch antenna by the antenna device ANT1 are switched on, the antenna device ANT1 radiates left-handed circular polarization (LHCP). If the switches SW1 and SW3 of the square patch antenna by the antenna device ANT2 are switched on while the switches SW2 and SW4 of the square patch antenna by the antenna device ANT2 are switched off, the antenna device ANT2 radiates right-handed circular polarization (RHCP).

If all the switches SW1 through SW4 of the square patch antenna by the antenna device ANT1 are switched on, the antenna device ANT1 radiates linear polarization (LINEAR). If all the switches SW1 through SW4 of the square patch antenna by the antenna device ANT2 are switched on, the antenna device ANT2 also radiates linear polarization (LINEAR). It is to be noted that "ON" in the TABLE 1 indicates that the main excitation device 11 of each of the antenna devices ANT1, ANT2 is electrically connected to each of the auxiliary excitation devices 12*a* through 12*d*. If this is shown according to a geometry equivalent pattern, the main excitation device 11 and the auxiliary excitation devices 12*a* through 12*d* are integrated on an identical plane. It is also to be noted that "OFF" in the TABLE 1 indicates that the main excitation device 11 of each of the antenna devices ANT1, ANT2 is electrically disconnected to each of the auxiliary excitation devices 12*a* through 12*d*. If this is shown according to a geometry equivalent pattern, four corners of the square patch antenna are cut away so that the auxiliary excitation devices 12*a* through 12*d* are not electrically significant on an identical plane.

Thus, if all the switches SW1 through SW4 are switched on, the antenna devices ANT1, ANT2 radiate the linear polarizations, not circular polarizations. This allows the square patch antenna in each of the antenna devices ANT1, ANT2 to select any one of the three types of the polarizations, linear polarization and right and left-handed circular polarizations. If the three types of the radiated polarizations are selected so that their communication states can be made optimal, it is possible to perform any reception and/or transmission that are/is optimally suitable for radio wave environment that a user uses.

The following will describe a control method of controlling the wireless communication apparatus according to the invention.

Figure 13:
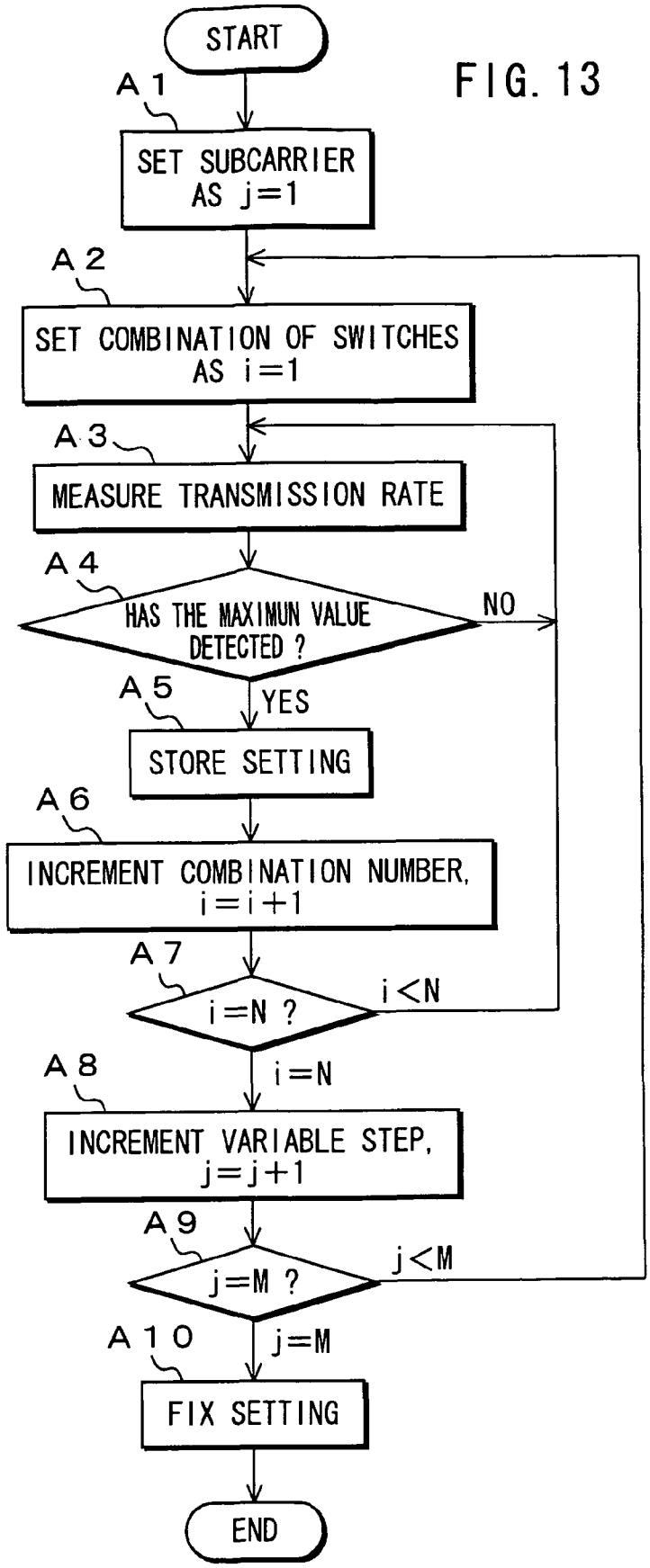
FIG. 13 is a flowchart for showing a control method of controlling the wireless communication apparatus to which the antenna devices are applied.

FIG. 13 is a flowchart for showing the control method of controlling the wireless communication apparatus 400 to which the antenna devices 100 are applied.

In this embodiment, it is estimated that in each of the antenna devices ANT1, ANT2, the switches SW1 through SW4 that are connected with the conductive main excitation device 11 having an octagonal shape, which is positioned on the substrate 19 of insulation, and each of the auxiliary excitation devices 12*a* through 12*d* positioned along diagonals in the main excitation device 11 across an insulation region of the substrate 19 are switched on or off so that the antenna devices ANT1, ANT2 can switch over the polarizations that the square patch antennas radiate, thereby enabling the antenna devices ANT1, ANT2 to receive and transmit the signals according to the MIMO communication system.

According to the MIMO communication system used in this embodiment, N (i=1, . . . , N) species of combinations of the switches to be switched alter so that setting of a maximum value of the reception and/or transmission rate(s) can be extracted (found). Then, M (j=1, . . . , M) species of subcarrier modulations are carried out so that the subcarriers alter, for example, from 64QAM to 16QAM, further to 8PSK, additionally to QPSK, to set any state of each of the antenna devices as having their maximum reception and/or transmission rates with the subcarrier altering, thereby enabling the wireless communication apparatus to receive and/or transmit the signals from and to any corresponding wireless communication apparatus.

Thus, suppose that such the operation setting is given, at step A1 of the flowchart shown in FIG. 13, the subcarrier is set as j=1. For example, the subcarrier is set as 64QAM. At step A2, the combination of switches SW1 through SW4 of each of the antenna devices ANT1, ANT2 is then set as i=1. At step A3, reception and/or transmission rates of the signals at the setting of a case of j=1 and i=l are measured. For example, reception circuits 44*a*, 44*b* measure reception sensitivities (RSSI and the like).

The process then goes to step A4 where it is determined (detected) whether the maximum reception and/or transmission rate(s) are/is given. If the maximum reception and/or transmission rate(s) are/is given, the process goes to step A5 where setting of the combination of the switches SW1 through SW4 of each of the antenna devices ANT1, ANT2 is stored (registered).

The process then goes to step A6 where the combination number of the switches is incremented by one (i=i+1) and the process goes to step A7. At the step A7, it is determined whether N species of combinations of switches have been completed. If N species of combinations of switches have not yet been completed, namely, i<N, the process goes back to the step A3 where transmission rate is measured. Then, the procedures such as determination, storage, and increment, in steps A4 through A6 are repeated.

If N species of combinations of switches have been completed, namely, i=N, at the step A7, the process goes to step A8 where a variable step of the subcarrier is incremented by one, j=j+1. For example, the subcarrier is changed from 64QAM to 16QAM.

The process then goes to step A9 where it is determined whether M species of variable steps of the subcarrier have been completed. If M species of variable steps have not yet been completed, namely, j<M, the process goes back to the step A2. At the step A2, the combination of switches SW1 through SW4 of each of the antenna devices ANT1, ANT2 is set as i=1. At step A3, reception and/or transmission rate(s) of the signals at the setting of a case of j=2 and i=1 are/is measured.

The process then goes-to step A4 where it is determined (detected) whether the maximum reception and/or transmission rate(s) are/is given in order to determine whether quality of communication by the square patch antenna is optimal. If the maximum reception and/or transmission rate are/is given, the process goes to step A5 where setting of the combination of the switches SW1 through SW4 of each of the antenna devices ANT1, ANT2, which have optimal quality of communication that has been detected, is maintained (extracted).

The process then goes to step A6. Thus, the steps A2 through A7 are repeated where the setting of the combination of the switches SW1 trough SW4, which has been determined as being optimal, is changed and maintained.

If, at the step A7, N species of combinations of switches have been completed, namely, i=N; at the step A8, the variable step of the subcarrier is incremented by one, j=j+1; and at step A9, j<M, the process goes back to the step A2 where the above processes are repeated. If j=M at the step A9, the process goes to step A10 where the setting is fixed. Such the setting of the combination of the switches SW1 through SW4 in which the optimal quality of communication is detected allows optimal communication to be implemented. Using the polarization thereof enables wireless communication processing by the MIMO communication system that is suitable to any radio wave environment used to be implemented.

Figures 14A, 14B:
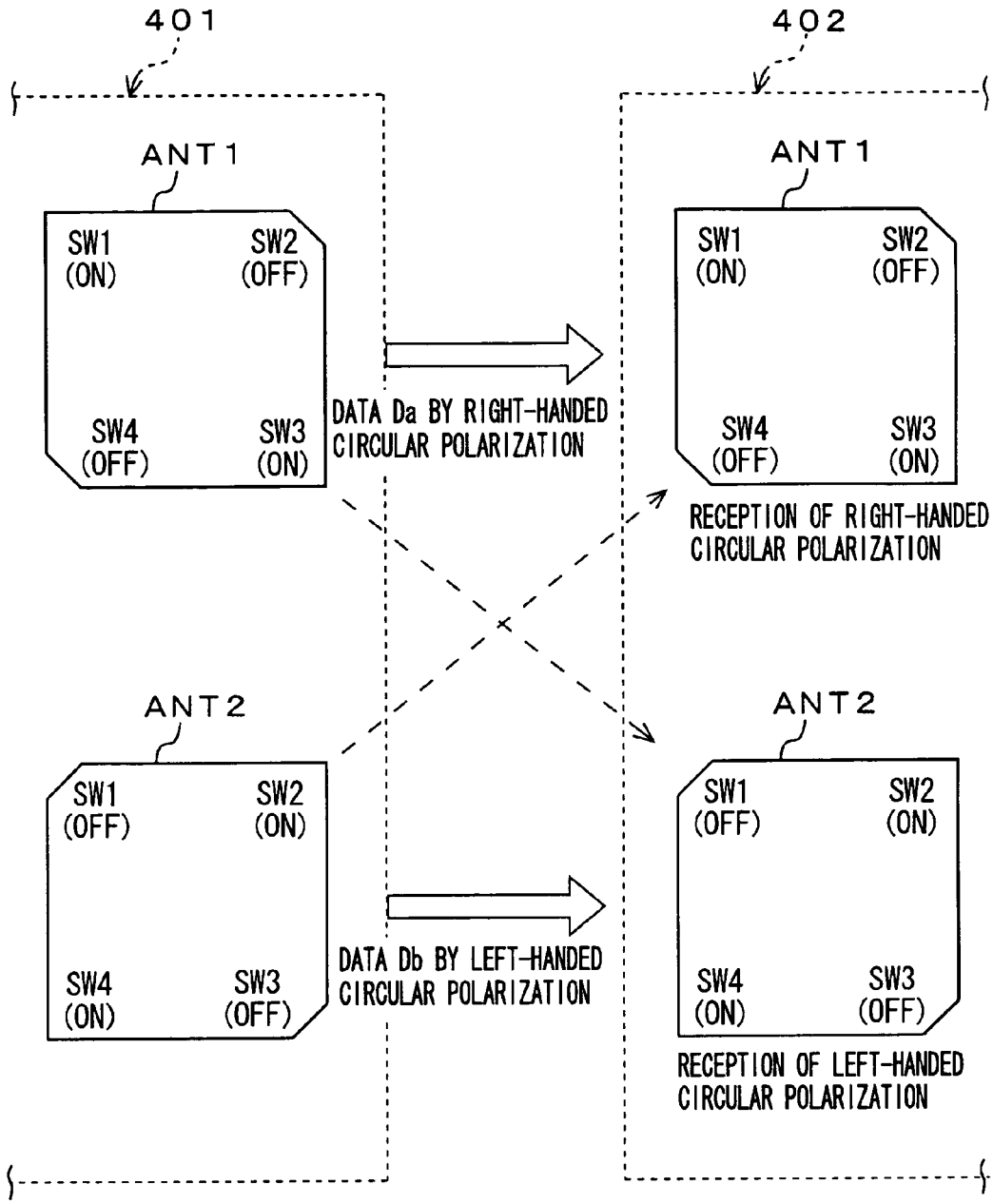
FIGS. 14A and 14B are diagrams each for showing an example of reception and transmission of signals according to MIMO communication system between wireless communication apparatuses when radio wave is not reflected.

FIGS. 14A and 14B show an example of reception and transmission of signals according to MIMO communication system between wireless communication apparatuses 401, 402 when radio wave is not reflected.

In this embodiment, the MIMO communication system is implemented by using two antenna devices ANT1, ANT2 when receiving and/or transmitting data. It proceeds with the talks on the assumption that communication process is carried out using the multipath environment. For example, the wireless communication apparatus 400 shown in FIG. 12 is applied to the wireless communication apparatus 401 shown in FIG. 14A on which two almost square antenna devices ANT1, ANT2 are arranged. The antenna device 100, 200, or 300 as the first, second or third embodiment can be applied to each of the antenna devices ANT1, ANT2.

According to this embodiment, in the antenna device ANT1 of the wireless communication apparatus 401, the switches SW1 and SW3 are switched on while the switches SW2 and SW4 are switched off, thereby enabling the antenna device ANT1 to radiate right-handed circular polarization. If this is shown according to a geometry equivalent pattern, the antenna device ANT1 is shown as a square patch pattern from which a right upper portion and a left lower portion are cut. This is a case where the antenna device ANT1 radiates data Da by the right-handed circular polarization.

Further, according to this embodiment, in the antenna device ANT2 of the wireless communication apparatus 401, the switches SW1 and SW3 are switched off while the switches SW2 and SW4 are switched on, thereby enabling the antenna device ANT2 to radiate left-handed circular polarization. If this is shown according to a geometry equivalent pattern, the antenna device ANT2 is shown as a square patch pattern from which a left upper portion and a right lower portion are cut. This is a case where the antenna device ANT2 radiates data Db by the right-handed circular polarization.

The wireless communication apparatus 400 shown in FIG. 12 is also applied to the wireless communication apparatus 402 shown in FIG. 14B on which two almost square antenna devices ANT1, ANT2 are arranged. The antenna device 100, 200, or 300 as the first, second or third embodiment is also applied to each of the antenna devices ANT1, ANT2.

According to this embodiment, in the antenna device ANT1 of the wireless communication apparatus 402, the switches SW1 and SW3 are switched on while the switches SW2 and SW4 are switched off, thereby enabling the antenna device ANT1 to receive right-handed circular polarization. If this is shown according to a geometry equivalent pattern, the antenna device ANT1 is shown as a square patch pattern from which a right upper portion and a left lower portion are cut. This is a case where the antenna device ANT1 also receives data Da by the right-handed circular polarization.

Further, according to this embodiment, in the antenna device ANT2 of the wireless communication apparatus 402, the switches SW1 and SW3 are switched off while the switches SW2 and SW4 are switched on, thereby enabling the antenna device ANT2 to receive left-handed circular polarization. If this is shown according to a geometry equivalent pattern, the antenna device ANT2 is shown as a square patch pattern from which a left upper portion and a right lower portion are cut. This is a case where the antenna device ANT2 also receives data Db by the right-handed circular polarization.

In the MIMO communication system of polarizations thus set, if there is no object by which radio wave is reflected, the antenna device ANT1 of the wireless communication apparatus 401 radiates the data Da by the right-handed circular polarization and the antenna device ANT1 of the wireless communication apparatus 402, which is ready for receiving the data Da by the right-handed circular polarization, receives the data Da. Similarly, the antenna device ANT2 of the wireless communication apparatus 401 radiates the data Db by the left-handed circular polarization and the antenna device ANT2 of the wireless communication apparatus 402, which is ready for receiving the data Db by the left-handed circular polarization, receives the data Db.

Figures 15A, 15B:
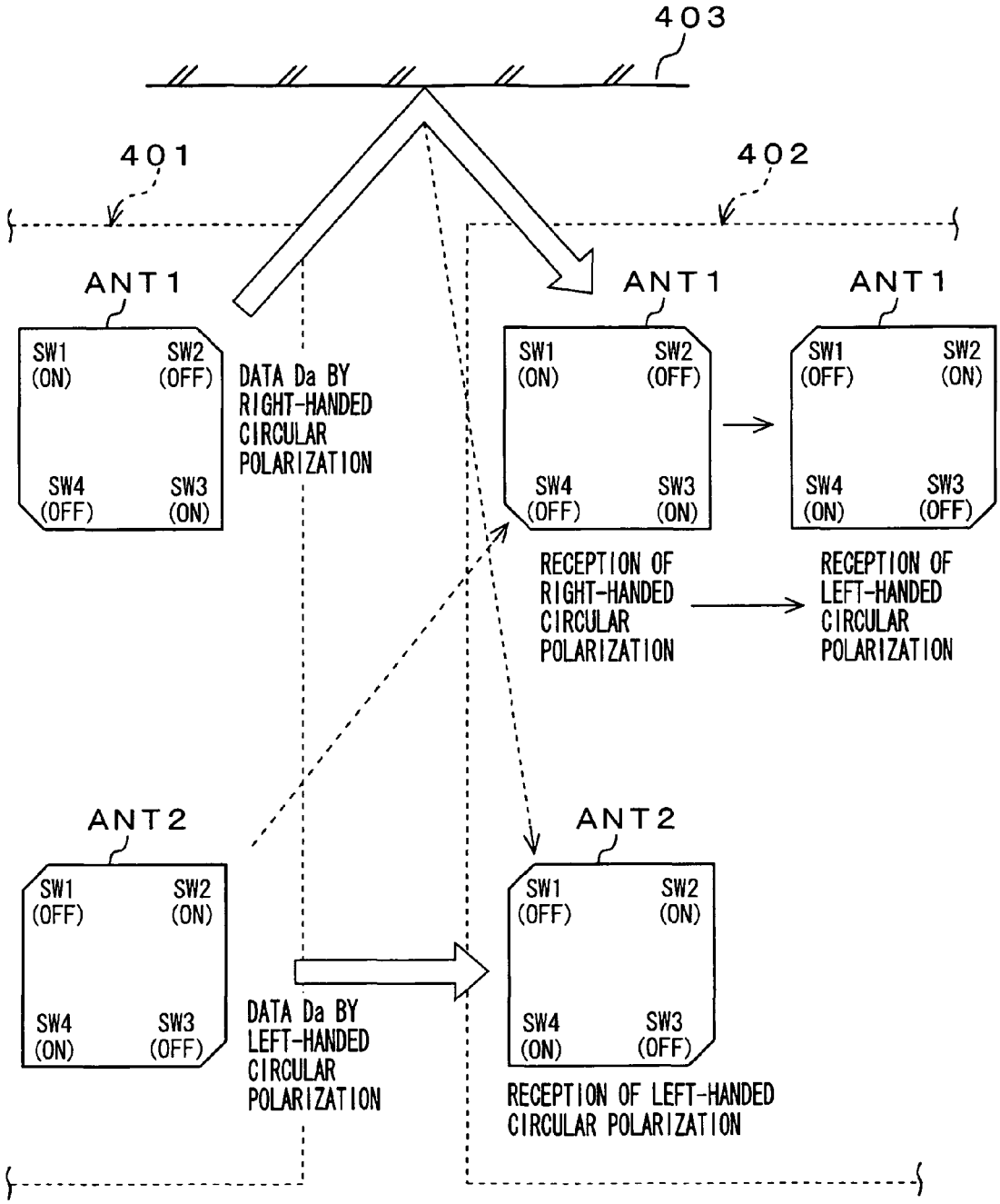
FIGS. 15A and 15B are diagrams each for showing an example of reception and transmission of signals according to MIMO communication system between wireless communication apparatuses when radio wave is reflected by an object.

FIGS. 15A and 15B show an example of reception and transmission of signals according to MIMO communication system between the wireless communication apparatuses 401, 402 when radio wave is reflected by an object 403.

In this embodiment, according to the MIMO communication system, any interference may occur -between the polarizations that should be orthogonalized by any influence of reflection by the object 403 under maltipath environment. On a case shown in FIGS. 14A and 14B, when radio wave radiated by the antenna device ANT1 of the wireless communication apparatus 401 is reflected one time, circular polarization of the radio wave thus reflected is made reverse. When the antenna device ANT1, ANT2 radiate radio wave by the right-handed circular polarization and the left-handed circular polarization, their circular polarizations are finally established as same-handed circular polarization by the reflection of the radio wave radiated by the antenna device ANT1 so that any interference may occur even if a distinction between the right-handed circular polarization and the left-handed circular polarization is established in the radiated radio wave.

On the other hand, even if the antenna device ANT1, ANT2 radiate radio wave by the same-handed circular polarization when radio wave radiated by the antenna device ANT1 of the wireless communication apparatus 401 is reflected by the object 403 one time, circular polarization of the radio wave thus reflected is made reverse, thereby preventing any interference from occurring in spite of any influence of the reflection.

Thus, under the multipath environment, the polarization variously alters. Even if the polarizations are orthogonalized when radiating radio wave, this may not be necessarily reached to any excellent quality of communication under any radio wave environment. For example, the wireless communication apparatus 402 shown in FIG. 15B receives as direct wave, nor reflected wave, the data Db by left-handed circular polarization radiated by the antenna device ANT2 of the wireless communication apparatus 401 shown in FIG. 15A. The wireless communication apparatus 402 shown in FIG. 152 also receives, as reflected wave, the data Da by right-handed circular polarization radiated by the antenna device ANT1 of the wireless communication apparatus 401.

In this case, the following two method of improving quality of communication of the received signal are conceivable.

As a first method, sensitivity of a received signal (RSSI or the like) is detected and the detected results are fed back to the transmission side. The wireless apparatus 401 transmits radio wave with the antenna device ANT2 thereof being kept unchanged while with only the antenna device ANT1 thereof being switched from its right-handed circular polarization to its left-handed circular polarization. Namely, in the antenna device ANT1 of the wireless apparatus 401, the switches SW1 and SW3 are switched from on to off and the switches SW2 and SW4 are switched from off to on. Thus, when transmitting radio wave, both of the antenna devices ANT1, ANT2 of the wireless communication apparatus 401 transmit the signals of same-handed circular polarization. When receiving the signals, any interference does not occur in the wireless communication apparatus 402 because circular polarization of the reflected radio wave is finally made reverse. According to this first method, a reception level can be raised up even if any interference occurs when no level of signal that is necessary for demodulation by the receiving side can be obtained.

As a second method, according to sensitivity of a received signal (RSSI or the like), the wireless apparatus 402 receives radio wave with the antenna device ANT2 thereof being kept unchanged while with only the antenna device ANT1 thereof selecting one from cases of switching from its right-handed circular polarization to its left-handed circular polarization or being kept unchanged. According to this second method, since a level of signal that is necessary for demodulation by the receiving side has been obtained, quality of communication can be improved by decreasing a level of interference signal by daring its receiving sensitivity to be deteriorated.

In this embodiment, sensitivity of a received signal (RSSI or the like) is detected and according to this RSSI, the wireless apparatus 402 receives radio wave with its circular polarizations being preferably switched from right-handed circular polarization to left-handed circular polarization and vice versa easily.

The following will describe an examination of detection of RSSI.

Figure 16:
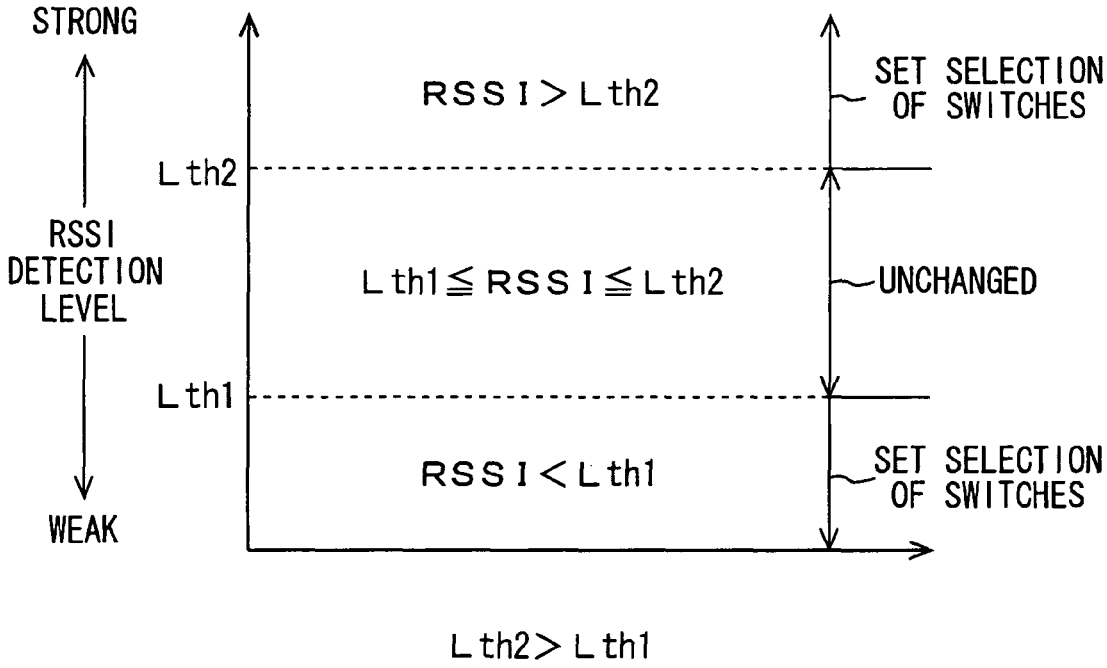
FIG. 16 is a diagram for showing a RSSI detection level, which indicates an example of setting threshold values when controlling selection of switches (polarizations)
Figure 17:
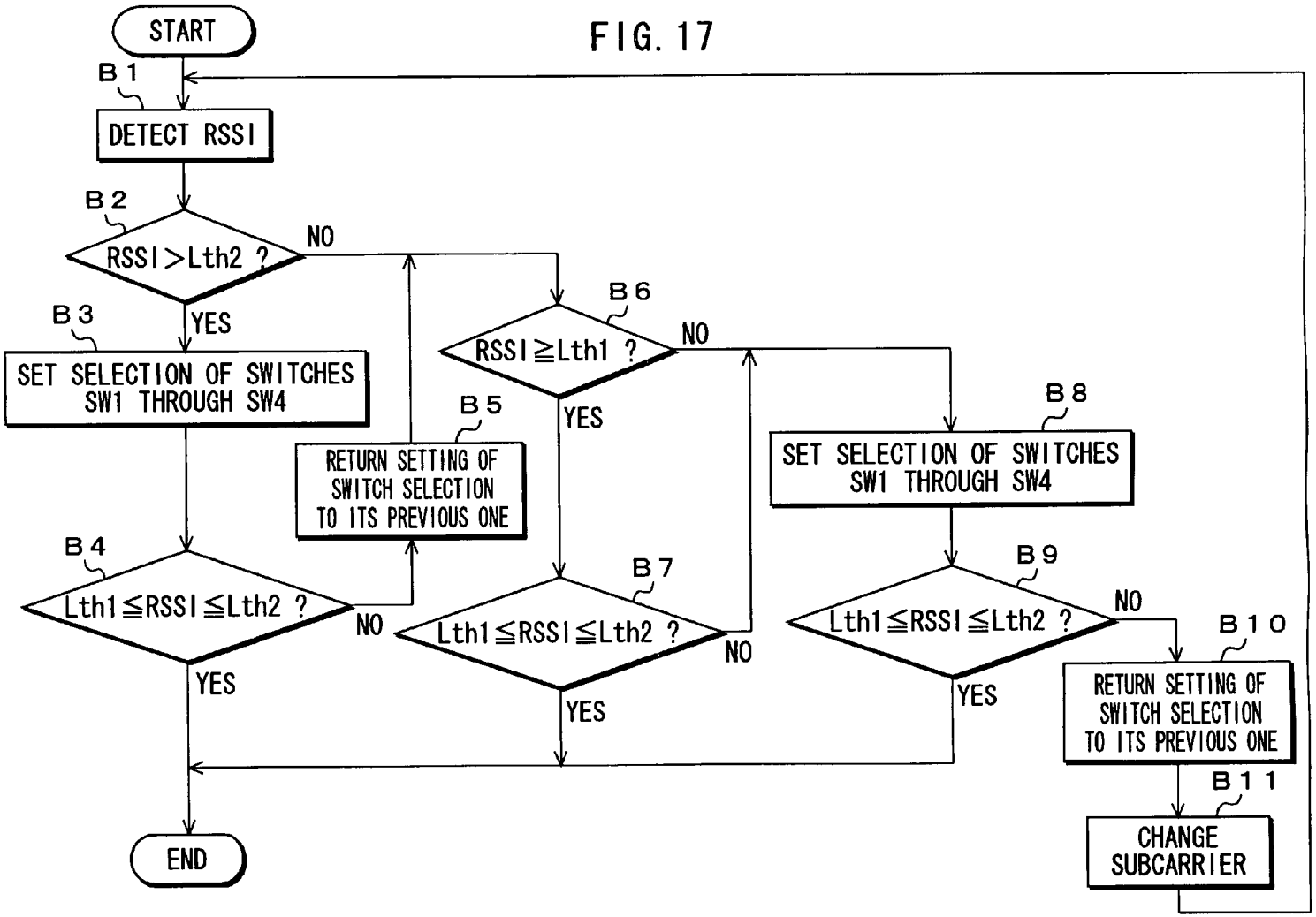
FIG. 17 is a flowchart for showing an example of controlling selection of polarizations in the wireless communication apparatus at the receiving side.

FIG. 16 shows an RSSI detection level, which indicates an example of setting threshold values when controlling selection of switches (polarizations). FIG. 17 is a flowchart for showing an example of controlling selection of polarizations in the wireless communication apparatus 402 at the receiving side.

In this embodiment, if, according to the RSSI, the wireless apparatus 402 or the like receives radio wave with its circular polarizations being switched from right-handed circular polarization to left-handed circular polarization and vice versa, a lower threshold value Lth1 and an upper threshold value Lth2 (Lth1<Lth2) are set relative to the RSSI detection level, as shown in FIG. 16. It proceeds with the talks on the assumption that the circular polarizations are switched from right-handed circular polarization to left-handed circular polarization and vice versa based on the threshold values Lth1, Lth2.

In this embodiment, the switches SW1 through SW4 are switched on or off to select the polarizations only if RSSI>Lth2 and RSSI<Lth1. If Lth1<=RSSI<=Lth2, the switches SW1 through SW4 are not switched to keep the current receiving state unchanged.

Under these switching conditions of switches (polarizations), at step B1 of the flowchart shown in FIG. 17, RSSI is detected. The reception circuits 44*a* and 44*b* of the wireless communication apparatus 402 detect the RSSI and transmit RSSI detection data to the control device 46.

At step B2, the control device 46 compares the detected RSSI with the upper threshold value Lth2 based on the RSSI detection data to determine whether the RSST is more than Lth2, RSSI>Lth2. If the RSST is more than Lth2, the process goes to step B3 where the switches SW1 through SW4 are switched on or off to select the polarizations (see FIGS. 15A and 15B).

At step B4, the control device 46 determines whether the detected RSSI stays within a range from the lower threshold value Lth1 to the upper threshold value Lth2, Lth1<=RSSI<=Lth2. If the RSSI stays within the range, the control device 46 keeps current receiving state of the wireless communication apparatus 402 unchanged.

At the step B2, if not RSSI>Lth2, namely, the detected RSSI is equal to Lth2 and less than Lth2, the process goes to step B6. At the step B4, if not Lth1<=RSSI<=Lth2, the process goes to step B5 where setting of switch selection returns to its previous one and the process goes to step B6.

At the step B6, the control device 46 compares the detected RSSI with the lower threshold value Lth1 to determine whether the RSST is less than Lth1, RSSI<Lth1.

If the RSST is equal to or more than Lth1, the process goes to step B7 where the control device 46 determines whether the detected RSSI stays within a range from the lower threshold value Lth1 to the upper threshold value Lth2, Lth1<=RSSI<=Lth2. If the RSSI stays within the range, the control device 46 keeps current receiving state of the wireless communication apparatus 402 unchanged. If the RSST is less than Lth1 at the step B6, the process goes to step B8 where the control device 46 switches the switches SW1 through SW4 on or off to select the polarizations. The process then goes to step B9 where the control device 46 determines whether the detected RSSI stays within a range from the lower threshold value Lth1 to the upper threshold value Lth2, Lth1<=RSSI<=Lth2. If the RSSI stays within the range, the control device 46 keeps current receiving state of the wireless communication apparatus 402 unchanged.

At the step B9, if not Lth1<=RSSI<=Lth2, the process goes to step B10 where setting of switch selection returns to its previous one and the process then goes to step B11 where any subcarrier is changed. The process further goes back to the step B1 and repeats processes in the above steps.

Thus, according to the wireless communication apparatus and the control method of controlling the same, as the fourth embodiment of the invention, to which the antenna devices ANT1, ANT2 are applied, it is possible to select the polarizations that the square patch antenna radiates by switching on or off the switches SW1 through SW4 that are connected with the main excitation device 11 and each of the auxiliary excitation devices 12*a* through 12*d*.

In this embodiment, on-off control of the switches SW1 through SW4 allows the main excitation device 11 and any of the auxiliary excitation devices 12*a* through 12*d* arranged along one diagonal in the main excitation device 11 to be electrically connected while the main excitation device 11 and any of the auxiliary excitation devices 12*a* through 12*d* arranged along the other diagonal in the main excitation device 11 to be electrically disconnected. This enables an antenna structure of circular polarization specifying the right or left-handed circular polarization to be configured. If all the switches SW1 through SW4 arranged on four corners positioned along two diagonals in the main excitation device 11 are switched on, this enables an antenna structure of linear polarization to be configured.

Selecting one of three types of antenna structures formed by the combination of the main excitation device 11 and any of the auxiliary excitation devices 12*a* through 12*d* allows to be received and transmitted the signals of linear polarization and right and left-handed circular polarizations, thereby implementing any wireless communication, according to the MIMO communication system, that is preferably applicable to any radio wave environment.

Although, in the above embodiments, cases where the auxiliary excitation devices 12*a* through 12*d* and the switches SW1 through SW4 are respectively arranged on four corners positioned along two diagonals in the main excitation device 11 have been described, this invention is not limited thereto. For example, two auxiliary excitation devices and the switches can be respectively arranged on two corners positioned along one diagonal in the main excitation device 11, not four corners positioned along two diagonals in the main excitation device 11, in order to reduce the costs thereof, and the other two corner positioned along the other diagonal in the main excitation device 11 can be not cut. If the switches, for example, SW1, SW3 are switched on or off, the linear polarization or the circular polarization (right or left-handed circular polarization) can be selected so that optimal quality of communication can be detected.

Although, in the embodiments, cases where the antenna device (square patch antennas) ANT1, ANT2 described in the above first embodiment are applied to the wireless communication apparatus have been described, this invention is not limited thereto. For example, the wireless communication apparatuses to which plural antenna devices 200 using MEMS switches SW1' to SW4' described in the second embodiment or plural antenna devices 300 having the circular patch pattern described in the third embodiment can be configured. These wireless communication apparatuses can obtain an excellent effect similar to that of the wireless communication apparatus 400.

Figure 18:
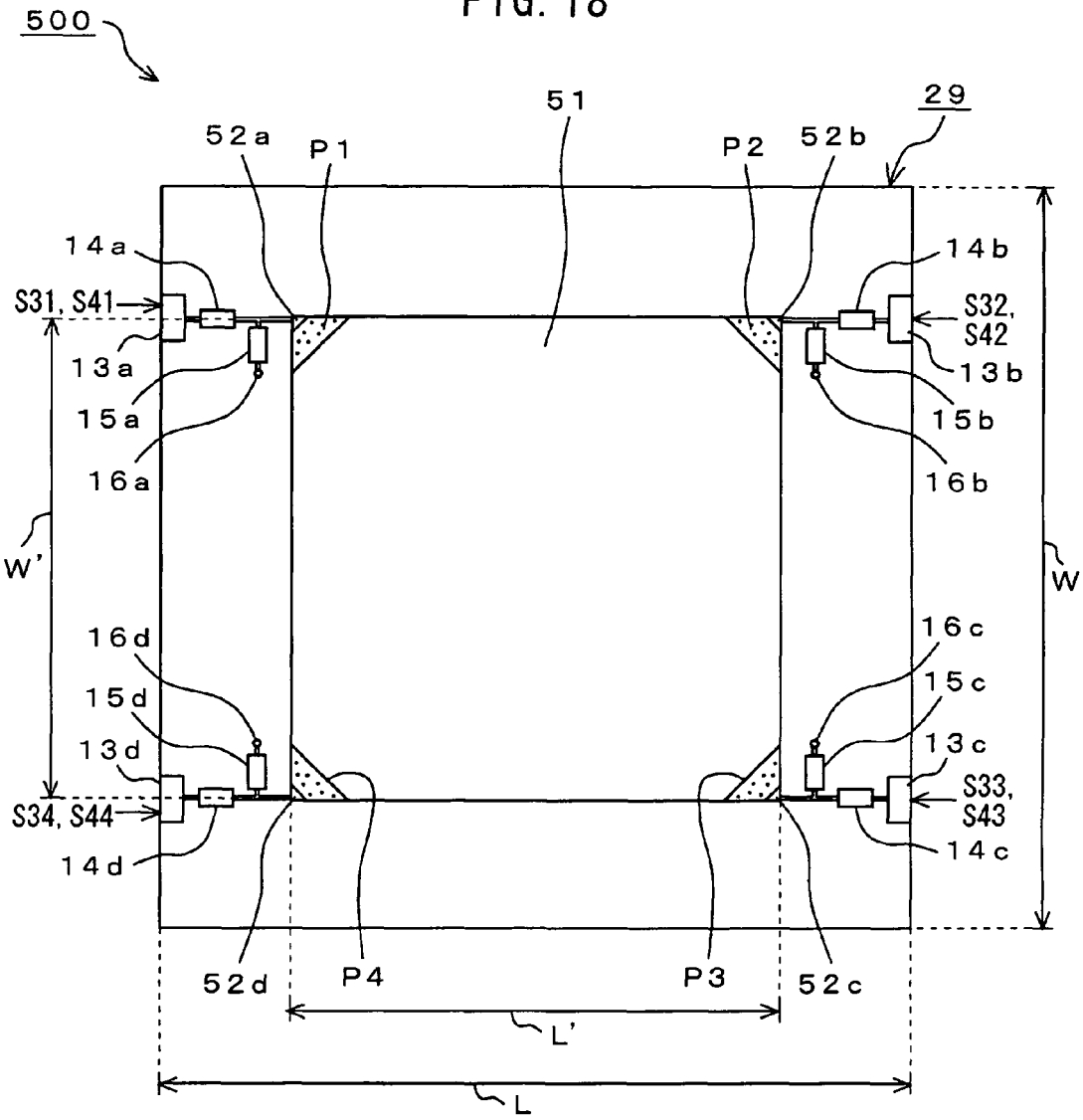
FIG. 18 is a diagram for showing a configuration of an antenna device according to a fifth embodiment of the invention.

FIG. 18 shows a configuration of an antenna device 500 according to a fifth embodiment of the invention.

The antenna device 500 shown in FIG. 18 is preferably applicable to an antenna device, which receives and transmits signals according to the MIMO communication system at the same time using plural flat antennas, and a wireless communication apparatus using the antenna device. The antenna device 500 has a dielectric substrate 29 and a conductive main excitation device 51, as an example of a flat antenna main body, which is positioned on the substrate 29. The main excitation device 51 has a shape, for example, a polygonal patch pattern such as an octagon that is given by cutting four corners from a square. The substrate 29 has a length of L and a width of W. The main excitation device 51 has a length of L' (L'<L) and a width of W (W'<W). The main excitation device 51 has a thickness of "t" and is made of metallic materials such as copper, cupronickel, phosphorus bronze, brass, stainless steel (SUS), and gold. The main excitation device 51 is formed by means of any etching method of a copper foil onto the substrate, any metallic plating to resin, any affixation technology of metallic foil and the like.

Triangular auxiliary excitation elements P1 through P4 (degeneracy separation elements or perturbation elements) for polarization control as examples of semi-conductive polarization control elements are positioned along diagonals in the main excitation device 51. The auxiliary excitation elements P1 through P4 are made of semi-conductive resin materials, which are different from those of the main excitation device 51. For example, the auxiliary excitation elements P1 through P4 are made of semi-conductive plastic material such as polyacetylene, polythiophene, polypyrrol, polyanilene and polyazulene.

The auxiliary excitation elements P1 through P4 are formed on the underlying dielectric substrate 29 so that triangular conductive (semi-conductive) plastic material can be successively connected to four corners of the octagonal main excitation device 51. They are connected using any predetermined adhesive agent. In this embodiment, an entire shape of a patch antenna including the main excitation device 51 and the auxiliary excitation elements P1 through P4 is square.

The auxiliary excitation element P1 has a control electrode 52*a* made of metallic material and direct-current voltage is applied across the electrode 52*a*. Similarly, other auxiliary excitation elements P2 through P4 respectively have control electrodes 52*b* through 52*d* made of metallic materials and direct-current voltage is applied across each of the electrodes 52*b* through 52*d*. In this embodiment, the square patch antenna radiates the polarizations with them being switched by controlling the direct-current voltage that is applied across each of the control electrodes 52*a* through 52*d*.

The dielectric substrate 29 is made of solid electrolyte material such as silicon gel, acrylonitrile gel, and polysaccharide polymer.

The dielectric substrate 29 has four control terminals 13*a* through 13*d*. The control terminal 13*a* is connected to a control electrode 52*a* of the auxiliary excitation element P1 through a choke coil 14*a*. A bypass capacitor 15*a* is connected with the control electrode 52*a* and a ground (GND) pattern 17, which will be described later. The choke coil 14*a*, the bypass capacitor 15*a* and the like form a filter for preventing high-frequency current from being diffracted, which can be connected to any lines for direct-current power supply at need. Such the filter can be laid out (positioned) on a suitable position.

The GND pattern 17 is provided on a rear surface of the substrate 29. The bypass capacitor 15*a* is connected to the GND pattern 17 via a through-hole 16*a*. Similarly, other control terminals 13*b* through 13*d* are respectively connected to control electrodes 52*b* through 52*d* of the auxiliary excitation elements P2 through P4 through choke coils 14*b* through 14*d* or the like. Further, similarly, bypass capacitors 15*b* through 15*d* are respectively connected to the GND pattern 17 via through-holes 16*b* through 16*d*.

Direct-current biased voltage (hereinafter referred to as "function-controlling signal" S31 to S34, S41 to S44) selecting function such as selection between conduction and insulation of each of the auxiliary excitation elements P1 through P4 is supplied to each of the control terminals 13*a* through 13*d* so as to be applied across each of the control electrodes 52*a* through 52*d* and the GND pattern 17. The control terminal 13*a* through 13*d* and the GND pattern 17 are connected to a communication control unit (a function control circuit or the like), which is not shown. In the auxiliary excitation elements P1 through P4, the direct-current voltage is applied across each of the pairs of the auxiliary excitation elements P1 and P3 as well as P2 and P4 that are arranged along each of the diagonals. Such the square patch antenna radiates polarization such as circular polarization like right-handed circular polarization or left-handed circular polarization, linear polarization and the like (see "New Antenna Engineering" written by Hiroyuki ARAI and published by Sougou Electronic Publisher in 1996.

Figure 19A:
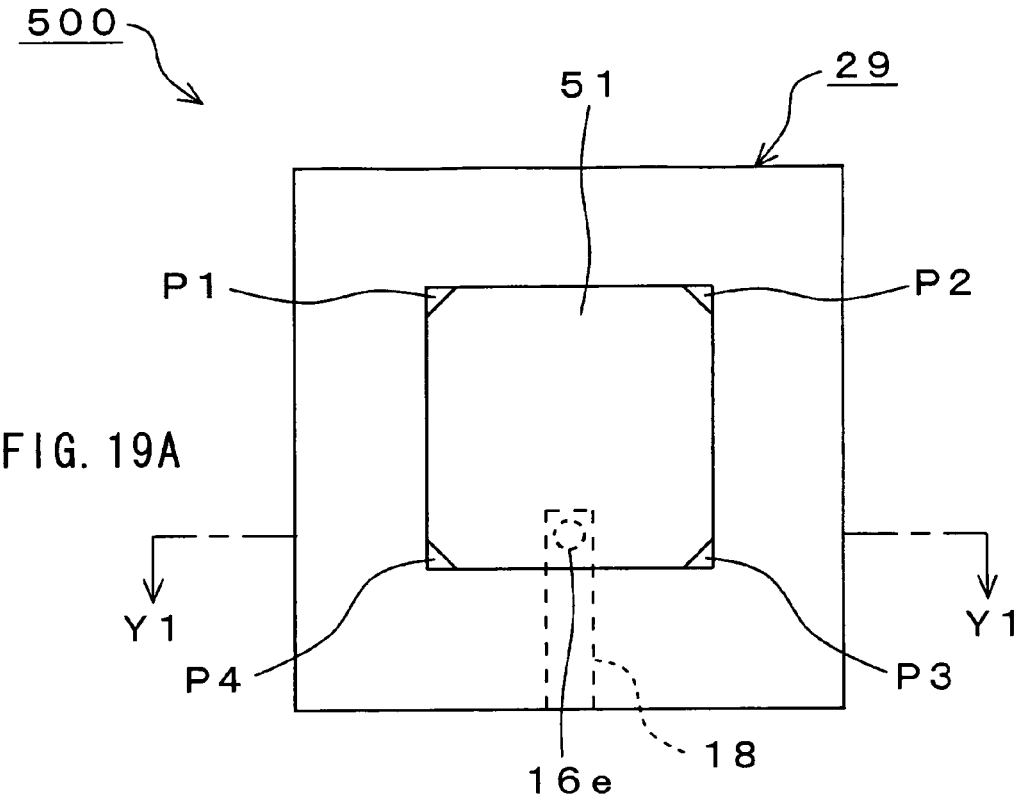
FIG. 19A is a plane view of the antenna device shown in FIG. 18 illustrating a configuration thereof and FIG. 19B is a sectional view of the antenna device taken along the lines Y1-Y1 of FIG. 19A.
Figure 19B:
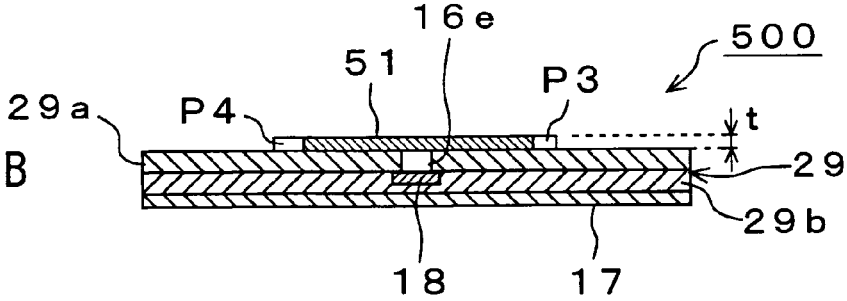
Figure 20:
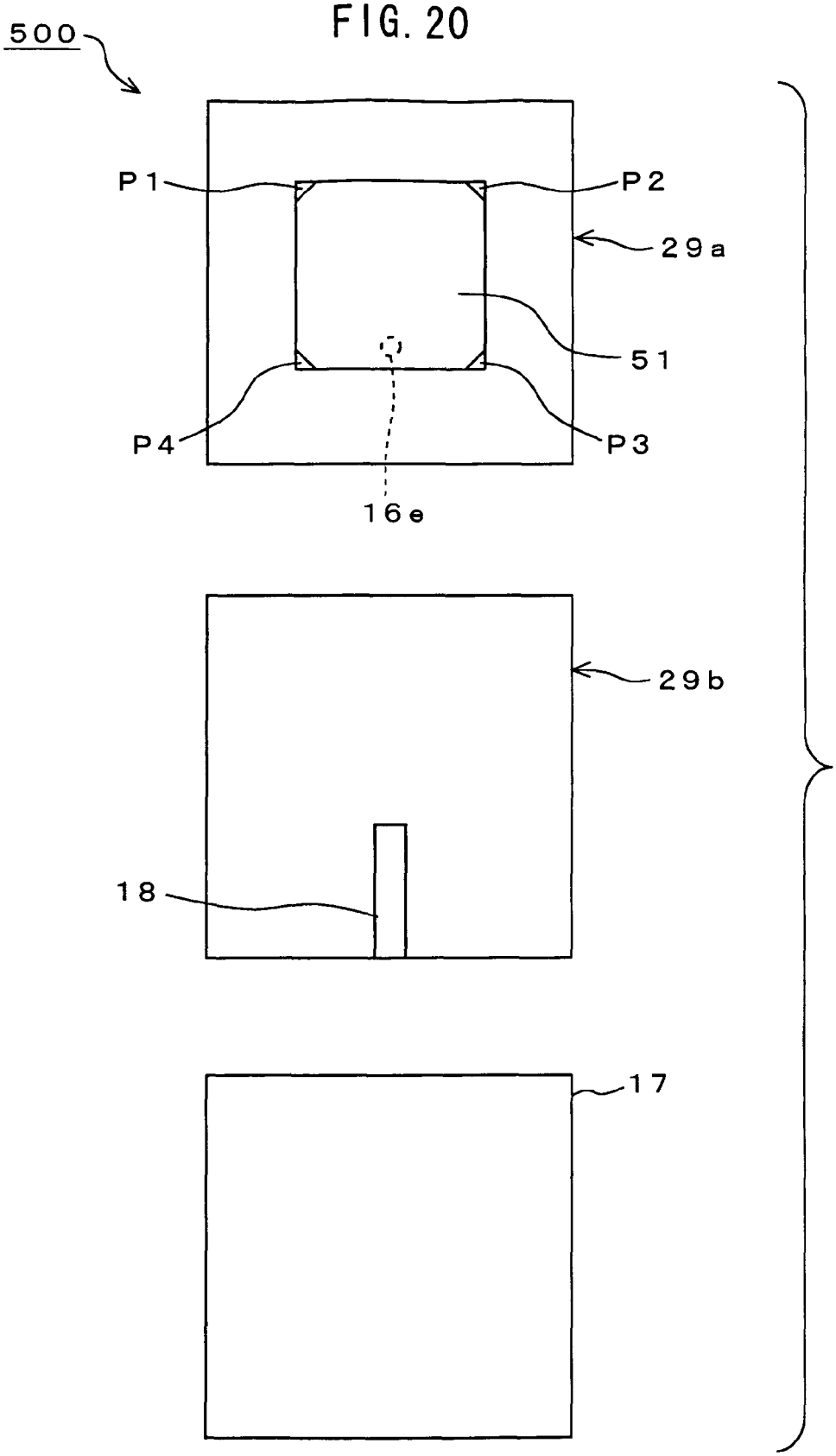
FIG. 20 is an exploded view of the antenna device 500 for showing its laminated configuration.

FIG. 19A shows a plane view of the antenna device 500 illustrating a configuration thereof and FIG. 19B shows a sectional view of the antenna device 500 taken along the lines Y1-Y1 of FIG. 19A. FIG. 20 is an exploded view of the antenna device 500 for showing its laminated configuration.

As shown in FIG. 19A, the antenna deice 500 has the square dielectric substrate 29, the octagonal main excitation device 51 and the triangular auxiliary excitation elements P1 through P4. As shown in FIG. 19A, each of the auxiliary excitation elements P1 through P4 extends outward from four corners of the main excitation device 51 so that an entire shape of patch antenna including the main excitation device 51 and each of the auxiliary excitation elements devices P1 through P4 can be shown as being square.

The antenna device 500, as shown in FIG. 20, has a three-layer structure. A first layer thereof has the dielectric substrate 29*a*, the main excitation device 51, the triangular auxiliary excitation elements P1 through P4. The conductive main excitation device 51 and the auxiliary excitation elements P1 through P4 are arranged on the dielectric substrate 29*a* in the first layer. The substrate 29*a* has a through-hole 16*e* under the main excitation device 51 and the through-hole is used for an RF feeding point.

A second layer shown in FIG. 20 has the dielectric substrate 29*b* and a micro strip line 18 formed in the substrate 29*b*. The micro strip line 18 is connected to the main excitation device 51 via the through-hole 16*e* formed in the dielectric substrate 29*a* of the first layer. The micro strip line 18 has characteristic impedance of 50 Ω and is arranged with it being sandwiched between the substrates 29*a* and 29*b* of the first and second layers. The micro strip line 18 has a feeding terminal (a feeding circuit) that is connected to a high-frequency circuit of a wireless communication apparatus or the like. A transmission signal is fed to the feeding terminal and a reception signal is received from the feeding terminal.

A third layer shown in FIG. 20 has GND pattern (GND layer) 17 that is arranged over an entire rear surface of the dielectric substrate 29*b* of the second layer. Thus, the antenna device 500 having the three-layer structure is formed.

There will describe how to manufacture such the antenna device 500 having the three-layer structure.

A square dielectric substrate, a surface of which has a copper foil, is prepared. An octagonal resist layer is applied on the copper foil and is patterned so that an octagonal can be formed for the main excitation device 51. By using the resist layer as a mask, suitable etching liquid can remove an excessive copper foil therefrom. This enables the octagonal main excitation device 51 to be formed on the square substrate.

Further, the triangular semi-conductive plastic sheets are adhered to the dielectric substrate 29 with them being successively connected to each of the four corners of the octagonal main excitation device 51. This enables the auxiliary excitation elements P1 through P2 to be formed. The semi-conductive plastic sheets are adhered to the dielectric substrate 29 using any predetermined adhesive agent. It is to be noted that the semi-conductive plastic sheet is formed as being triangle so that an entire shape of patch antenna including the main excitation device 51 and the auxiliary excitation elements devices P1 through P2 can be shown as being square.

Next, the through-hole 16*e* having a predetermined diameter is formed in the square dielectric substrate to reach a rear face of the main excitation device 51. The through-hole 16*e* is formed by using any drill or the like. The diameter of the through-hole 16*e* may have an extent such that the through-hole can contain any conductive component. Thus, the first substrate 29*a* having the main excitation device 11 and the auxiliary excitation elements P1 through P4 on a surface thereof and the through-hole 16*e* having a predetermined diameter therein to reach the rear surface of the main excitation device 51 can be configured.

Next, another square dielectric substrate, both surfaces of which have copper foils, is prepared. A resist layer having a predetermined shape for the micro strip line 18 is applied on the copper foil on one surface of the substrate and is patterned. The resist layer is applied so that it can be aligned to the through-hole 16*e*. A resist layer is applied over the copper foil on the other surface of the substrate. By using the resist layers as masks, suitable etching liquid can remove an excessive copper foil therefrom. This enables to be formed the second substrate 29*b* on a surface of which the micro strip line 18 is formed and on the other surface of which the GND pattern 17 is formed. Of course, this invention is not limited thereto. A copper foil corresponding to the micro strip line 18 can be affixed to a non-copper-foil-formed surface of the substrate, the other surface of which has a copper foil.

Then, the first substrate 29*a* having the main excitation device 51, the auxiliary excitation elements P1 through P4, and the through-hole 16*e* and the second substrate 29*b* having the micro strip line 18 and the GND pattern 17 are firmly affixed to each other using any predetermined adhesive agent. The surface of the first substrate 29*a* on which the main excitation device 11 and the auxiliary excitation elements P1 through P4 are not mounted and the surface of the second substrate 29*b* in which the micro strip line 18 is positioned are affixed to each other. In this moment, the through-hole 16*e* contains any conductive materials to connect the main excitation device 11 and the micro strip line 18.

Figure 21A:
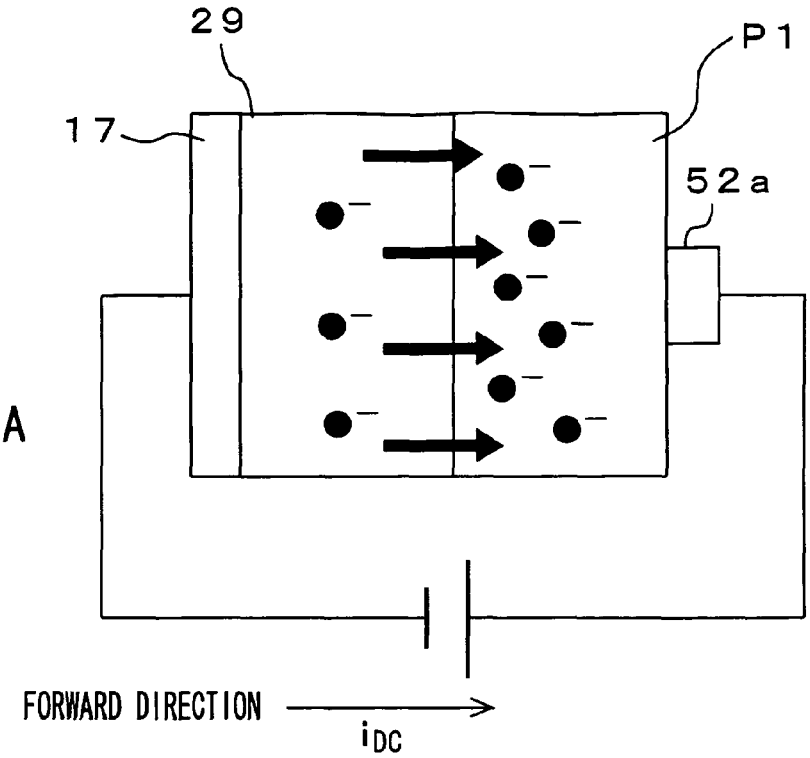
FIGS. 21A and 21B are drawings each for explaining a control example of making each auxiliary excitation element P1 or the like conductive or insulated.
Figure 21B:
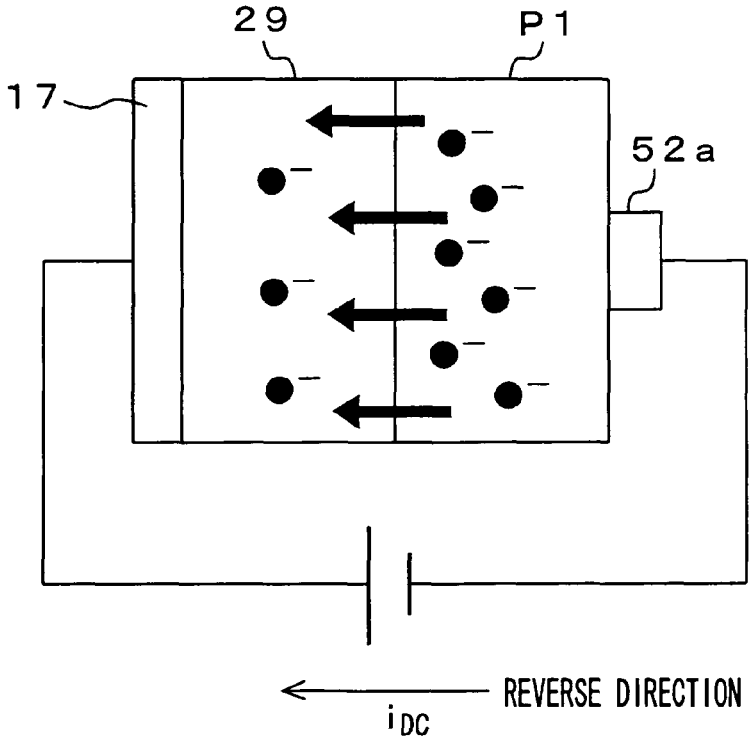

FIGS. 21A and 21B are drawings each for explaining a control example of making each auxiliary excitation element P1 or the like conductive or insulated.

A junction configuration shown in FIG. 21A indicates a portion of the auxiliary excitation element P1 mounted on the dielectric substrate 29 as shown in FIG. 18. The dielectric substrate 29 is made of solid electrolyte material such as silicon gel, acrylonitrile gel, and polysaccharide polymer. Such the solid electrolyte material is subject to derivation of an anion. The auxiliary excitation element P1 is made of semi-conductive plastic material such as polyacetylene, polythiophene, polypyrrol, polyanilene and polyazulene.

On the junction configuration shown in FIG. 21A, forward biased voltage is applied across the control electrode 52*a* of the auxiliary excitation element P1 and the GND pattern 17 on the rear surface of the substrate 29. When such the biased voltage is applied thereacross, the anion is moved from the dielectric substrate 29, which is made of solid electrolyte material, to the auxiliary excitation element P1, which is made of semi-conductive plastic material. This enables the auxiliary excitation element P1 to be made conductive, thereby changing its electric nature so as to allow electricity to pass through it like metallic materials.

Contrarily, if, on the junction configuration shown in FIG. 21B, reverse biased voltage is applied across the control electrode 52*a* of the auxiliary excitation element P1 and the GND pattern 17 on the rear surface of the substrate 29, the anion is moved from the auxiliary excitation element P1 to the dielectric substrate 29. This enables the auxiliary excitation element P1 to be made insulated, thereby changing its electric quality so as to prevent electricity from passing through it like insulation.

Thus, based on a direction of applying direct-current voltage across the junction configuration between the solid electrolyte material and the semi-conductive plastic material, the auxiliary excitation element P1 or the like changes its electric nature from conduction to insulation and vice versa because of movement of the anion. In this embodiment, this nature is applied to switching operation of the polarizations that the patch antenna radiates.

On the antenna device 500 having the three-layer structure according to the fifth embodiment of the invention, the auxiliary excitation elements P1 through P4 are respectively arranged on four position along two diagonals in the main excitation device 51 and two auxiliary excitation elements P1 and P3 arranged along the one diagonal are made conductive while two auxiliary excitation elements P2 and P4 arranged along the other diagonal are made insulated. Such the function control from conduction to insulation and vice versa of each of the auxiliary excitation elements P1 through P4 enables the main excitation device 51 and each of the auxiliary excitation elements P1 and P2 arranged along the one diagonal to be electrically connected to each other while the main excitation device 51 and each of the auxiliary excitation elements P2 and P4 arranged along the other diagonal to be insulated. This allows an antenna device for circular polarization indicating any property of a right or left-handed circular polarization to be formed.

When all the auxiliary excitation elements P1 through P4 arranged on four positions along two diagonals in the main excitation device 51 are made conductive, it is possible to form an antenna structure for linear polarization.

Thus, the function control of each of the auxiliary excitation elements P1 through P4 enables the main excitation device 51 and any of the auxiliary excitation elements P1 through P4' to be combined. This allows an antenna device of three-types for linear polarization and right and left-handed circular polarizations to be formed as one antenna structure. Thus, it is fully possible to apply the antenna device 500 having any radiated polarization switching mechanism to an MIMO communication system that is preferably suitable for any radio wave environments.

Figure 22:
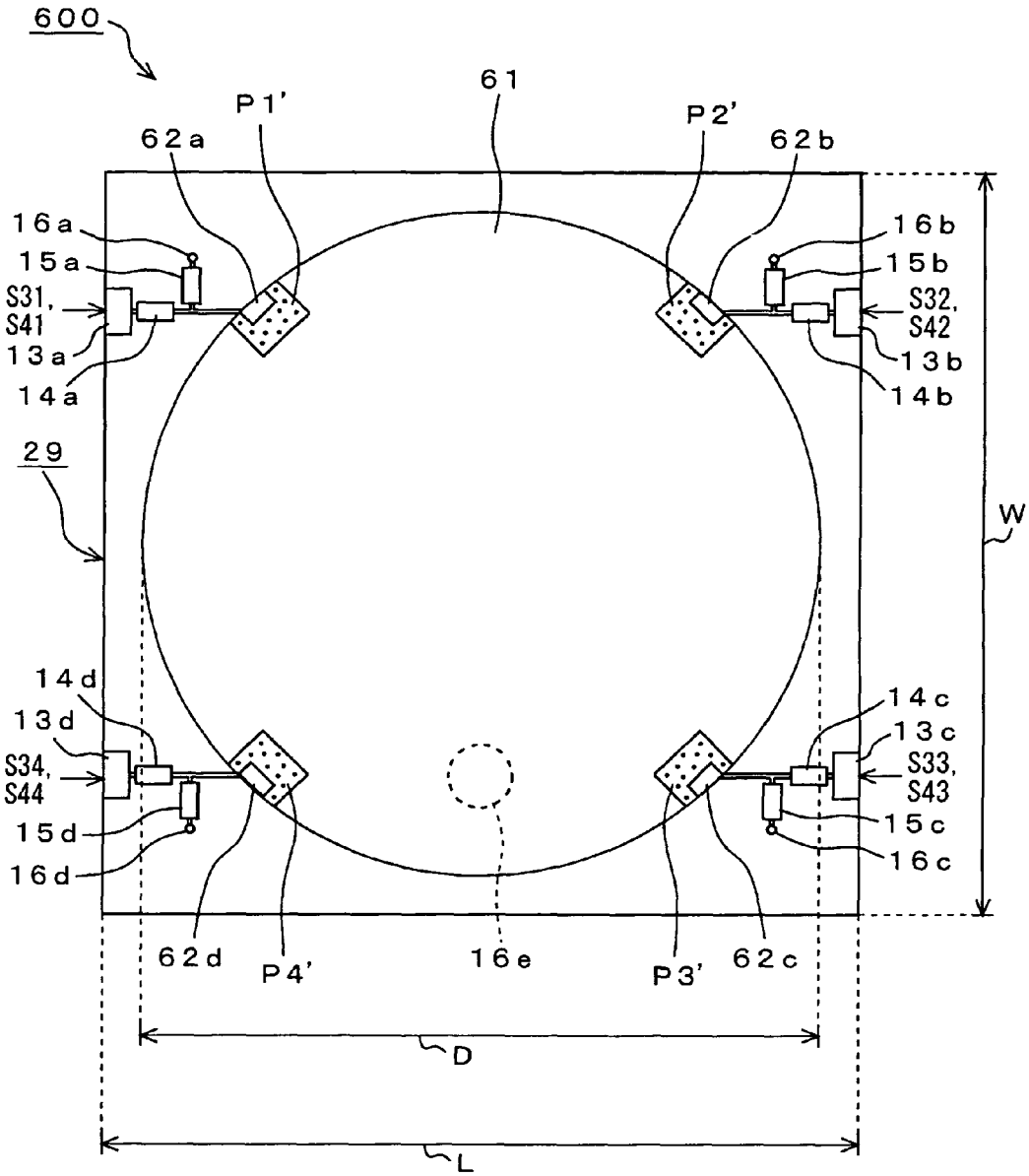
FIG. 22 is a diagram for showing a configuration of an antenna device according to a six embodiment of the invention.

FIG. 22 shows a configuration of an antenna device 600 according to a six embodiment of the invention.

The antenna device 600 shown in FIG. 22 is preferably applicable to antenna device, which receives and transmits signals according to the MIMO communication system at the same time using plural flat antennas, and a wireless communication apparatus using the antenna device. The antenna device 600 has a dielectric substrate 29 and a conductive main excitation device 61, which is positioned on the substrate 29. The main excitation device 61 has a circle shape. The substrate 29 has a length of L and a width of W. The main excitation device 61 has a diameter of D (D<L, W). The main excitation device 61 is made of the same materials as those of the fifth embodiment and by means of the same manufacturing method as that of the fifth embodiment.

The square-like auxiliary excitation elements P1' through P4' (perturbation elements or perturbation elements) for polarization control as examples of conductive polarization control elements are positioned on predetermined positions along a circumference of the main excitation device 61 with a pair of the auxiliary excitation elements P1' through P4' being faced to each other around a center of the circular main excitation device 61. For example, the square-like auxiliary excitation elements P1' through P4' are positioned on positions, which are away from each other by every 90 degrees on the circumference of the main excitation device 61, along two diagonals in the substrate 29, as shown in FIG. 22. The auxiliary excitation elements P1' through P4' are made of semi-conductive plastic material, which is different from those of the main excitation device 61. The auxiliary excitation elements P1' through P4' are formed so that four portions of the circular main excitation device 61 are cut away like squares from positions on the circumference OF the circular main excitation device 61 to expose the underlaid substrate 29 and the semi-conductive plastic sheets are adhered to the exposed portions of the substrate 29.

In this embodiment, the auxiliary excitation elements P1' through P4' are installed on (connected with) each of the cutaway portions on the circumference of the main excitation device 61. The function control from conduction to insulation and vice versa of the auxiliary excitation elements P1' through P4' can switch the polarization that a flat antenna (hereinafter referred to as "circular patch antenna") radiates.

Similar to the fifth embodiment, the dielectric substrate 29 has four control terminals 13*a* through 13*d*. The control terminal 13*a* is connected to a control electrode 62*a* of the auxiliary excitation element P1' through a choke coil 14*a*. A bypass capacitor 15*a* is connected with the control electrode 62*a* and a GND pattern, which is not shown. The choke coil 14*a*, the bypass capacitor 15*a* and the like form a filter for preventing high-frequency current from being diffracted, which can be connected to any lines for a direct-current power supply at need. Such the filter can be laid out on any suitable positions.

The GND pattern is provided on a rear surface of the substrate 29, which is similar to the fifth embodiment. The bypass capacitor 15*a* is connected to the GND pattern via a through-hole 16*a*. Similarly, other control terminals 13*b* through 13*d* are respectively connected to control electrodes 62*b* through 62*d* of the auxiliary excitation elements P2' through P4' via choke coils 14*b* through 14*d*. Further, similarly, bypass capacitors 15*b* through 15*d* are respectively connected to the GND pattern via through-holes 16*b* through 16*d*.

Direct-current biased voltage (hereinafter referred to as "function-controlling signal") S31 through S34, S41 through S44 to select the function of each of the auxiliary excitation elements P2' through P4' is supplied to each of the control terminals 13*a* through 13*d* so as to be applied across each of the control electrodes 62*a* through 62*d* and the GND pattern. The control terminals 13*a* through 13*d* and the GND pattern 17 is connected to a function control unit (a function controller), which is not shown. In the auxiliary excitation elements P1' through P4', the direct-current biased voltage is applied across each of the pairs of auxiliary excitation elements P1 and P3 as well as P2 and P4. The auxiliary excitation elements P1 and P3 are faced to each other on a transverse line across the circular main excitation device 61. Similarly, the auxiliary excitation elements P2 and P4 are faced to each other on a transverse line across the circular main excitation device 61. Thus, this circular patch antenna also radiates polarization such as circular polarization like right-handed circular polarization or left-handed circular polarization, linear polarization and the like, which is similar to the fifth embodiment.

Since the main excitation device 61 according to the sixth embodiment of the invention has such the circular patch pattern, the invention is not limited to the square patch antenna like the fifth embodiment. Based on any concept of the invention, the antenna device 600 having the circular patch antenna is applicable to any various kinds of wireless communication apparatuses.

Figure 23:
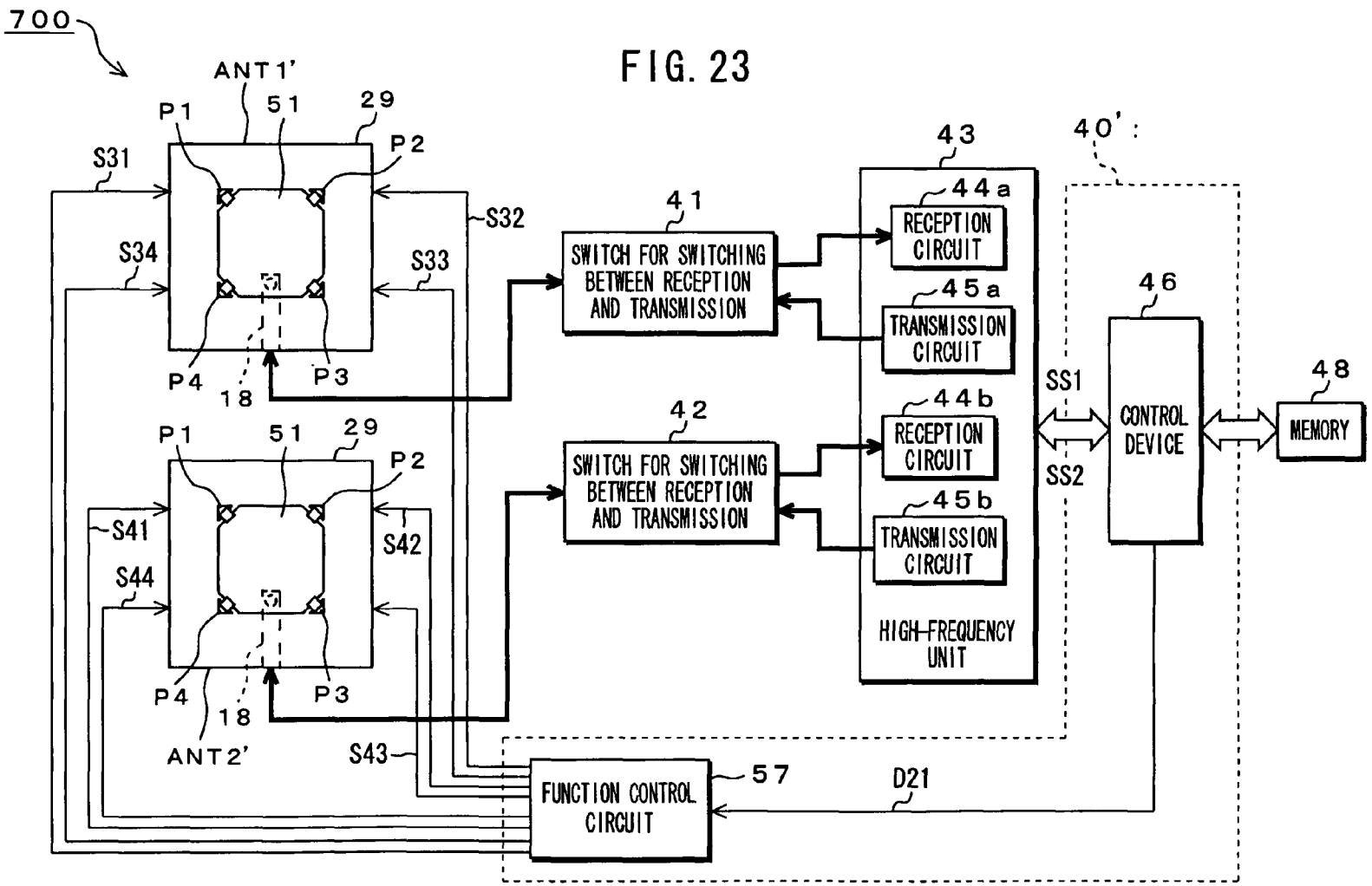
FIG. 23 is a block diagram for showing a configuration of a wireless communication apparatus to which the antenna device is applied according to a seventh embodiment of the invention.

FIG. 23 shows a configuration of a wireless communication apparatus 700 to which the antenna devices 500 are applied, according to a seventh embodiment of the invention.

In the embodiment, the wireless communication apparatus 700 uses N antenna devices (N are at least two) and N reception-and-transmission circuits (N are at least two). The wireless communication apparatus 700 suitably controls the antenna devices to radiate the polarizations, thereby implementing the MIMO communication (transmission) system that is preferable to any radio wave environment used. In this embodiment, the antenna devices 500 described in the fifth embodiment are respectively used as antennas ANT1', ANT2'.

The wireless communication apparatus 700 shown in FIG. 23 has a communication control unit 40', a high-frequency unit 43, a memory 48, two antenna devices ANT1', ANT2', and two switches 41, 42 for switching between reception and transmission. The wireless communication apparatus 700 implements the MIMO communication. The high-frequency unit 43 includes two reception circuits 44*a*, 44*b* and two transmission circuits 45*a*, 45*b*.

The switch 41 is connected to the antenna device ANT1'. The switch 41 switches between the reception circuit 44*a* and the transmission circuit 45*a* in the high-frequency unit 43 so that any one of the reception circuit 44*a* and the transmission circuit 45*a* can be connected to a feeding terminal (the through-hole 16*e*) of the antenna device ANT1'. The feeding terminal is connected to the main excitation device 51 of the antenna device ANT1' via the micro strip line 18, thereby feeding a transmission signal to the feeding terminal and receiving a reception signal from the feeding terminal. The feeding terminal and the micro strip line 18 form a feeding circuit.

The reception circuit 44*a* and the transmission circuit 45*a* forms a reception-and-transmission circuit that receives and transmits signals according to the MIMO communication system using the antenna device ANT1'.

The reception circuit 44*a* is connected to the antenna device ANT1' through the switch 41 and receives the signal from the antenna device ANT1' through the switch 41 to perform any reception processing based on MIMO communication system.

The transmission circuit 45*a* is connected to the antenna device ANT1' through the switch 41 and perform any transmission processing on a signal based on MIMO communication system to feed the signal to the antenna device ANT1', through the switch 41, from which the signal is transmitted.

The switch 42 is connected to the antenna device ANT2'. The switch 42 switches between the reception circuit 44*b* and the transmission circuit 45*b* in the high-frequency unit 43 so that any one of the reception circuit 44*b* and the transmission circuit 45*b* can be connected to a feeding terminal (the through-hole 16*e*) of the antenna device ANT2'. The feeding terminal is connected to the main excitation device 51 of the antenna device ANT2' via the micro strip line 18, thereby feeding a transmission signal to the feeding terminal and receiving a reception signal from the feeding terminal. The feeding terminal and the micro strip line 18 form a feeding circuit.

The reception circuit 44*b* and the transmission circuit 45*b* forms a reception-and-transmission circuit that receives and transmits signals according to the MIMO communication system using the antenna device ANT2'.

The reception circuit 44*b* is connected to the antenna device ANT2' through the switch 42 and receives the signal from the antenna device ANT2' through the switch 42 to perform any reception processing based on MIMO communication system.

The transmission circuit 45*b* is connected to the antenna device ANT2' through the switch 42 and perform any transmission processing on a signal based on MIMO communication system to feed the signal to the antenna device ANT2', through the switch 42, from which the signal is transmitted.

The communication control unit 40' is connected with the antenna devices ANT1', ANT2' and the high-frequency unit 43 and controls the direct-current voltage applied across each of the control electrodes 52*a* through 52*d* of the antenna devices ANT1', ANT2' based on quality of communication of each of the signals received by the reception circuits 44*a*, 44*b*. For example, the communication control unit 40' switches between conduction and insulation of each of the auxiliary excitation elements P1 through P4 of the antenna device ANT1' based on quality of communication of the signal received by the reception circuit 44*a* and switches between conduction and insulation of each of the auxiliary excitation elements P1 through P4 of the antenna device ANT2' based on quality of communication of the signal received by the reception circuits 44*b*.

The communication control unit 40' has a control device 46 and a function control circuit 57 for the auxiliary excitation elements P1 through P4 of the antenna devices ANT1', ANT2'. The function control circuit 57 is connected to the antenna devices ANTI', ANT2'. The function control circuit 57 is also connected to the control device 46. The control device 46 includes a central processing unit (CPU), a micro processing unit (MPU), A/D converter, D/A converter, modulation/demodulation (Base Band) circuit, media access control (MAC) circuit, and a user interface, which are not shown.

The control device 46 controls the antenna devices ANT1', ANT2' using the high-frequency unit 43 and the function control circuit 57. For example, the control device 46 transmits a function-change-over signal SS1 to the switch 41 to switch between reception and transmission functions of the antenna device ANT1' and transmits a switch-change-over signal SS2 to the switch 42 to switch between reception and transmission functions of the antenna device ANT2'.

Further, the control device 46 performs function controls from conduction to insulation and vice versa of the four auxiliary excitation elements P1 through P4, which are successively connected to the main excitation device 51 of each of the antenna devices ANT1', ANT2', based on quality of communication of each of the signals received by the reception circuits 44*a*, 44*b*. The reception circuits 44*a*, 44*b* measure reception sensitivity (received signal strength indicator (RSSI)). In a case of IEEE802.11a scheme, the reception sensitivity is given by monitoring an automatic gain control (AGC) signal before a quadrature amplitude demodulation has been carried out. Of course, the reception sensitivity can be given by any other methods, in addition to this, such as detection of the decoded data.

For example, the control device 46 determines whether RSSI stays within a fixed range. If RSSI stays out of the fixed range, for example, RSSI stays under a lower threshold value or stays beyond an upper threshold value, the control device 46 transmits function control data D21 for commanding and controlling any switch of polarizations to the function control circuit 57. Thus, the function control circuit 57 allows the switch of polarizations that the antenna devices ANT1', ANT2' radiate to be controlled (polarization diversity).

The control device 46 also controls the transmission circuits 45*a*, 45*b* based on quality of communication of each of the signals received by the reception circuits 44*a*, 44*b* to make suitable a subcarrier modulation scheme of each of the transmission signals that the transmission circuits 45*a*, 45*b* feed (transmit) to the antenna devices ANT1', ANT2'. Such control of the subcarrier modulation scheme enables to be implemented any MIMO communication (transmission) system that is preferably applicable to any radio wave environment used.

The memory 48 as an example of the storage medium is connected to the control device 46. As the memory 48, a read-only memory (ROM), a random-access memory (RAM) that can write or read information at any time, an electrically erasable programmable ROM (EEPROM) that can electrically erase or write information and/or a hard disk drive (HDD) are used. The memory 48 stores a control program for wireless communication apparatus that receives and transmits the signals according to the MIMO communication system.

The control program includes the steps of: setting direct-current biased voltage applied across each of the control electrodes 52*a* through 52*d* of the antenna devices ANT1', ANT2'; detecting quality of communication by the square patch antenna formed based on the set direct-current biased voltage applied across each of the control electrodes 52*a* through 52*d*; maintaining the setting on the direct-current biased voltage applied across each of the control electrodes 52*a* through 52*d* based on the detected quality of communication by the square patch antenna; and performing the communication by the maintained setting on the direct-current biased voltage applied across each of the control electrodes 52*a* through 52*d*.

Thus, using the control program stored in the memory 48 enables three types of the square patch antennas formed by a combination of the main excitation device 51 and any of the auxiliary excitation elements P1 through P4 to be selected. Further, the square patch antenna is made optimal and thus, the optimal square patch antenna can receive and transmit the signals for polarization such as linear polarization and left and right-handed circular polarizations.

The function control circuit 57 receives the function control data D21 from the control device 46 and generates function selection signals (direct-current biased voltages) S31 through S34 and S41 through S44 based on the function control data D21. Regarding the antenna device ANT1', the function control circuit 57 transmits the function selection signal S31 to the auxiliary excitation element P1; the function selection signal S32 to the auxiliary excitation element P2; the function selection signal S33 to the auxiliary excitation element P3; and the function selection signal S34 to the auxiliary excitation element P4. Based on these function selection signals S31 through S34, the auxiliary excitation elements P1 through P4 of the antenna device ANT1' are made conductive or insulated.

The function control circuit 57 receives the function control data D21 from the control device 46. Regarding the antenna device ANT2', the function control circuit 57 transmits the function selection signal S41 to the auxiliary excitation element P1; the function selection signal S42 to the auxiliary excitation element P2; the function selection signal S43 to the auxiliary excitation element P3; and the function selection signal S44 to the auxiliary excitation element P4. Based on these function selection signals S41 through S44, the auxiliary excitation elements P1 through P4 of the antenna device ANT2' are made conductive or insulated.

In this embodiment, the auxiliary excitation elements P1 through P4 having the control electrodes 52*a* through 52*d* are arranged clock-wise on four corners along two diagonals in the main excitation device 51 and forward biased voltage is applied across a pair of the electrodes 52*a* and 52*c* of the auxiliary excitation elements P1 and P3 arranged along one diagonal therein while reverse biased voltage is applied across a pair of the electrodes 52*b* and 52*d* of the auxiliary excitation elements P2 and P4 arranged along the other diagonal therein. These applications of biased voltages can make the auxiliary excitation elements P1 and P3 conductive while the auxiliary excitation elements P2 and P4 insulated.

Contrarily, reverse biased voltage can be applied across a pair of the electrodes 52*a* and 52*c* while forward biased voltage can be applied across a pair of the electrodes 52*b* and 52*d*. These applications of biased voltages can make the auxiliary excitation elements P1 and P3 insulated while the auxiliary excitation elements P2 and P4 conductive. Thus, selections of conduction or insulation of each of the auxiliary excitation elements P1 through P4 enable the patch antenna to radiate circular polarization for right or left-handed circular polarization. If forward biased voltage is applied across all the control electrodes 52*a* through 52*d*, all the auxiliary excitation elements P1 through P4 can be made conductive, thereby enabling the patch antenna to radiate linear polarization.

and P4 of the square patch antenna in the antenna device ANT1' are made insulated, the antenna device ANT1' radiates right-handed circular polarization (RHCP). If the auxiliary excitation elements P1 and P3 of the square patch antenna in the antenna device ANT2' are made insulated while the auxiliary excitation elements P2 and P4 of the square patch antenna in the antenna device ANT2' are made conductive, the antenna device ANT2' radiates left-handed circular polarization (LHCP).

If the auxiliary excitation elements P1 and P3 of the square patch antenna in the antenna device ANT1' are made insulated while the auxiliary excitation elements P2 and P4 of the square patch antenna in the antenna device ANT1' are made conductive, the antenna device ANT1' radiates left-handed circular polarization (LECP). If the auxiliary excitation elements P1 and P3 of the square patch antenna in the antenna device ANT2' are made conductive while the auxiliary excitation elements P2 and P4 of the square patch antenna in the antenna device ANT2' are made insulated, the antenna device ANT2' radiates right-handed circular polarization (RHCP).

If all the auxiliary excitation elements P1 through P4 of the square patch antenna in the antenna device ANT1' are made conductive, the antenna device ANT1' radiates linear polarization (LINEAR). If all the auxiliary excitation elements P1 through P4 of the square patch antenna in the antenna device ANT2' are made conductive, the antenna device ANT2' radiates linear polarization (LINEAR). It is to be noted that "conduction" in the TABLE 2 indicates that the main excitation device 51 of each of the antenna devices ANTI', ANT2' is electrically connected to each of the auxiliary excitation elements P1 through P4. If this is shown according to a geometry

TABLE 2

| | AUXILIARY EXITATION ELEMENTS OF ANT 1' | | AUXILIARY EXITATION ELEMENTS OF ANT 2' | | OPERATING |
|---|---|---|---|---|---|
| COMBINATIONS | 1, 3 | 2, 4 | 1, 3 | 2, 4 | STATES |
| 1 | CONDUCTION | INSULATION | INSULATION | CONDUCTION | ANT 1' RADIATES RHCP ANT 2' RADIATES LHCP |
| 2 | INSULATION | CONDUCTION | CONDUCTION | INSULATION | ANT 1' RADIATES LHCP ANT 2' RADIATES RHCP |
| . . . | . . . | | . . . | | |
| . . . | CONDUCTION | CONDUCTION | CONDUCTION | CONDUCTION | ANT 1' RADIATES LINER ANT 2' RADIATES LINER |
| . . . N | . . . | | . . . | | |

TABLE 2 indicates combinations of four the auxiliary excitation elements P1 through P4 and operating states of the antenna devices ANTI', ANT2' as the antenna device 500. In the TABLE 2, if the auxiliary excitation elements P1 and P3 of the square patch antenna in the antenna device ANT1' are made conductive while the auxiliary excitation elements P2 equivalent pattern, the main excitation device 51 and the auxiliary excitation elements P1 through P4 are integrated on an identical plane. It is also to be noted that "insulation" in the TABLE 2 indicates that the main excitation device 51 of each of the antenna devices ANT1', ANT2' is electrically disconnected to each of the auxiliary excitation elements P1 through P4. If this is shown according to a geometry equivalent pattern, four corners of the square patch antenna are cut away so that the auxiliary excitation elements P1 through P4 are not electrically significant on an identical plane.

Thus, if all the auxiliary excitation elements P1 through P4 are made conductive, the antenna devices ANT1', ANT2' radiate the linear polarizations, not circular polarizations. This allows the square patch antenna in each of the antenna devices ANT1', ANT2' to select any one of the three types of the polarizations, linear polarization and right and left-handed circular polarizations. If the three types of the radiated polarizations are selected so that their communication states can be made optimal, it is possible to perform any reception and/or transmission that are/is optimally suitable for radio wave environment that a user uses.

The following will describe a control method of controlling the wireless communication apparatus according to the invention.

Figure 24:
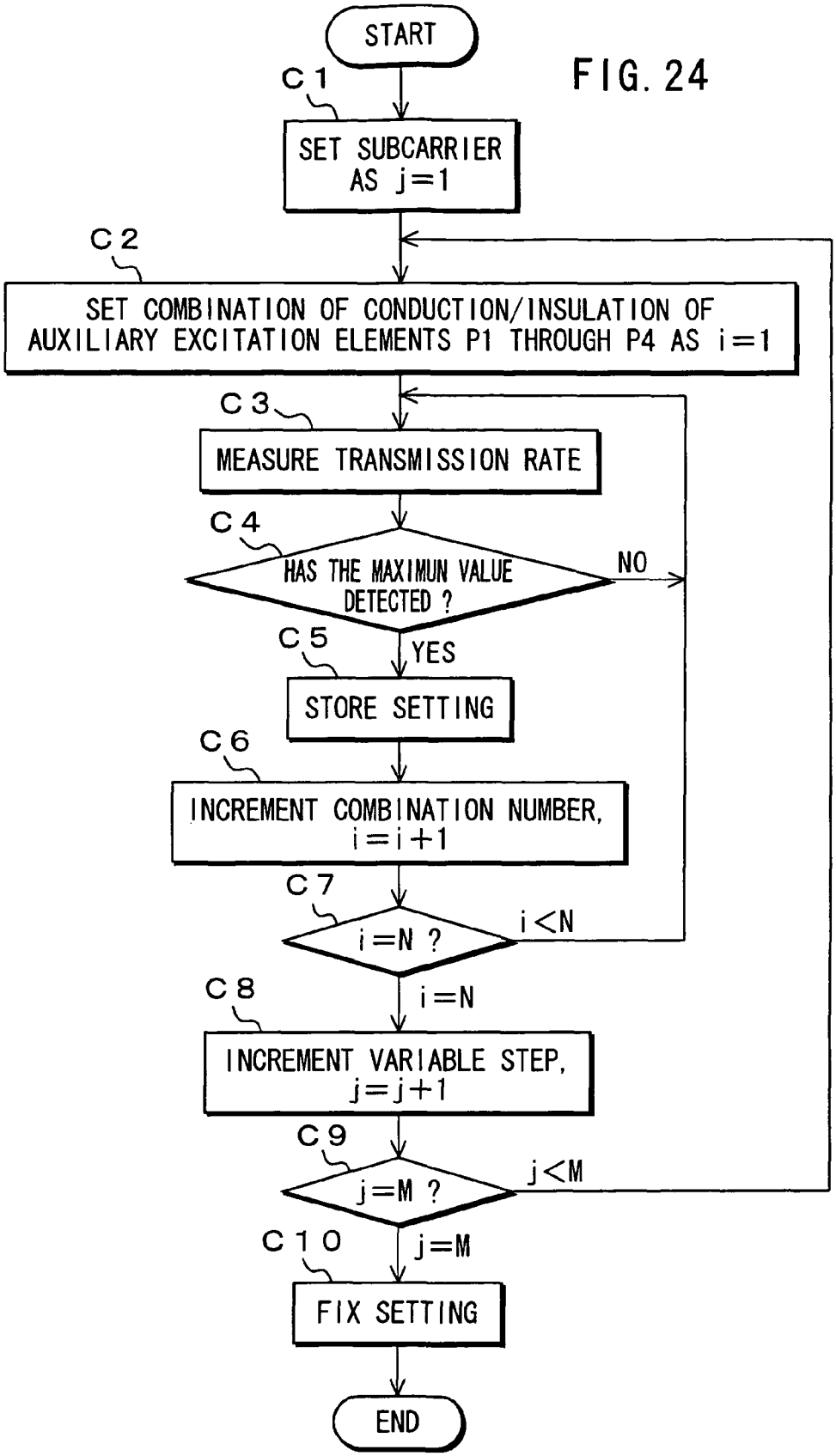
FIG. 24 is a flowchart for showing a control method of controlling the wireless communication apparatus to which the antenna devices are applied.

FIG. 24 is a flowchart for showing the control method of controlling the wireless communication apparatus 700 to which the antenna devices 500 are applied. In this embodiment, it is estimated that in each of the antenna devices ANT1', ANT2', the auxiliary excitation elements P1 through P4 that are connected with the conductive main excitation device 51 having an octagonal shape, which is positioned on the dielectric substrate 29, and each of the auxiliary excitation elements P1 through P4 for polarization control, which are positioned along diagonals in the main excitation device 51, are provided so that the antenna devices ANT1', ANT2' can switch over the polarizations that the square patch antennas radiate by means of controlling direct-current biased voltage allied across each of the control electrodes 52*a* through 52*d* to use conduction or insulation of the auxiliary excitation elements P1 through P4, thereby enabling the antenna devices ANT1', ANT2' to receive and transmit the signals according to the MIMO communication system.

According to the MIMO communication system used in this embodiment, N (i=1, . . . , N) species of combinations of the conduction or insulation of the auxiliary excitation elements P1 through P4 alter so that setting of a maximum value of the reception and/or transmission rate(s) can be extracted (found) like the forth embodiment. Then, M (j=1, . . . , M) species of subcarrier modulations are carried out so that the subcarriers alter, for example, from 64QAM to 16QAM, further to 8PSK, additionally to QPSK, to set any state of each of the antenna devices as having their maximum reception and/or transmission rates with the subcarrier altering, thereby enabling the wireless communication apparatus to receive and/or transmit the signals from and to any corresponding wireless communication apparatus.

Thus, suppose that such the operation setting is given, at step C1 of the flowchart shown in FIG. 24, the subcarrier is set as j=1. For example, the subcarrier is set as 64QAM. At step C2, the combination of conduction/insulation of the auxiliary excitation elements P1 through P4 of each of the antenna devices ANT1', ANT2' is then set as i=1. In this moment, direct-current biased voltage to be applied across each of the control electrodes 52*a* through 52*d* of the antenna devices ANT1', ANT2' is set.

At step C3, reception and/or transmission rates of the signals at the setting of a case of j=1 and i=1 are measured. For example, reception circuits 44*a*, 44*b* measure reception sensitivities (RSSI). This is because this measurement can detect quality of communication by a square patch antenna formed by the set direct-current biased voltage that is applied across each of the control electrodes 52*a* through 52*d*.

The process then goes to step C4 where it is determined (detected) whether the maximum reception and/or transmission rate(s) are/is given. If the maximum rate(s) are/is given, the process goes to step C5 where setting of the combination of conduction or insulation of each of the auxiliary excitation elements P1 through P4 of the antenna devices ANT1', ANT2' is stored (registered). In this moment, setting of the direct-current biased voltage that is applied across each of the control electrodes 52*a* through 52*d* based on the previously given quality of communication by the square patch antenna is maintained.

The process then goes to step C6 where number of the combination of the conduction or insulation of each of the auxiliary excitation elements P1 through P4 is incremented by one (i=i+1) and the process goes to step C7. At the step C7, it is determined whether N species of combinations of the conduction or insulation of each of the auxiliary excitation elements P1 through P4 have been completed. If N species of combinations have not yet been completed, namely, i<N, the process goes back to the step C3 where reception and/or transmission rate(s) are/is measured. Then, the procedures such as determination, storage, and increment, in steps C4 through C6 are repeated.

If N species of combinations have been completed, namely, i=N, at the step C7, the process goes to step C8 where a variable step of the subcarrier is incremented by one, j=j+1. For example, the subcarrier is changed from 64QAM to 16QAM.

The process then goes to step C9 where it is determined whether M species of variable steps of the subcarrier have been completed. If M species of variable steps have not yet been completed, namely, j<M, the process goes back to the step C2. At the step C2, the combination of conduction/insulation of the auxiliary excitation elements P1 through P4 of each of the antenna devices ANT1', ANT2' is then set as i=1. At the step C3, reception and/or transmission rate(s) of the signals at the setting of a case of j=2 and i=1 are/is measured.

The process then goes to step C4 where it is determined (detected) whether the maximum reception and/or transmission rate(s) are/is given in order to determine whether quality of communication by the square patch antenna is optimal. If the maximum reception and/or transmission rate(s) are/is given, the process goes to step C5 where setting of the combination of conduction/insulation of the auxiliary excitation elements P1 through P4 of each of the antenna devices ANT1', ANT2 ', which have optimal quality of communication that has been detected, is maintained (extracted).

The process then goes to step C6. Thus, the steps C2 through C7 are repeated wherein the setting of the combination of conduction/insulation of the auxiliary excitation elements P1 through P4, which has been determined as being optimal, is changed and maintained.

If, at the step C7, N species of the combination of conduction/insulation of the auxiliary excitation elements P1 through P4 have been completed, namely, i=N; at the step C8, the variable step of the subcarrier is incremented by one, j=j+1; and at step C9, j<M, the process goes back to the step C2 where the above processes are repeated. If j=M at the step C9, the process goes to step C10 where the setting is fixed. Such the setting of the combination of conduction/insulation of the auxiliary excitation elements P1 through P4 in which the optimal quality of communication is detected allows optimal communication to be implemented. Using the polarization thereof enables wireless communication processing by the MIMO communication system that is suitable to any radio wave environment used to be implemented.

Figures 25A, 25B:
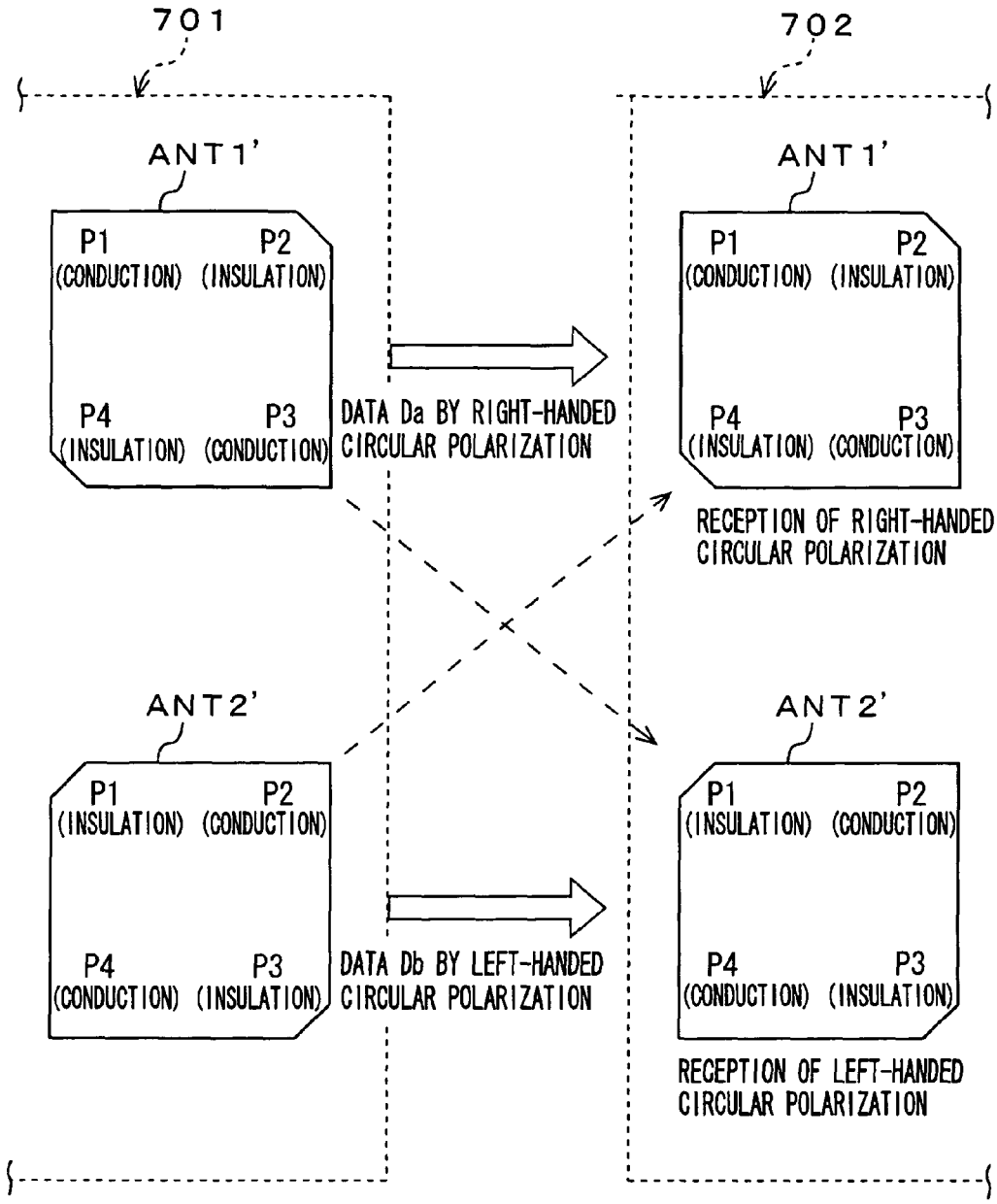
FIGS. 25A and 25B are diagrams each for showing an example of reception and transmission of signals according to MIMO communication system between wireless communication apparatuses when radio wave is not reflected.

FIGS. 25A and 25B show an example of reception and transmission of signals according to MIMO communication system between wireless communication apparatuses 701, 702 when radio wave is not reflected.

In this embodiment, the MIMO communication system is implemented by using two antenna devices ANT1', ANT2' when receiving and/or transmitting data. It proceeds with the talks on the assumption that communication process is carried out using the multipath environment. For example, the wireless communication apparatus 700 shown in FIG. 23 is applied to the wireless communication apparatus 701 shown in FIG. 25A on which two almost square antenna devices ANT1', ANT2' are arranged. The antenna device 500 or 600 as the fifth or sixth embodiment can be applied to each of the antenna devices ANT1', ANT2'.

According to this embodiment, in the antenna device ANT1' of the wireless communication apparatus 701, the auxiliary excitation elements P1 and P3 are made conductive while the auxiliary excitation elements P2 and P4 are made insulated, thereby enabling the antenna device ANT1' to radiate right-handed circular polarization. If this is shown according to a geometry equivalent pattern, the antenna device ANT1' is shown as a square patch pattern from which a right upper portion and a left lower portion are cut. This is a case where the antenna device ANT1' radiates data Da by the right-handed circular polarization.

Further, according to this embodiment, in the antenna device ANT2' of the wireless communication apparatus 701, the auxiliary excitation elements P1 and P3 are made insulated while the auxiliary excitation elements P2 and P4 are made conductive, thereby enabling the antenna device ANT2' to radiate left-handed circular polarization. If this is shown according to a geometry equivalent pattern, the antenna device ANT2' is shown as a square patch pattern from which a left upper portion and a right lower portion are cut. This is a case where the antenna device ANT2' radiates data Db by the right-handed circular polarization.

The wireless communication apparatus 700 shown in FIG. 23 is also applied to the wireless communication apparatus 702 shown in FIG. 25B on which two almost square antenna devices ANT1', ANT2' are arranged. The antenna device 500 or 600 as the fifth or sixth embodiment is also applied to each of the antenna devices ANT1', ANT2'.

According to this embodiment, in the antenna device ANT1' of the wireless communication apparatus 702, the auxiliary excitation elements P1 and P3 are made conductive while the auxiliary excitation elements P2 and P4 are made insulated, thereby enabling the antenna device ANT1' to radiate right-handed circular polarization. If this is shown according to a geometry equivalent pattern, the antenna device ANT1' is shown as a square patch pattern from which a right upper portion and a left lower portion are cut. This is a case where the antenna device ANT1' radiates data Da by the right-handed circular polarization.

Further, according to this embodiment, in the antenna device ANT2' of the wireless communication apparatus 702, the auxiliary excitation elements P1 and P3 are made insulated while the auxiliary excitation elements P2 and P4 are made conductive, thereby enabling the antenna device ANT2' to radiate left-handed circular polarization. If this is shown according to a geometry equivalent pattern, the antenna device ANT2' is shown as a square patch pattern from which a left upper portion and a right lower portion are cut. This is a case where the antenna device ANT2' radiates data Db by the right-handed circular polarization.

In the MIMO communication system of polarizations thus set, if there is no object by which radio wave is reflected, the antenna device ANT1' of the wireless communication apparatus 701 radiates the data Da by the right-handed circular polarization and the antenna device ANT1' of the wireless communication apparatus 702, which is ready for receiving the data Da by the right-handed circular polarization, receives the data Da. Similarly, the antenna device ANT2' of the wireless communication apparatus 701 radiates the data Db by the left-handed circular polarization and the antenna device ANT2' of the wireless communication apparatus 702, which is ready for receiving the data Db by the left-handed circular polarization, receives the data Db.

Figures 26A, 26B:
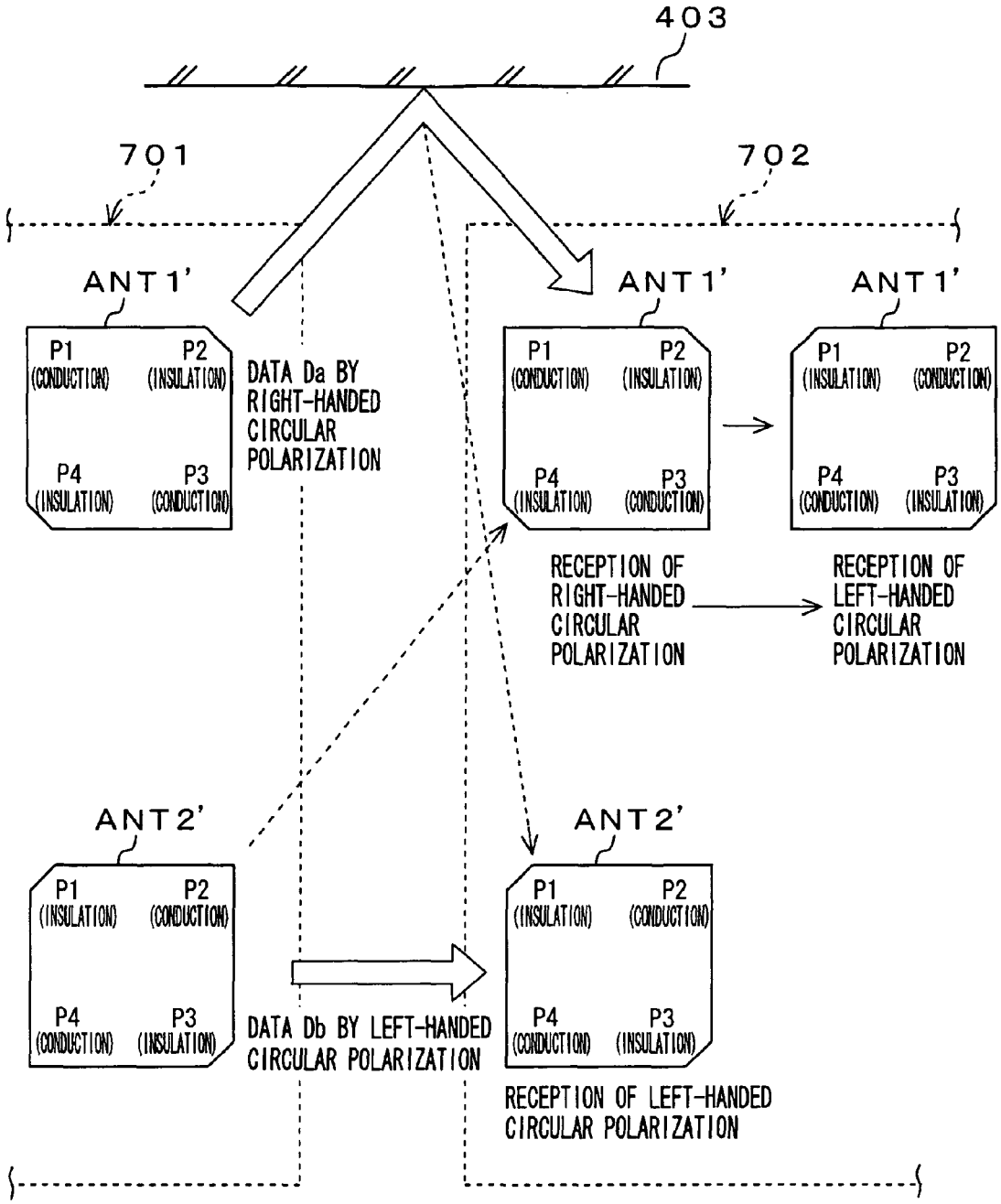
FIGS. 26A and 26B are diagrams each for showing an example of reception and transmission of signals according to MIMO communication system between wireless communication apparatuses when radio wave is reflected by an object.

FIGS. 26A and 26B show an example of reception and transmission of signals according to MIMO communication system between the wireless communication apparatuses 701, 702 when radio wave is reflected by an object 403.

In this embodiment, according to the MIMO communication system, any interference may occur between the polarizations that should be orthogonalized by any influence of reflection by the object 403 under maltipath environment. On a case shown in FIGS. 26A and 26B, when radio wave radiated by the antenna device ANT1' of the wireless communication apparatus 701 is reflected one time, circular polarization of the reflected radio wave is made reverse. When the antenna device ANT1', ANT2' radiate radio wave by the right-handed circular polarization and the left-handed circular polarization, their circular polarizations are finally established as same-handed circular polarization by the reflection of the radio wave radiated by the antenna device ANT1' so that any interference may occur even if a distinction between the right-handed circular polarization and the left-handed circular polarization is established in the radiated radio wave.

On the other hand, even if the antenna device ANT1', ANT2' radiate radio wave by the same-handed circular polarization when radio wave radiated by the antenna device ANT1' of the wireless communication apparatus 701 is reflected by the object 403 one time, circular polarization of the reflected radio wave is made reverse, thereby preventing any interference from occurring in spite of any influence of the reflection.

Thus, under the multipath environment, the polarization variously alters. Even if the polarizations are orthogonalized when radiating radio wave, this may not be necessarily reached to any excellent quality of communication under any radio wave environment. For example, the wireless communication apparatus 702 shown in FIG. 26B receives as direct wave, nor reflected wave, the data Db by left-handed circular polarization radiated by the antenna device ANT2' of the wireless communication apparatus 701 shown in FIG. 26A. The wireless communication apparatus 702 shown in FIG. 26B also receives, as reflected wave, the data Da by right-handed circular polarization radiated by the antenna device ANT1' of the wireless communication apparatus 701.

In this case, the wireless communication apparatus 702 receives radio wave with only the antenna device ANT1' thereof being switched from its right-handed circular polarization to its left-handed circular polarization while the antenna device ANT2' thereof is kept unchanged. Namely, in the antenna device ANT1' of the wireless apparatus 702, conductions of the auxiliary excitation elements P1 and P3 are changed to insulations while insulations of the auxiliary excitation elements P2 and P4 are changed to conductions. Thus, it is possible that any interference does not occur.

In this embodiment, sensitivity of a received signal (RSSI or the like) is detected and according to this RSSI, the wireless apparatus 702 receives radio wave with its circular polarizations being preferably switched from right-handed circular polarization to left-handed circular polarization and vice versa easily.

The following will describe an examination of detection of RSSI.

Figure 27:
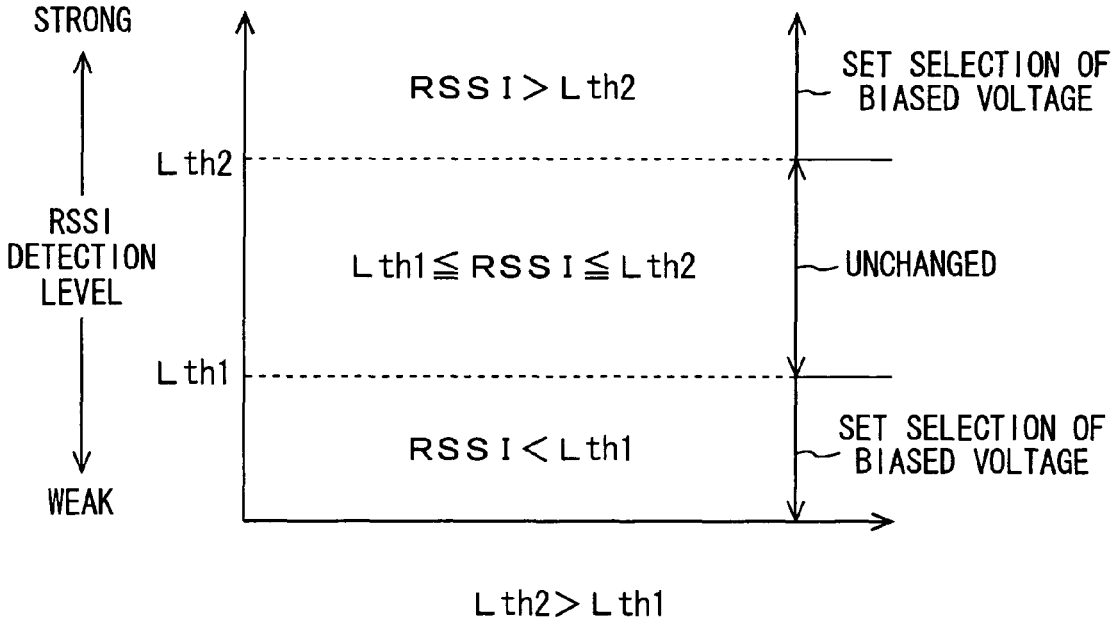
FIG. 27 is a diagram for showing a RSSI detection level, which indicates an example of setting threshold values when controlling selection of switches (polarizations)
Figure 28:
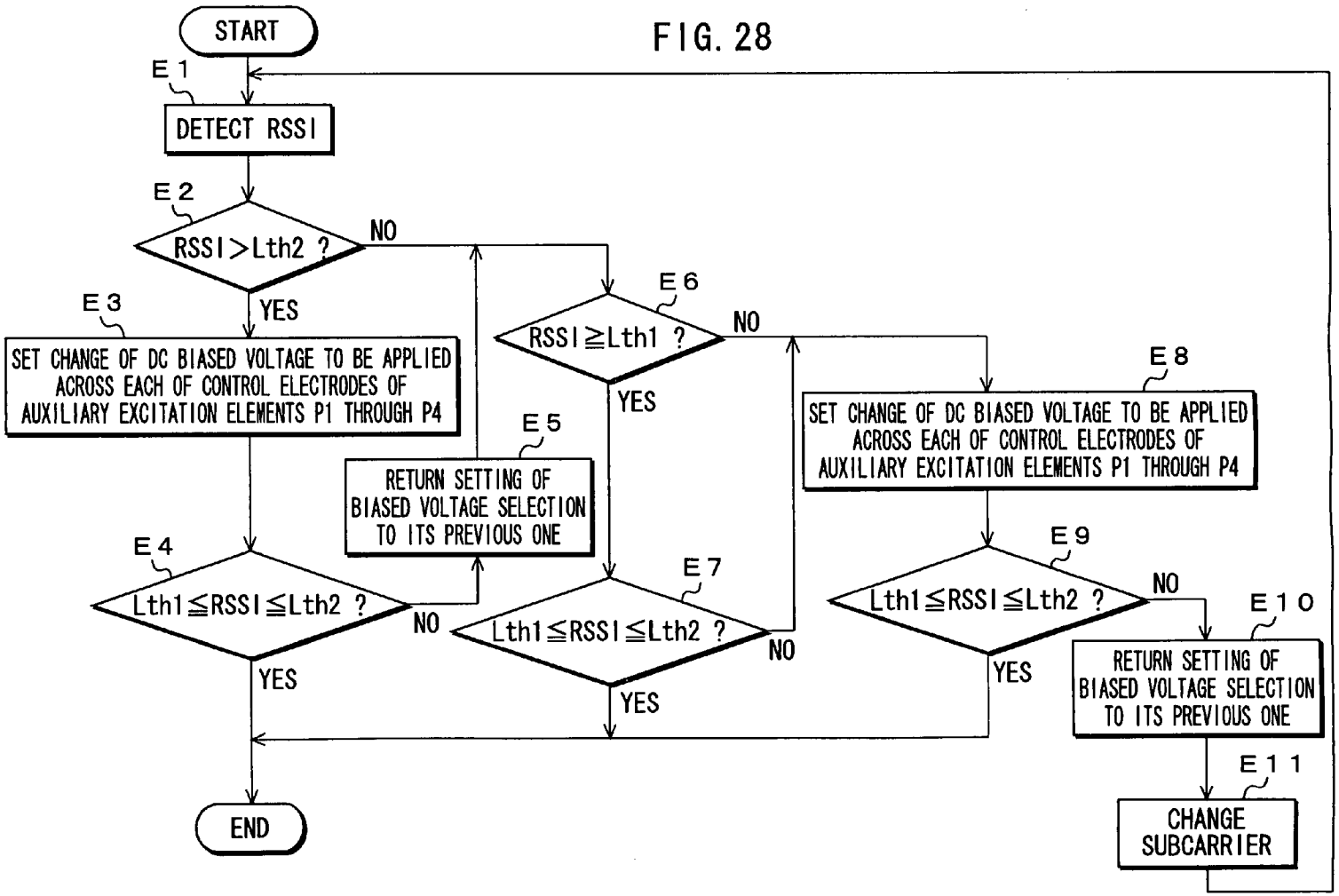
FIG. 28 is a flowchart for showing an example of controlling selection of polarizations in the wireless communication apparatus at the receiving side.

FIG. 27 shows an RSSI detection level, which indicates an example of setting threshold values when controlling selection of direct-current biased voltages (polarizations). FIG. 28 is a flowchart for showing an example of controlling selection of polarizations in the wireless communication apparatus 702 at the receiving side.

In this embodiment, if, according to the RSSI, the wireless apparatus 702 or the like receives radio wave with its circular polarizations being switched from right-handed circular polarization to left-handed circular polarization and vice versa, a lower threshold value Lth1 and an upper threshold value Lth2 (Lth1<Lth2) are set relative to the RSSI detection level, as shown in FIG. 27, like the fourth embodiment. It proceeds with the talks on the assumption that the circular polarizations are switched from right-handed circular polarization to left-handed circular polarization and vice versa based on the threshold values Lth1, Lth2.

In this embodiment, the direct-current voltages applied across each of the control electrodes 52*a* through 52*d* of the auxiliary excitation elements P1 through P4 are changed to select the polarizations only if RSSI>Lth2 and RSSI<Lth1. If Lth1<=RSSI<=Lth2, the direct-current voltages are not changed to keep the current receiving state unchanged.

Under these change conditions of the direct-current voltages (polarizations), at step E1 of the flowchart shown in FIG. 28, RSSI is detected. The reception circuits 44*a* and 44*b* of the wireless communication apparatus 702 detect the RSSI and transmit RSSI detection data to the control device 46.

At step E2, the control device 46 compares the detected RSSI with the upper threshold value Lth2 based on the RSSI detection data to determine whether the RSST is more than Lth2, RSSI>Lth2. If the RSST is more than Lth2, the process goes to step E3 where the direct-current biased voltages to be applied across each of the control electrodes 52*a* through 52*d* of the auxiliary excitation elements. P1 through P4 are changed to select the polarizations (see FIGS. 26A and 26B).

At step E4, the control device 46 determines whether the detected RSSI stays within a range from the lower threshold value Lth1 to the upper threshold value Lth2, Lth1<=RSSI<=Lth2. If the RSSI stays within the range, the control device 46 keeps current receiving state of the wireless communication apparatus 702 unchanged.

At the step E2, if not RSSI>Lth2, namely, the detected RSSI is equal to Lth2 and less than Lth2, the process goes to step E6. At the step E4, if not Lth1<=RSSI<=Lth2, the process goes to step E5 where setting of selection of direct-current biased voltage returns to its previous one and the process goes to step E6.

At the step E6, the control device 46 compares the detected RSSI with the lower threshold value Lth1 to determine whether the RSST is less than Lth1, RSSI<Lth1.

If the RSST is equal to or more than Lth1, the process goes to step E7 where the control device 46 determines whether the detected RSSI stays within a range from the lower threshold value Lth1 to the upper threshold value Lth2, Lth1<=RSSI<=Lth2. If the RSSI stays within the range, the control device 46 keeps current receiving state of the wireless communication apparatus 702 unchanged. If the RSST is less than Lth1 at the step E6, the process goes to step E8 where the control device 46 changes the direct-current biased voltages to be applied across each of the control electrodes 52*a* through 52*d* of the auxiliary excitation elements P1 through P4 to select the polarizations. The process then goes to step E9 where the control device 46 determines whether the detected RSSI stays within a range from the lower threshold value Lth1 to the upper threshold value Lth2, Lth1<=RSSI<=Lth2. If the RSSI stays within the range, the control device 46 keeps current receiving state of the wireless communication apparatus 702 unchanged.

At the step E9, if not Lth1<=RSSI<=Lth2, the process goes to step E10 where setting of selection of the direct-current voltage to its previous one and the process then goes to step E11 where any subcarrier is changed. The process further goes back to the step E1 and repeats processes in the above steps.

Thus, according to the wireless communication apparatus and the control method of controlling the same, as the seventh embodiment of the invention, the antenna devices ANT1', ANT2' are applied thereto, the octagonal conductive main excitation device 51 is arranged on the dielectric substrate 29, and the semi-conductive auxiliary excitation elements P1 through P4 for controlling the polarizations are positioned along the diagonals in the main excitation device 51. The auxiliary excitation elements P1 through P4 respectively has the control electrodes 52*a* through 52*d*. The direct-current biased voltages applied across each of the control electrodes 52*a* through 52*d* are controlled.

In this embodiment, application of forward biased voltage to each of the control electrodes 52*a*, 52*c* of the auxiliary excitation elements P1 and P3 positioned along one diagonal in the main excitation device 51 while application of reverse biased voltage to each of the control electrodes 52*b*, 52*d* of the auxiliary excitation elements P2 and P4 positioned along the other diagonal in the main excitation device 51 allows the main excitation device 51 and the auxiliary excitation elements P1, P3 to be electrically connected while the main excitation device 11 and the auxiliary excitation elements P2, P4 to be electrically disconnected. This enables an antenna structure of circular polarization specifying the right-handed circular polarizations to be configured.

Contrarily, application of reverse biased voltage to each of the control electrodes 52*a*, 52*c* of the auxiliary excitation elements P1 and P3 while application of forward biased voltage to each of the control electrodes 52*b*, 52*d* of the auxiliary excitation elements P2 and P4 allows the main excitation device 51 and the auxiliary excitation elements P1, P3 to be electrically disconnected while the main excitation device 11 and the auxiliary excitation elements P2, P4 to be electrically connected. This enables an antenna structure of circular polarization specifying the left-handed circular polarizations to be configured.

If reverse biased voltage is applied to all the control electrodes 52*a* through 52*d* of the auxiliary excitation elements P1 through P4 arranged on four corners positioned along two diagonals in the main excitation device 51, this enables an antenna structure of linear polarization to be configured.

Thus, control of the direct-current biased voltage applied to each of the control electrodes 52*a* through 52*d* of the auxiliary excitation elements P1 through P4 enables each of the auxiliary excitation elements P1 through P4 to be made conductive or insulated. This allows the combination of conduction or insulation of the auxiliary excitation elements P1 through P4 to be selected, thereby switching the polarizations that the square patch antenna radiates. This enables three types of antennas for linear polarization and right and left-handed circular polarizations to be configured as one antenna structure like the fourth embodiment.

Although, in the above embodiments, cases where the auxiliary excitation elements P1 through P4 are respectively arranged on four corners positioned along two diagonals in the main excitation device 51 have been described, this invention is not limited thereto. For example, only two auxiliary excitation elements can be respectively arranged on two corners positioned along one diagonal in the main excitation device 51 in order to reduce the costs thereof. If the two auxiliary excitation elements, for example, P1, P3 are made conductive or insulated, the linear polarization or the circular polarization (right or left-handed circular polarization) can be selected so that optimal quality of communication can be detected.

Although, in the embodiments, cases where the antenna device (square patch antennas) ANT1', ANT2' described in the fifth embodiment are applied to the wireless communication apparatus and the like have been described, this invention is not limited thereto. For example, the wireless communication apparatus to which plural antenna devices 600 having the circular patch pattern described in the sixth embodiment can be configured. The wireless communication apparatus can obtain an excellent effect similar to that of the wireless communication apparatus 700 as the seventh embodiment.

The embodiments of the invention are preferably applied to an antenna device, a wireless communication apparatus and the like that receive and transmit the signals according to the MIMO communication system at the same time using plural square patch antennas.

It should be understood by those skilled in the art that various modifications, combinations, sub-combinations and alternations may occur depending on design requirements and other factors insofar as they are within the scope of the appended claims or the equivalents thereof.

What is claimed is:

1. An antenna device comprising:

a substrate of insulation formed in a substantially rectangular shape;

a ground pattern formed on a lower surface of the substrate;

a conductive flat antenna main body, formed on an upper surface of the substrate having an octagonal shape and including an RF feeding point, the conductive flat antenna main body being configured to radiate an RF signal and being positioned on the substrate;

a plurality of triangular semiconductive polarization control elements each positioned on diagonal transverse lines across the flat antenna main body over an insulation region of the substrate, each diagonal transverse line bisecting opposite corners of the substrate, the transverse lines intersecting in a center of the conductive flat antenna main body; and a plurality of control electrodes, each arranged on one of the triangular semiconductive polarization control elements to apply a biasing voltage thereto; and a plurality of control terminals each connected to one of the plurality of control electrodes, each of the control terminals receiving the biasing voltage to control conductivity of a respective triangular semiconductive polarization control element, wherein a subset of said plurality of triangular semiconductive polarization control elements are in a conductive state when a forward biasing voltage is applied by corresponding control electrodes to move anions from the substrate to the subset of the plurality of triangular semiconductive polarization control elements, and the subset of the plurality of triangular semiconductive polarization control elements are in a non-conductive state when a reverse biasing voltage is applied via the corresponding control electrodes to move anions from the substrate to the ground pattern, a state of the plurality of triangular semiconductive polarization control elements determining a polarization of the antenna device.

2. The antenna device according to claim 1 wherein two of the control electrodes arranged on triangular semiconductive polarization control elements along a first of the diagonal transverse lines apply a forward biasing voltage to the triangular semiconductive polarization control elements along the first diagonal transverse line while another two of the control electrodes on triangular semiconductive polarization control elements arranged along a second of the diagonal transverse lines apply a reverse biasing voltage to the triangular semiconductive polarization control elements along the second diagonal transverse line.

3. The antenna device according to claim 1 wherein all control electrodes apply a forward biasing voltage to the plurality of triangular semiconductive polarization control elements.

4. The antenna device according to claim 1, wherein each of the plurality of control terminals is arranged on an edge of the substrate.

5. The antenna device according to claim 1, further comprising:

a plurality of filters configured to reject high-frequency current, each of the plurality of filters being connected between one of the plurality of control terminals and one of the plurality of control electrodes.

6. The antenna device according to claim 5, wherein each filter includes a choke coil connected in series between the one of the plurality of control terminals and the one of the plurality of control electrodes, and a bypass capacitor connected between the one of the control electrodes and ground.

7. A wireless communication apparatus comprising:

at least two antenna devices;

at least two reception-and-transmission circuits configured to transmit and receive signals according to a multi-input-multi-output communication system, each of said reception-and-transmission circuits being connected to each of the antenna devices; and a communication control unit configured to control the antenna devices and the reception-and-transmission circuits, each of the antenna devices including a substrate of insulation formed in a substantially rectangular shape;

a ground pattern formed on a lower surface of the substrate;

a conductive flat antenna main body, formed on an upper surface of the substrate having an octagonal shape and including an RF feeding point, the conductive flat antenna main body being configured to radiate an RF signal and being positioned on the substrate;

a plurality of triangular semiconductive polarization control elements each positioned on diagonal transverse lines across the flat antenna main body over an insulation region of the substrate, each diagonal transverse line bisecting opposite corners of the substrate, the transverse lines intersecting in a center of the conductive flat antenna main body; and a plurality of control electrodes, each arranged on one of the triangular semiconductive polarization control elements to apply a biasing voltage thereto; and a plurality of control terminals each connected to one of the plurality of control electrodes, each of the control terminals receiving the biasing voltage to control conductivity of a respective triangular semiconductive polarization control element, wherein a subset of said plurality of triangular semiconductive polarization control elements are in a conductive state when a forward biasing voltage is applied by corresponding control electrodes to move anions from the substrate to the subset of the plurality of triangular semiconductive polarization control elements, and the subset of the plurality of triangular semiconductive polarization control elements are in a non-conductive state when a reverse biasing voltage is applied via the corresponding control electrodes to move anions from the substrate to the ground pattern, a state of the plurality of triangular semiconductive polarization control elements determining a polarization of the antenna device.

8. The wireless communication apparatus according to claim 7 wherein the communication control unit applies biasing voltages to the plurality of triangular semiconductive polarization control elements based on a quality of communication of a signal received by each of the reception-and-transmission circuits.

9. The wireless communication apparatus according to claim 7 wherein the communication control unit controls a sub carrier modulation scheme of a signal transmitted by each of the reception-and-transmission circuits corresponding to quality of communication of a signal received by the reception-and-transmission circuits.

10. The wireless communication apparatus according to claim 7 wherein each of the reception-and-transmission circuits includes:

a reception circuit that receives a signal based on the multi-input-multi-output communication system;

a transmission circuit that transmits a signal based on the multi-input-multi-output communication system;

a switch for transmitting and receiving the signals, said switch being connected to the reception circuit and the transmission circuit; and a feeding circuit that is connected to the switch at one terminal thereof and is connected to the antenna device at the other terminal thereof; and wherein the switch switches connection of the feeding circuit to any one of the reception circuit and the transmission circuit.

11. An antenna device comprising:

a substrate of insulation formed in a substantially rectangular shape;

a ground pattern formed on a lower surface of the substrate;

a conductive flat antenna main body, formed on an upper surface of the substrate and having a circular shape and including an RF feeding point, the conductive flat antenna main body being configured to radiate an RF signal and being positioned on the substrate;

a plurality of semiconductive polarization control elements each positioned within a circumference of the flat antenna main body on diagonal transverse lines across the flat antenna main body over an insulation region of the substrate, each diagonal transverse line bisecting opposite corners of the substrate, the transverse lines intersecting in a center of the conductive flat antenna main body; and a plurality of control electrodes each arranged on one of the plurality of semiconductive polarization control elements to apply a biasing voltage thereto; and a plurality of control terminals each connected to one of the plurality of control electrodes to receive the biasing voltage, wherein a subset of the plurality of semiconductive polarization control elements are in a conductive state when a forward biasing voltage is applied by corresponding control electrodes to move anions from the substrate to the subset of the plurality of semiconductive polarization control elements, and the subset of the plurality of semiconductive polarization control elements are in a non-conductive state when a reverse biasing voltage is applied via the corresponding control electrodes to move anions from the substrate to the ground pattern, a state of the plurality of polarization control elements determining a polarization of the antenna device.

* * * * *